US010767521B1

(12) United States Patent
Hills

(10) Patent No.: US 10,767,521 B1
(45) Date of Patent: Sep. 8, 2020

(54) OVERHEAD SLIDING ROTARY VALVE ASSEMBLY AND METHOD OF USE

(71) Applicant: Larry Kenneth Hills, Lexington, KY (US)

(72) Inventor: Larry Kenneth Hills, Lexington, KY (US)

( * ) Notice: Subject to any disclaimer, the term of this patent is extended or adjusted under 35 U.S.C. 154(b) by 69 days.

(21) Appl. No.: 16/659,540

(22) Filed: Oct. 21, 2019

(51) Int. Cl.

| | |
|---|---|
| ***F01L 7/14*** | (2006.01) |
| ***F01L 7/02*** | (2006.01) |
| *F01L 11/02* | (2006.01) |
| *F01L 7/16* | (2006.01) |

(52) U.S. Cl.
CPC ..... *F01L 7/026* (2013.01); *F01L 7/021* (2013.01); *F01L 7/14* (2013.01); *F01L 7/16* (2013.01); *F01L 11/02* (2013.01); *F01L 2101/00* (2013.01); *F01L 2250/04* (2013.01)

(58) Field of Classification Search
CPC ... F01L 1/047; F01L 2105/00; F01L 13/0036; F01L 13/0042; F01L 2001/0475; F01L 1/143
See application file for complete search history.

(56) References Cited

U.S. PATENT DOCUMENTS

| | | | | |
|---|---|---|---|---|
| 5,249,553 | A | 10/1993 | Guiod | |
| 6,006,714 | A | 12/1999 | Griffin et al. | |
| 6,308,677 | B1 * | 10/2001 | Bohach | F01L 7/021 123/190.1 |
| 6,651,605 | B2 | 11/2003 | Trentham | |
| 7,044,097 | B2 | 5/2006 | Wright | |
| 7,089,893 | B1 | 8/2006 | Pizarro et al. | |
| 7,234,428 | B2 * | 6/2007 | Nagel | F01L 1/026 123/90.27 |
| 8,210,147 | B2 | 7/2012 | Cotton | |
| 8,459,227 | B2 | 6/2013 | Carver | |
| 8,776,756 | B2 | 7/2014 | Carver | |
| 2005/0247278 | A1 * | 11/2005 | Koshimizu | F01L 1/022 123/90.16 |
| 2018/0179920 | A1 * | 6/2018 | Yokoyama | F01L 1/053 |

OTHER PUBLICATIONS

COMP Cams Catalogue part # 01-710-9 [37].
Piston Ring Handbook; korihandbook.federalmogul.com/en/section_25.htm.

* cited by examiner

*Primary Examiner* — Long T Tran
(74) *Attorney, Agent, or Firm* — Francis Law Firm PLLC; James M. Francis

(57) ABSTRACT

A variable port engine assembly and method of use utilizing a rotating camshaft having different sized ports that are dynamically aligned with intake, combustion, and exhaust ports and timed to open and close with appropriate engine cycles to change gas flow volumes through the combustion chamber to modify fuel efficiency and power.

12 Claims, 48 Drawing Sheets

OVERHEAD SLIDING ROTARY VALVE ASSEMBLY AND METHOD OF USE

TECHNICAL FIELD

The apparatus of the present application relates to a device and means to vary the size of intake and exhaust ports in a four-cycle engine.

BACKGROUND

Four-cycle internal combustion engines have, as their name implies, four cycles (strokes): (1) intake stroke, (2) compression stroke, (3) power stroke, and (4) exhaust stroke. A simplistic explanation of the four cycles begins with the piston at top dead center (TDC), intake stroke initiates with the opening of intake valve as the piston begins to move down the cylinder. The open intake valve permits the introduction of air and fuel into the combustion chamber. The downward movement of the piston creates a vacuum that pulls an air-fuel mixture into the cylinder. As the piston reaches bottom dead center (BDC), intake valve closes. At this point, intake and exhaust valves are closed. During the compression stroke, the piston moves up the cylinder, compressing an air-fuel mixture. As the piston reaches TDC, a spark plug ignites the mixture converting the potential energy of the air/fuel mixture into kinetic energy. During the power stroke, the pressure created by exploding air-fuel mixture forces the piston down the cylinder and the power created by the explosion is captured as mechanical energy, which turns the crankshaft as the reciprocating motion of the piston is converted into rotational motion by the crankshaft. As the piston reaches BDC, the exhaust valve opens. During the exhaust stroke, the piston moves back up the cylinder forcing the waste gases out of the combustion chamber through the open exhaust valve. At TDC, the exhaust valve closes and the four-cycle process begins again. A video at "Animated Engines—Four Stroke" visualizes the four-cycle process.

The precise control of intake valve and exhaust valve in a four-stroke engine is more complicated than as described in the commonly utilized simplistic explanation. With intake stroke, intake valve opens while the piston is moving up the cylinder and reaches a point a few degrees prior to reaching TDC position. The number of degrees dictated by the design of the camshaft is fixed. The piston continues to TDC, reverses direction, and starts back down the cylinder. The downward movement of the piston creates a vacuum that pulls an air-fuel mixture into the combustion chamber through the open intake valve port. Intake valve opens a few degrees after bottom dead center (ABDC). The number of degrees is fixed by the design of the camshaft. At this point, intake and exhaust valves are closed for the beginning of the compression stroke. During the compression stroke, a few degrees before top dead center (BTDC), the spark plug ignites the mixture. The engine control system determines when this occurs. During the power stroke, the pressure created by the exploding air-fuel mixture forces the piston down the cylinder. During the exhaust stroke, the exhaust valve opens a few degrees before bottom dead center (BBDC). The precise number of degrees when this occurs is fixed by the design of the camshaft is fixed. The piston is then forced back up the cylinder forcing the waste gases and combustion by-products out of the combustion chamber through the exhaust valve. A few degrees after top dead center (ATDC), the exhaust valve closes. At this point in the cycle both valves, intake and exhaust, are open. This is called the overlap. An example of overlap can be seen at "Engine camshaft animation (500-7000 rpm at the end)."

Most four-cycle internal combustion engines utilize a lobed camshaft that is fixed in its duration, (i.e., the number of degrees of crankshaft rotation where intake and exhaust valves are open), and timing, (i.e., the rotational position of the crankshaft in degrees BTDC/BBDC where the valves start to open and the position of crankshaft in degrees ABDC/ATDC where the valves are closed). The duration and timing dictate to a large degree the smoothness at idle and the maximum horsepower. In automobiles, a smooth idle is very desirable for occupant comfort.

Horsepower of these engines can be increased by installing superchargers and/or turbochargers. Superchargers and turbochargers add cost and complexity, leading to additional opportunity for engine failure. Both superchargers and turbochargers require a "waste gate" that regulates the internal pressure of intake system by bleeding off the pressure, thus preventing "preignition." Waste gates direct excess pressure into the exhaust system, thus wasting energy created by turbochargers and superchargers. Pre-ignition is an event where the air/fuel mixture in the cylinder ignites before the spark plug actuates and can severely damage an engine. Pre-ignition, in its milder form, is termed "knock." Cars with computer-controlled engines have "knock sensors," typically a microphone tuned to listen for knock(s), which detect these pre-ignition events and signal the engine control system, which acts to reduce ignition advance. A video depicting knocking, pre-ignition and examples of damage caused by pre-ignition can be found in "Knocking and Pre-ignition."

In U.S. Pat. No. 5,249,553, duration is determined by the cams and intake/exhaust ports. The cam duration is derived by measuring the number of degrees it is open to the combustion chamber. Intake/exhaust port duration is derived by measuring the number of degrees during which intake/exhaust cams are open. In U.S. Pat. No. 5,249,553, the cam's contribution to duration is approximately 140° while intake/exhaust port contribution is approximately 80°. The camshaft is geared to rotate half the rate as the crankshaft. To determine the duration, the two (2) angles (140° and 80°) are summed (220°) and then doubled, resulting in 440°. Engines with this degree of duration are not suitable for everyday use. A camshaft for a racing engine, COMP Cams Catalogue part #01-710-9 [37], has 322° degrees of intake duration and 330° of exhaust duration. The revolutions per minute (RPM) range for an engine equipped with this camshaft is 5000 to 7800. "Parts Details: Buick 4.1 L camshaft" depicts camshaft specifications, including duration (exhaust 194°/intake) 188°, for a typical engine, e.g. a Buick V-6. Duration can be listed two ways; one is an absolute measurement while the other is duration once the valve has lifted 1.27 mm (0.050 inch). Poppet valves are not functional until they are moved 1.27 mm (0.050 inch) off their seat, resulting in two different durations listed.

U.S. Pat. Nos. 8,210,147, 8,459,227, and 8,776,756 have extremely complicated mechanisms with many additional parts. They employ an additional crankshaft, two connecting rods, two sliding spool valves, and six pairs of sealing rings. All of these would act to limit the maximum RPM achievable as these reciprocating motions would add to existing noise and vibration created by the engine crankshaft, connecting rods, and pistons.

In U.S. Pat. No. 6,308,677, the oval-shaped cam ports restrict maximum flow. Additionally, this configuration provides only one level of horsepower and idle characteristics.

U.S. Pat. No. 6,651,605 discloses a complex valve system combined with a throttle. The camshaft rotates within a throttle shaft, which is a metal cylinder with cutouts to control flow. This configuration creates significant friction between the camshaft and throttle shaft, which increases with RPMs, and makes it difficult to regulate the throttle.

U.S. Pat. No. 7,044,097 employs a cylinder head with two rotatable camshafts. The camshafts have ports perpendicular to the axis of the camshaft. This configuration provides only one set of engine performance characteristics.

U.S. Pat. No. 6,006,714 provides an alternative to poppet valves for motor vehicles and other applications including gasoline, diesel, natural gas or other internal combustion engines. The aspiration system of the present invention operates without reciprocating valve heads and associated valve seats or other conventional seals and without any valve elements that extend into the engine cylinders.

U.S. Pat. No. 7,089,893 utilizes a valve system for a combustion engine, which possesses a fixed cylindrical valve shaft.

The aforementioned inventions suffer from a number of disadvantages, such as changing the duration and/or timing requires engine disassembly and existing camshaft(s) must be removed and replaced with camshaft(s) of different duration and/or timing and the engine reassembled; changing lobed camshaft(s) is expensive and time consuming, requiring numerous special jigs, tools, and fixtures; idle characteristics for these inventions are fixed; maximum horsepower is fixed; engines equipped with poppet valves are limited in terms of maximum RPMs and poppet valves are reciprocating mass prone to failure because as the engine RPMs rise, the reciprocating mass will overcome the resistance provided by the valve springs, resulting in contact between valve(s) and piston(s); each aforementioned invention has complicated reciprocating mechanisms that are prone to excessive wear and tend to limit engine maximum RPMs; poppet valve engines require clearances (valve lash) between the cam and the valve, but eventually clearances are reduced to zero and the valve will start to open, resulting in a loss of duration and timing; and manufacturing lobed camshafts is complicated and requires expensive, high precision equipment. In accordance with each invention, a four-cycle internal combustion engine contains camshaft(s), sleeve valves or other valve systems that is/are fixed in their duration and timing, necessitating a tradeoff between smooth idle and maximum horsepower. Moreover, the aforementioned inventions do not allow for individualized duration and timing for each cylinder.

SUMMARY

The present application discloses a novel cylindrical valve shaft assembly that allows for the selection of an alternate intake/exhaust port size by the use of cylindrical valve shafts possessing at least two intake/exhaust ports per cylinder, whereby the shafts are laterally repositioned to permit the selection of one of at least two available intake/exhaust port sizes and/or geometries.

The invention allows for full aspiration, (i.e., intake and exhaust, of multiple combustion chambers with only one moving part within the aspiration head, and no separate seals, moving bearings, lubricants, or coolants). In addition, the aspiration system of the present invention can achieve substantially ideal aspiration timing with enhanced air throughput and can thereby allow internal combustion engines to more closely approach their theoretical potential with reduced harmful emissions.

In one aspect, the aspiration system of the present invention allows for charging and exhausting of a combustion chamber of an internal combustion engine via transverse flows through a rotor. According to this aspect of the invention, the aspiration system includes a rotor having a rotation axis, an intake subsystem including two intake passageways each having an end adjacent to the rotor, and an exhaust subsystem including two exhaust passageways each having an end adjacent to the rotor. The intake subsystem can be used to deliver charge or just an oxygen-containing gas such as air to the combustion chamber, (i.e., the fuel can be delivered separately). The passageway ends of the respective intake subsystem and the exhaust subsystem are located at substantially overlapping longitudinal positions relative to the rotation axis of the roller. That is, each of the intake passageway ends are located at substantially the same position or in at least partially overlapped positions along the length of the rotor, and the same is true with respect to the exhaust passageway ends. The intake passageway ends can be located in longitudinally overlapping positions relative to the exhaust passageway ends or can be offset there from. The rotor includes at least one transverse bore for alternately allowing communication between the intake passageways and between the exhaust passageways. A single bore can be used for intake and exhaust or more than one bore can be provided. Preferably, the bore(s) allows for substantially linear flow, transversely through the rotor. In one embodiment, a straight bore extending diametrically through a cylindrical rotor alternately interconnects the intake passageways and the exhaust passageways. The aspiration system thereby employs a rotor for sealing of intake and exhaust, has a reduced length relative to the rotation axis, and allows for increased flow rates to and from the combustion chamber.

Accordingly, the present application provides cylinder heads and camshafts that create excellent idle characteristics and two levels of horsepower. Camshafts manufactured to fit the requirements of each engine, camshafts that are less expensive to manufacture than engines equipped with the aforementioned valve systems and traditional valve systems. The disclosed camshaft and head combination have no RPM limit and eliminates duration and timing loss due to clearances (valve lash). The disclosed camshafts can be replaced with minimal engine disassembly and special tools. The disclosed camshafts can be configured to each valve of each cylinder, each having its own duration and timing thus, allowing for equal air/fuel distribution to all cylinders to compensate for manifold design. The present application also discloses an engine, which omits the following failure prone parts: reciprocating (i.e.: poppet) intake and exhaust valves, lobed camshafts, rocker arms, lifters, push rods, valve guides, valve springs, valve locks and valve retainers, and other related hardware needed for actuation.

The present apparatus recognizes and addresses the previously mentioned long-felt needs and provides utility in meeting those needs in its various possible embodiments. To one of skill in this art who has the benefits of this disclosure's teachings, other and further objects and advantages will be clear, as well as others inherent therein. The disclosures herein are not intended to limit the scope of the invention, merely to provide context with which to understand the patent claims.

BRIEF DESCRIPTION OF THE DRAWINGS

FIG. 119 shows a cropped section view of the cylinder head assembly.

FIG. 120 shows a side view of the cylinder head assembly.

FIG. 121 shows a cropped section view of the cylinder head assembly.

FIG. 122 shows a side view of the cylinder head assembly.

FIG. 123 shows a cropped section view of the cylinder head assembly.

FIG. 124 shows a side view of the cylinder head assembly.

FIG. 125 shows a cropped section view of the cylinder head assembly.

FIG. 126 shows the cylinder head assembly.

FIG. 127 shows exploded view of the cylinder head assembly.

DETAILED DESCRIPTION OF THE PREFERRED EMBODIMENTS

Figure 1:
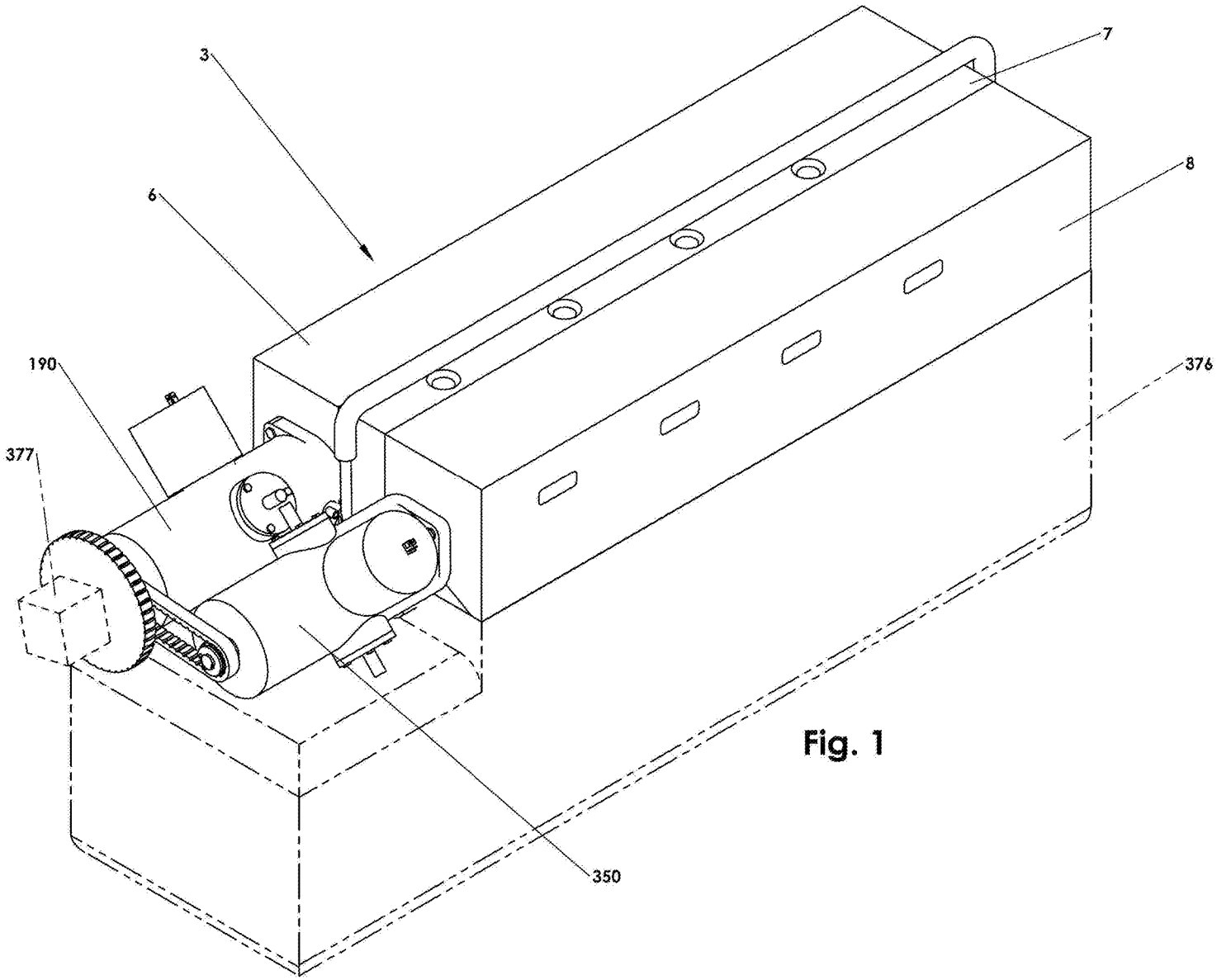
FIG. 1 shows the cylinder head assembly with a phantom engine block.

An embodiment of an engine assembly 3 of the present applicaton is depicted in FIG. 1. Additionally, discloses the following assemblies: intake section 6, center section 7, exhaust section 8, intake cam drive and shift assembly 190, exhaust cam drive and shift assembly 350, engine block 376 (unclaimed matter), and electronic cam advance-retard device 377 (unclaimed matter).

Figure 2:
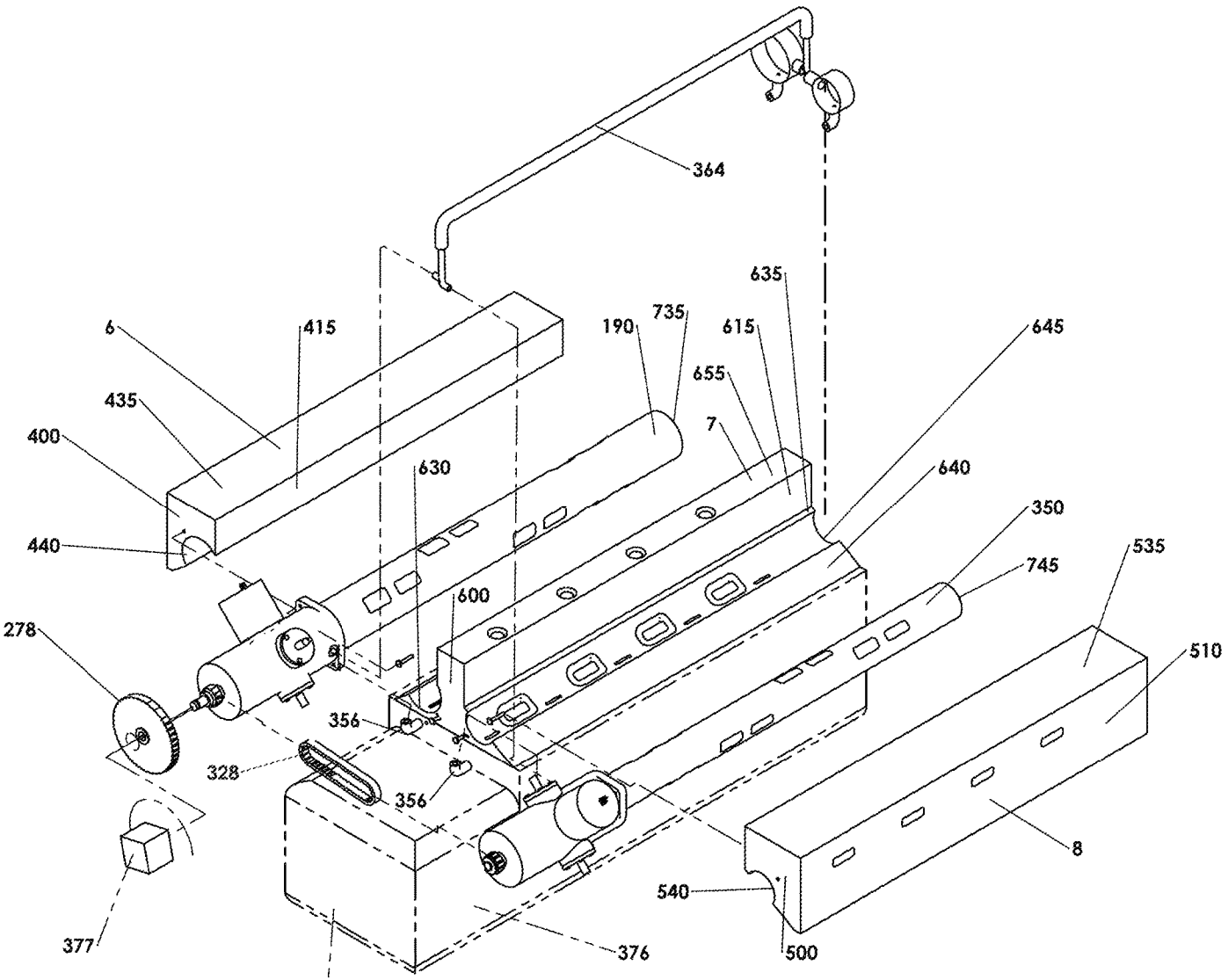
FIG. 2 shows the engine assembly in an exploded view.

FIG. 2 discloses, in an exploded view, an embodiment of engine assembly 3: intake section 6, center section 7, exhaust section 8, intake cam drive and shift assembly 190, cam-to-crankshaft pulley 278, exhaust cam drive and shift assembly 350, cam-to-cam drive belt 328, oil return tubes 356, crankshaft-to-cam belt 368, crankshaft pulley 370, fluid containment system 364, engine block 376, and electronic cam advance-retard device 377. The intake section 6 possesses an intake cam apse 440 into which the intake cam 11, part of the intake cam drive and shift assembly 190, is received. The center section 7 possesses an center intake cam apse 630 and center exhaust cam apse 645 into which the intake cam 11, part of the intake cam drive and shift assembly 190, in received into center intake cam apse 630 and the exhaust cam 12, part of the exhaust cam drive and shift assembly 350, is received into center exhaust cam apse 645 The exhaust section 8 possesses an exhaust cam apse 540 into which the exhaust cam 12, part of the exhaust cam drive and shift assembly 350, in received. Camshaft sleeves 340 and 345 (not shown) are formed when from the union of the intake section 6, center section 7, and exhaust section 8 so as to align their grooves to form circular voids into which the camshafts 11, 12 are received. Faces of intake section 6, center section 7, exhaust section 8, intake cam 11, and exhaust cam 12 are identified as follows: intake front face 400, intake inside face 415, intake top face 435, intake cam apse 440, exhaust front face 500, exhaust outside face 510, exhaust top face 535, exhaust cam apse 540, center front face 600, center exhaust side face 615, center intake cam apse 630, center upper sealing face-exhaust 635, center lower sealing face-exhaust 640, center exhaust cam apse 645, center top face 655, camshaft intake distal 735, and camshaft exhaust distal 745.

In an embodiment, the diameter of the cam-to-crankshaft pulley 278 is four (4) time the diameter of the crankshaft pulley 370. Projection lines indicate fitment relationships.

Figure 3:
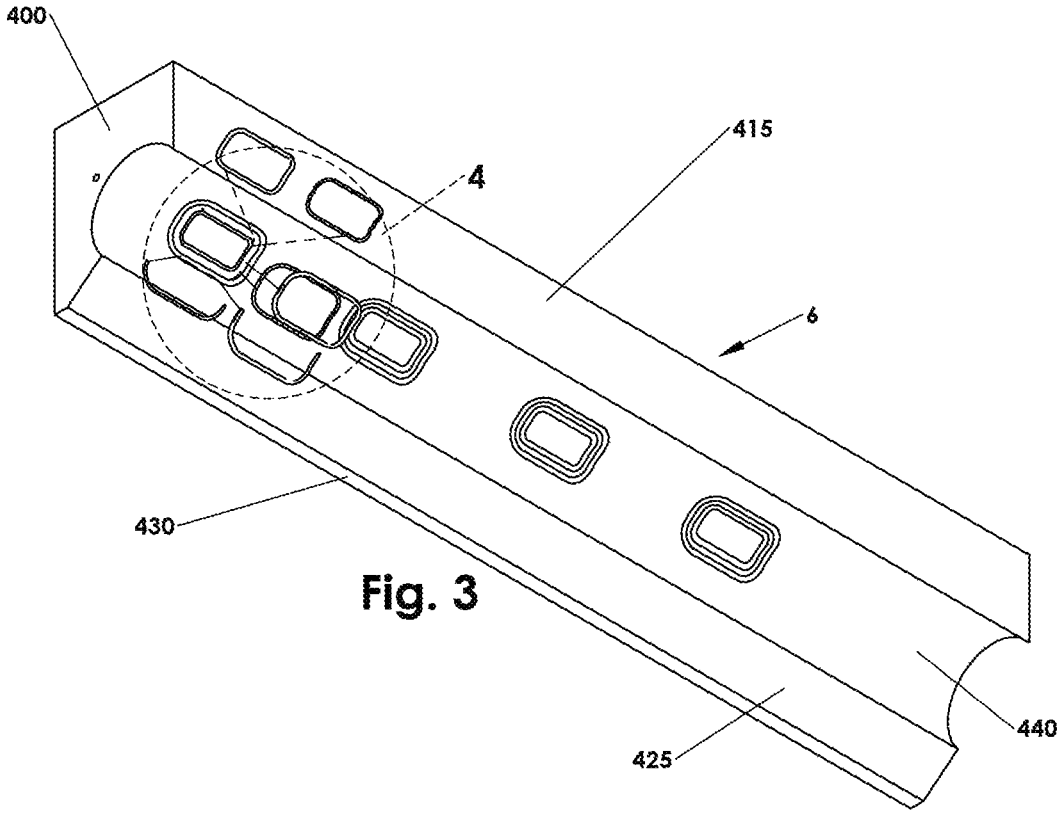
FIG. 3 shows the intake section of the cylinder head.

FIG. 3 provides, in an exploded view, an overview of intake section 6 of the cylinder head assembly 5. Faces of intake section 6 are identified as follows: intake front face 400, intake inside face 415, intake lower sealing face 425, intake bottom face 430, intake cam apse 440.

Figure 4:
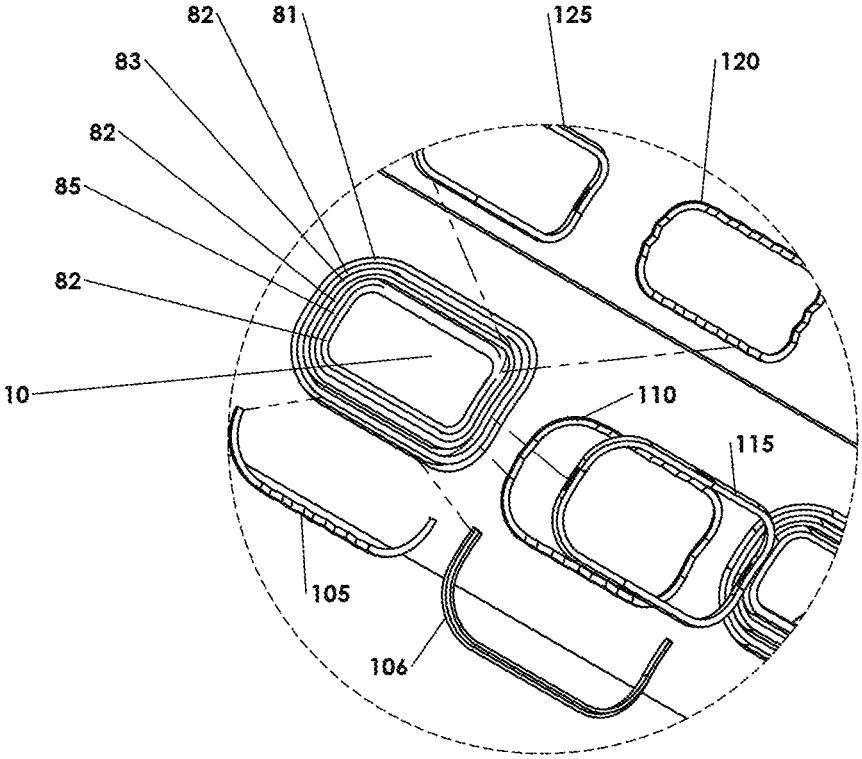
FIG. 4 shows an enlarged view of intake section.

FIG. 4 discloses, in an enlarged view, an embodiment of intake section 6 of the cylinder head assembly 5. Intake oil-control spring 105, intake oil-control device 106, intake middle-ring sealing assembly spring 110, intake middle-ring sealing assembly 115, intake inner-ring sealing assembly spring 120, intake inner-ring sealing assembly 125 are identified. Grooves 81, 83, 85 that holds sealing rings and oil-control devices are identified. Lands 82 between grooves serve to support the grooves 81, 83, 85 identified. Intake port 10 is identified. Intake section 6 functions to bring an air/fuel mixture in via intake port 10 and functions as a seal to the intake cam 11 (not shown).

Figure 5:
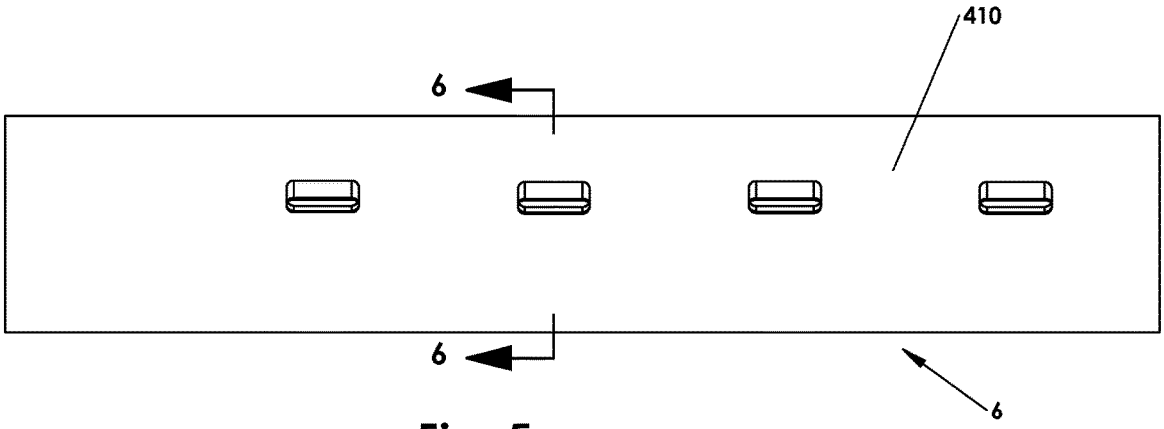
FIG. 5 shows intake section.

FIG. 5 provides a side view of intake section 6. A cutting line for FIG. 6 is identified.

Figure 6:
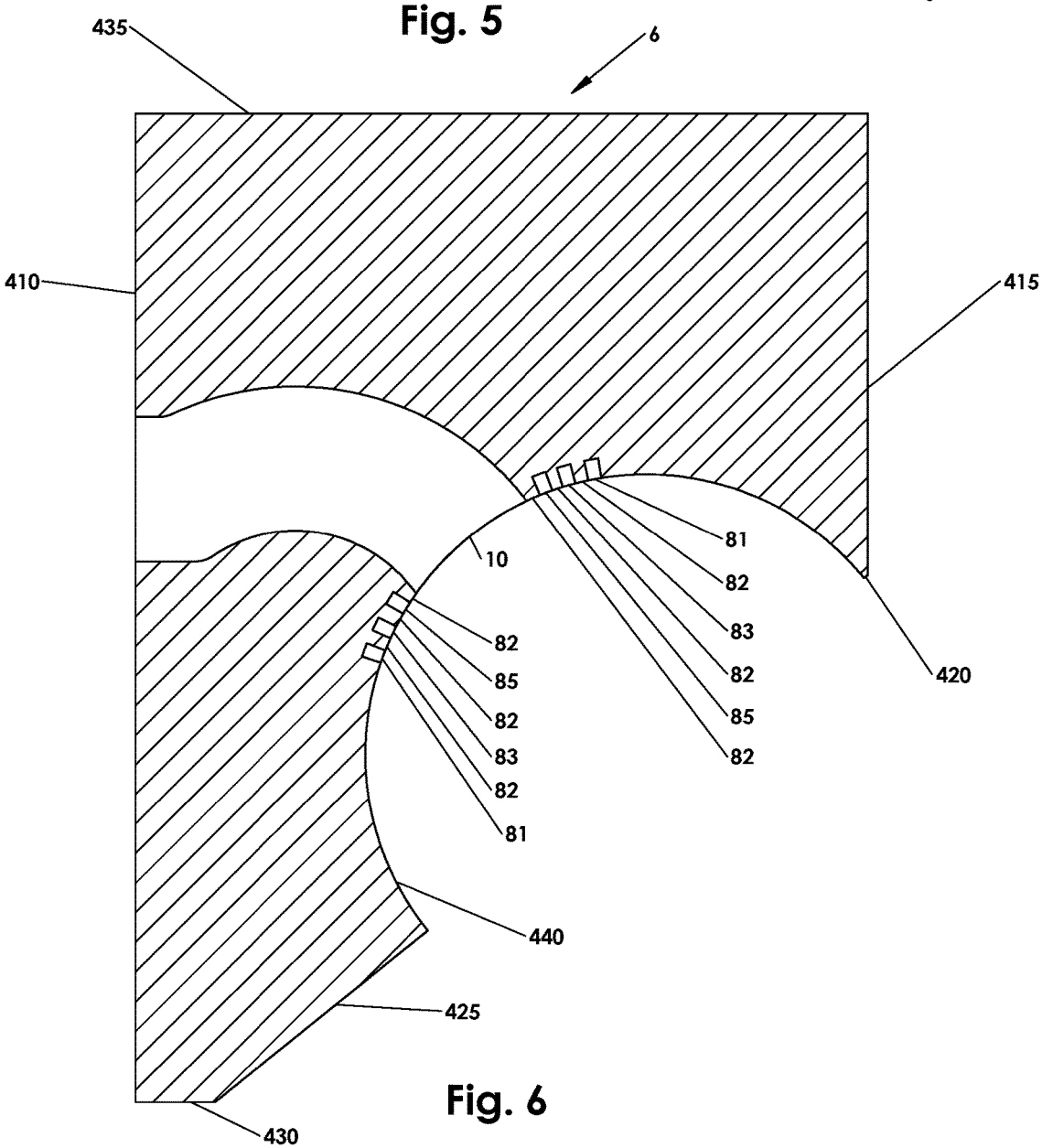
FIG. 6 shows a sectional view of intake section.

FIG. 6 depicts an embodiment of intake section 6, in a sectional view, illustrating the relationship between intake port 10, lands 82, and grooves 81, 83, 85. This view is a "bare part," (i.e., intake section 6 only). Faces of intake section 6 are identified as follows: intake outside face 410, intake inside face 415, intake upper sealing face 420, intake lower sealing face 425, intake bottom face 430, intake top face 435, intake cam apse 440.

Figure 7:
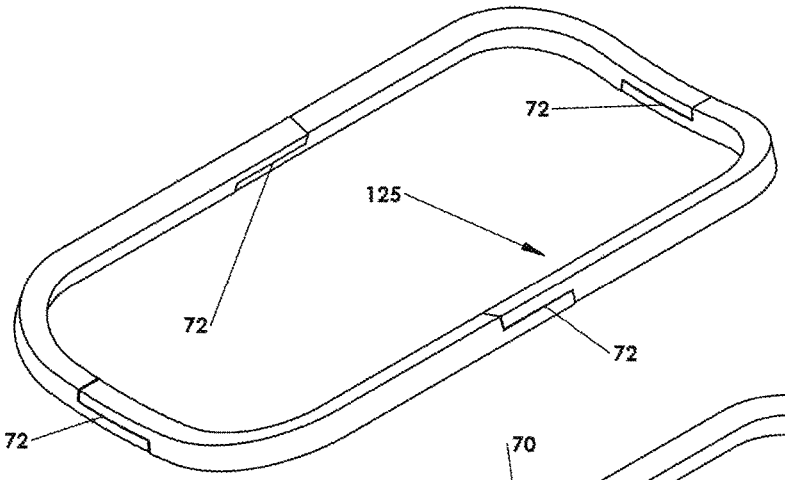
FIG. 7 shows intake inner-ring sealing assembly.

FIG. 7 depicts an embodiment of intake inner-ring 125 that seals the combustion chamber so there is minimal blowback of gases to the crankcase. Sealing ring overlap joints (4) 72 are identified. The overlap joints 72 allows for expansion and contraction of cylinder head during engine warm-up and cool-down and compensates for wear while maintaining their original sealing competence.

Figure 8:
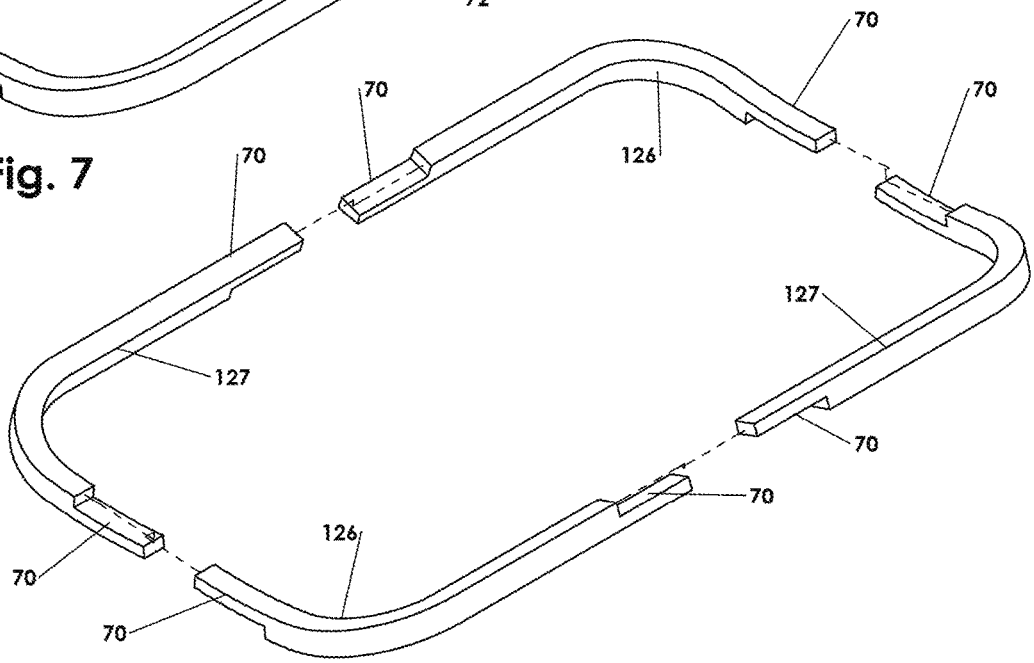
FIG. 8 shows an exploded view of intake inner-ring.

FIG. 8 depicts an exploded view of intake inner-ring 125. Illustrated features: intake right-hand inner-ring segments (2) 126, intake left-hand inner-ring segments (2) 127 and sealing ring mating members (8) 70. Sealing of the sealing ring mating member parts 126, 127 is accomplished by overlapping the mating members (8) 70. The overlapping mating members 70 forms overlap joints 72 (not shown) that allows for expansion and contraction of cylinder head during engine warm-up and cool-down and compensates for wear while maintaining their original sealing competence. Projection lines indicate fitment relationships. Intake inner-ring 125 functions as a seal between intake cam 11 (not shown) and intake section 6 (not shown).

Figure 8A:
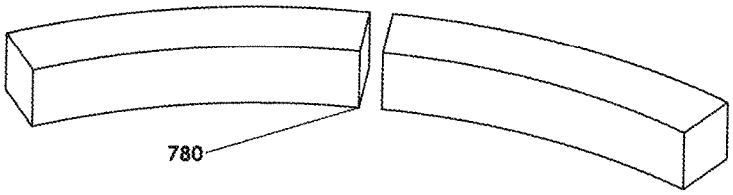
FIG. 8*a* through 8*f* depict various embodiments of suitable ring segment joints.

FIG. 8*a* depicts a butt joint ring 780. The butt joint ring 780 is used on the piston(s) of many internal combustion engines. They are inexpensive but lose their ability to seal as they wear. Their use was considered in place of overlapping joints 72 but was rejected for the wear problems. Note: See Federal Mogul publication "Piston Ring Handbook" for additional data on piston rings.

Figure 8B:
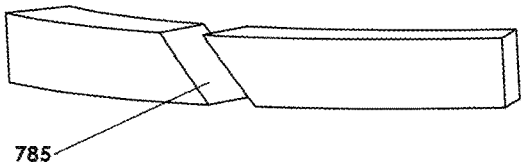

FIG. 8*b* depicts an angle joint ring 785. The angle joint ring 785 is not used on the piston(s) of car and truck engines.

Figure 8C:
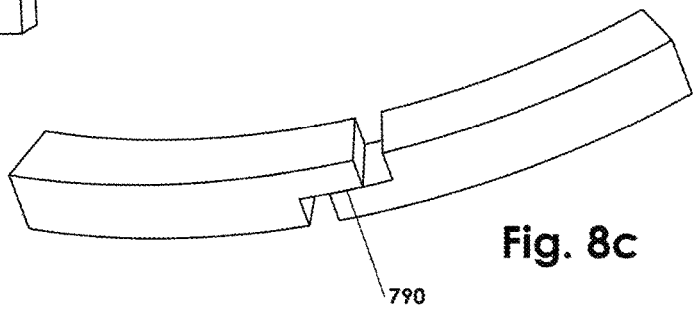

FIG. 8*c* depicts an overlapped joint ring 790. The overlapped joint ring 790 is used on the piston(s) of many internal combustion engines. They are more expensive than butt joints or angle joint ring due to additional machining cost. Overlapped joint maintain their ability to seal as they wear. They were selected for use as overlapping joints 72.

Figure 8D:
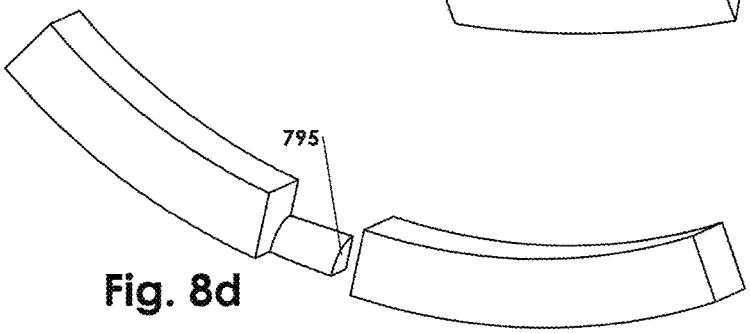

FIG. 8*d* depicts a convex step type joint 795. The convex step type joint 795 is not used on the piston(s) of car and truck engines.

Figure 8E:
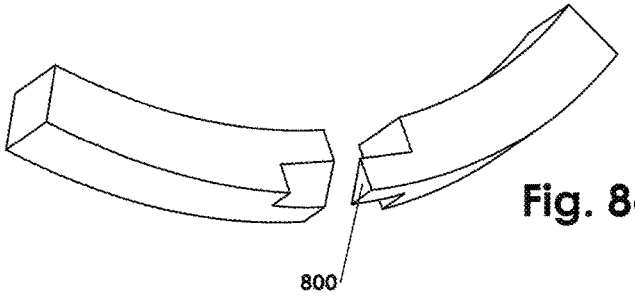

FIG. 8*e* depicts an angle step type joint 800. The angle step type joint 800 is not used on the piston(s) of car and truck engines.

Figure 8F:
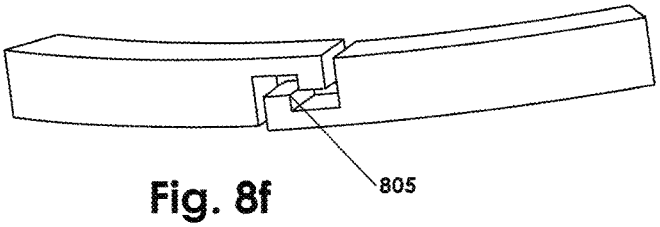

FIG. 8*f* depicts a hook type joint 805. The hook type joint 805 is not used on the piston(s) of car and truck engines.

Figure 9:
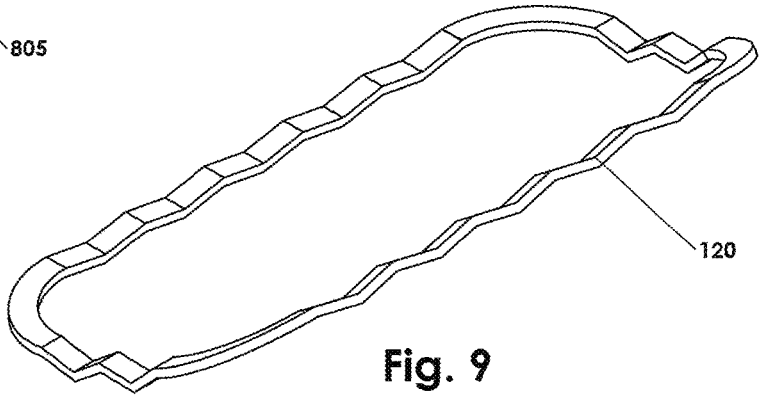
FIG. 9 shows intake inner-ring spring.

FIG. 9 depicts an embodiment of intake inner-ring spring 120. Intake inner-ring spring 120 provides pressure to assure contact between intake inner-ring 125 and intake cam 11 (not shown).

Figure 10:
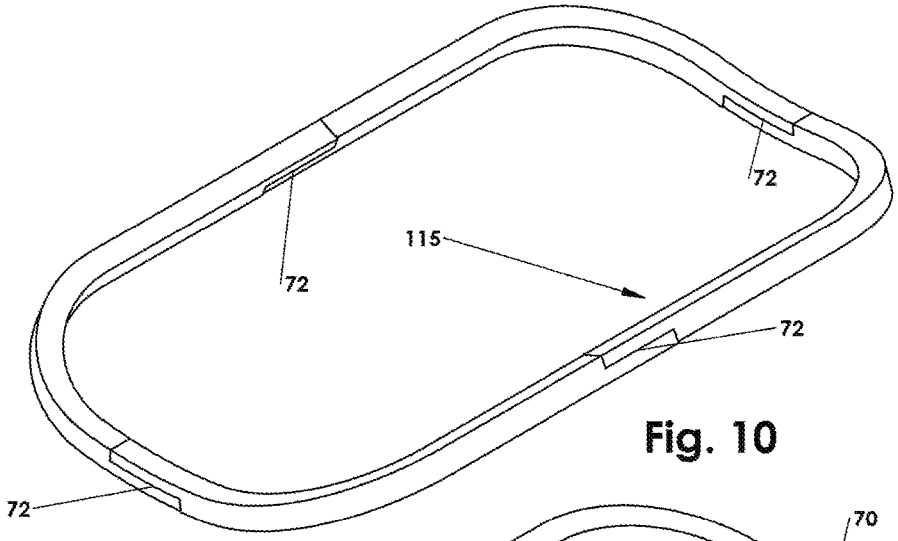
FIG. 10 shows intake middle-ring sealing assembly.

FIG. 10 depicts an embodiment of intake middle-ring 115 that seals the combustion chamber so there is minimal blowback of gases to the crankcase. Sealing ring overlap joints (4) 72 identified. The overlap joints 72 allows for expansion and contraction of cylinder head during engine warm-up and cool-down and compensates for wear while maintaining their original sealing competence.

Figure 11:
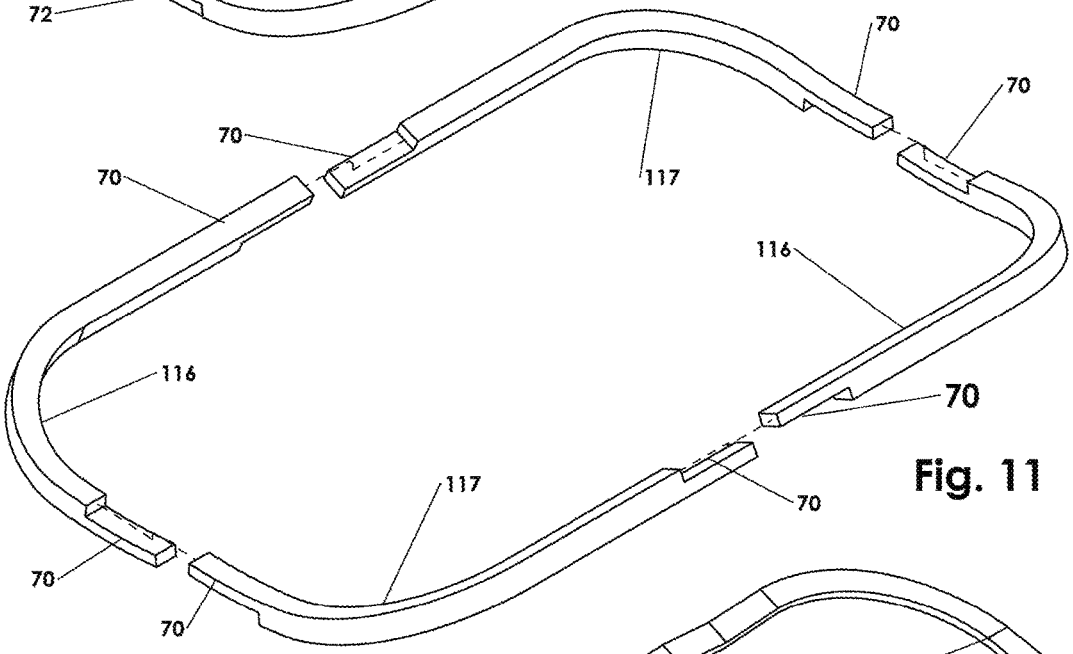
FIG. 11 shows an exploded view of intake middle-ring.

FIG. 11 depicts an exploded view of intake middle-ring 115. Illustrated features are intake right-hand middle-ring segments (2) 116, intake left-hand middle-ring segments (2) 117 and sealing ring mating member (8) 70. Sealing of the sealing ring mating member parts 116, 117 is accomplished by overlapping the mating members (8) 70. The overlapping mating members 70 forms a sealing ring mating member joints (not shown) 72 that allows for expansion and contraction of cylinder head during engine warm-up and cool-down and compensates for wear while maintaining their original sealing competence. Projection lines indicate fitment relationships. Intake middle-ring 115 functions as a seal between intake cam 11 (not shown) and intake section 6 (not shown).

Figure 12:
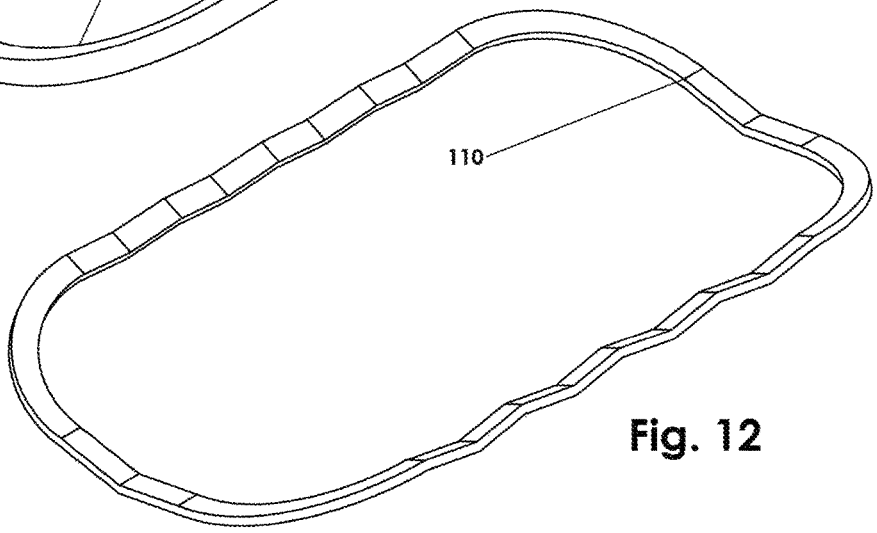
FIG. 12 shows intake middle-ring spring.

FIG. 12 depicts an embodiment of intake middle-ring spring 110. Intake middle-ring spring 110 provides pressure to assure contact between intake middle-ring 115 (not shown) and intake cam 11 (not shown).

Figure 13:
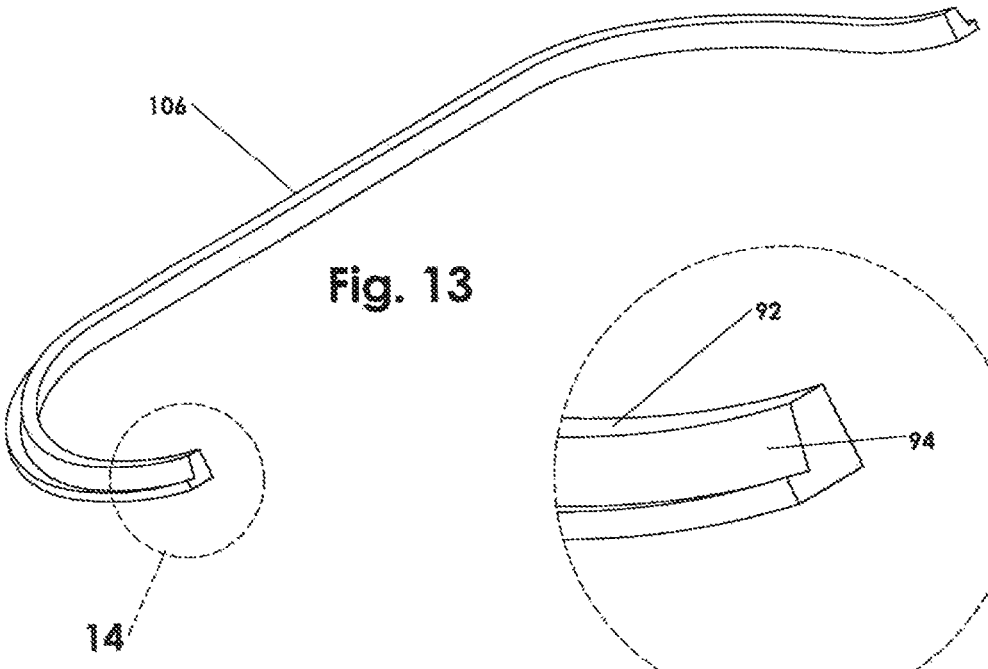
FIG. 13 shows intake oil-control device.

FIG. 13 depicts intake oil-control device 106. It is positioned in the groove for oil-control device 81. Intake oil-control device and spring 105, 106 occupies the leading edge (first half) of the groove for oil-control device 81. The trailing edge (second half) channels and distributes lubricating oil to the intake side of the cylinder head assembly 5. Excess oil flows into oil channel 94 where it flows into an oil-control groove 81 when the oil-control segment 106 contacts intake cam 11.

Figure 14:
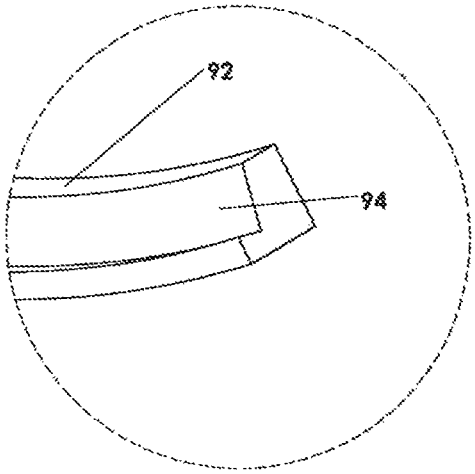
FIG. 14 shows an enlarged view of intake oil-control device.

FIG. 14 depicts a enlarged view of the oil scraper face 92 and the oil scraper leading face 94. The oil scraper leading face 94 collects lubricating oil and channels it to oil return passageways 99 (not shown).

Figure 15:
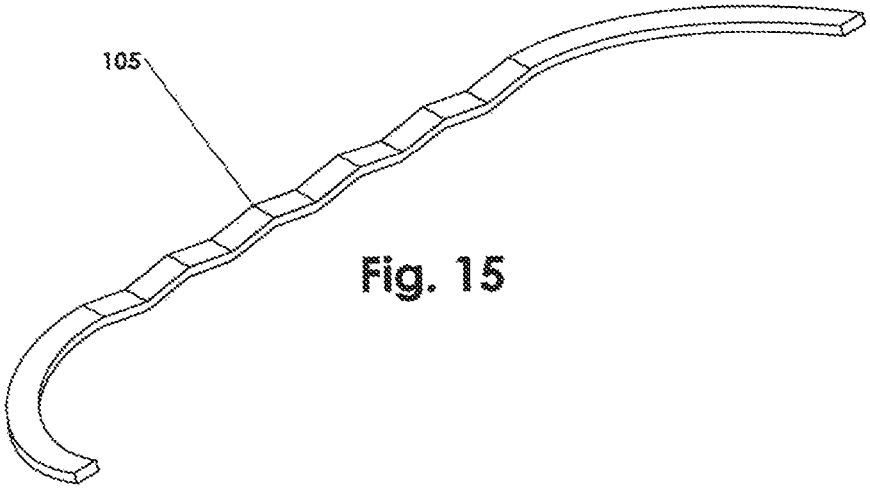
FIG. 15 shows intake oil-control spring.

FIG. 15 depicts an intake oil-control spring 105, which provides pressure to assure sealing between intake oil-control segment 106 (not shown) and intake cam 11 (not shown). Intake oil-control device and spring 105, 106 occupy the leading edge (first half) of the groove for oil-control device 81. The trailing edge (second half) of the groove for oil-control device 81 channels and distributes lubricating oil to the intake side of the cylinder head assembly 5. Excess oil flows into oil channel 94 where it flows into an oil-control groove 81 when intake oil-control segment 106 contacts intake cam 11 (not shown).

Figure 16:
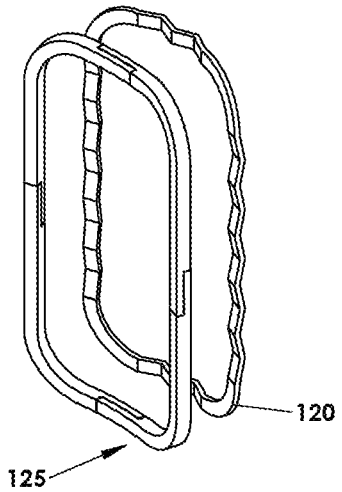
FIG. 16 shows intake inner-ring positioned with intake inner-ring spring.

FIG. 16 depicts an embodiment of intake inner-ring 125, and the intake inner-ring spring 120 positioned to show relationship.

Figure 17:
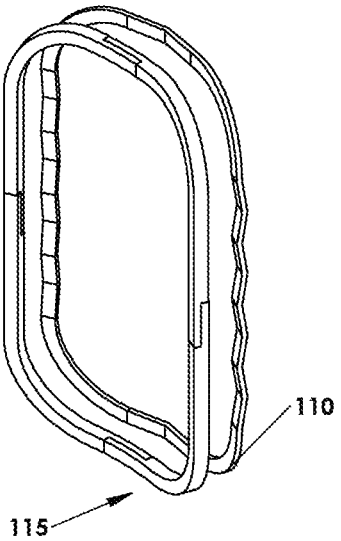
FIG. 17 shows intake middle-ring positioned with intake middle-ring spring.

FIG. 17 depicts intake middle-ring 115 and intake middle-ring spring 110 positioned to show relationship.

Figure 18:
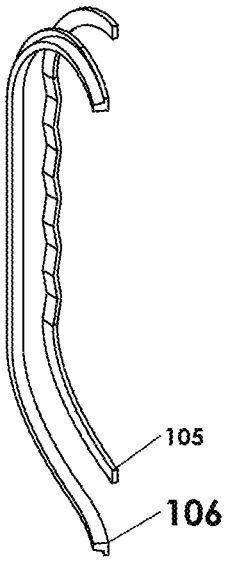
FIG. 18 shows intake oil-control device positioned with intake oil-control spring.

FIG. 18 depicts intake oil-control device 106 and the intake oil-control spring 105 positioned to show relationship.

Figure 19:
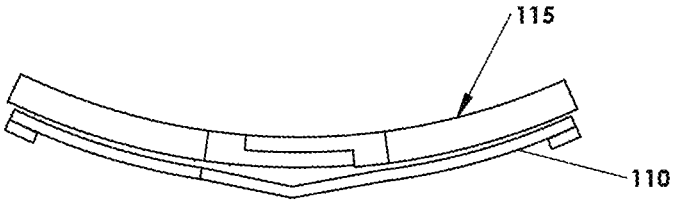
FIG. 19 shows intake middle-ring and intake idle spring.

FIG. 19 depicts the concave shape of intake middle-ring spring 110, intake middle-ring 115, to display their orientation when installed in intake sides (i.e., intake section 6 and center section 7) of the cylinder head assembly 5 (not shown). All rings (115, 125, 165, 175), oil control devices (106, 156), and springs (105, 110, 120, 155, 160, 170) are concave to engage the curved surface onto which they are affixed.

Figure 20:
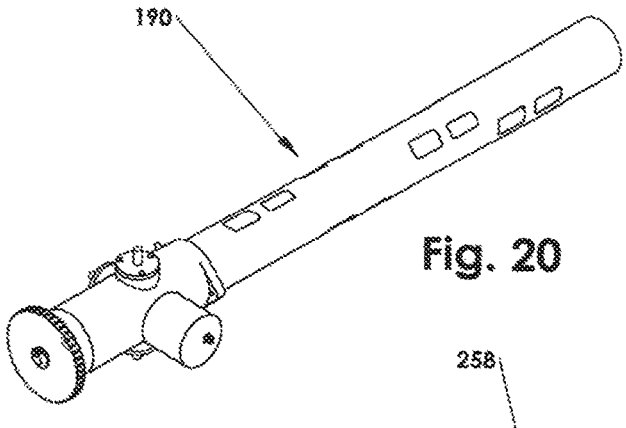
FIG. 20 shows intake camshaft drive and shift assembly.

FIG. 20 discloses an embodiment of intake cam drive/shift 190. This device rotates intake cam 11. In addition, nutate intake cam 11 between its operating positions (primary or secondary). Nutation is controlled by the engine control module (unclaimed matter).

Figure 21:
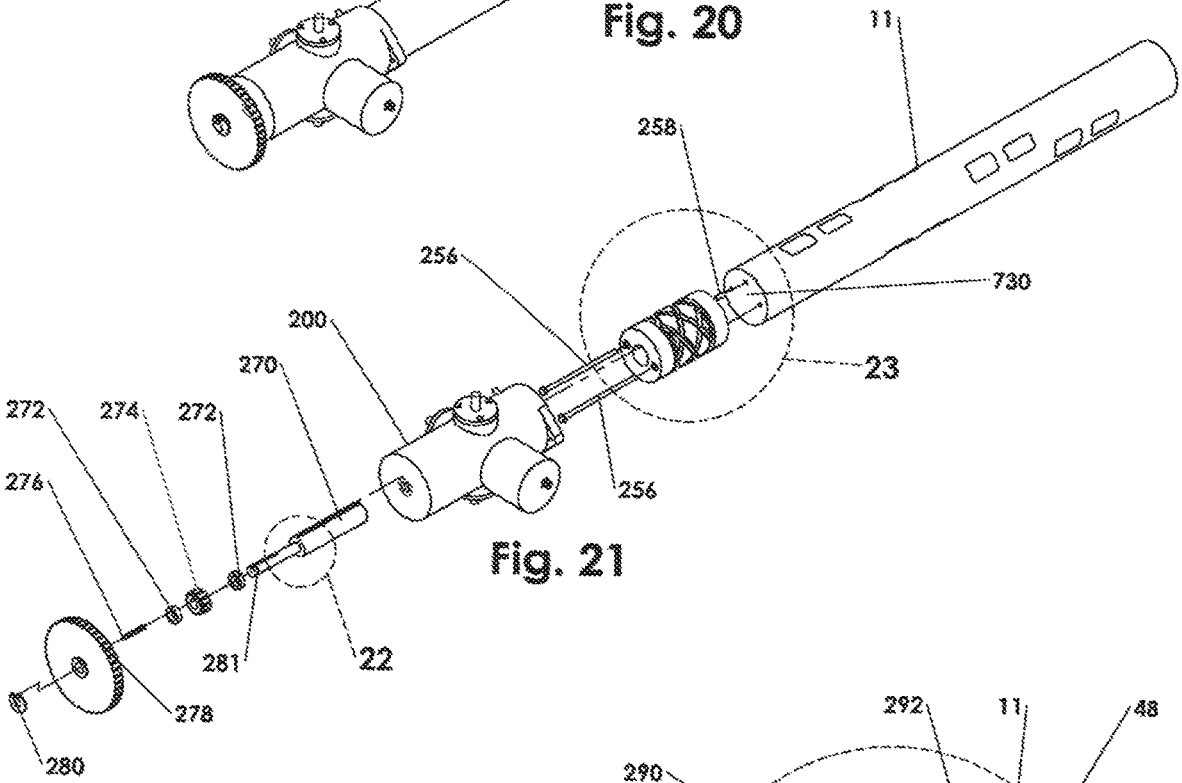
FIG. 21 shows an exploded view of intake cam drive/shift.

FIG. 21 discloses exploded view of intake cam drive/shift 190. Projection lines provide relationships of parts in the device, starting with intake cam 11, followed by cam-to-rifled shaft dowel pin 258, rifled shaft 290, rifled shaft to camshaft retaining bolts (2) 256, rifled shaft actuator 200, male telescoping shaft-intake 270 (i.e. connecting member), slotted shaft spacer 272, cam-to-cam pulley 274, slotted shaft spacer 272, intake square key 276, cam-to-crankshaft pulley 278, and ending with the snap ring 280. The cam-to-crankshaft pulley 278 rotates intake cam drive/shift 190 except for the rifled shaft housing 210 (a member of rifled shaft actuator 200), which is bolted to the cylinder head assembly 5. Nutation occurs when, with the engine assembly 3 running, and the engine control module (unclaimed matter) sends a signal to the camshaft shifting mechanism 238, e.g. double-acting solenoid shell 238, i.e., (not shown), a member of the master-pin assembly 230 (not shown), to momentarily move the master-pin 232 (not shown) to or froe. The master-pin 232 (not shown), a member of the master-pin assembly 230 (not shown), then engages master-pin rifling 298 (not shown) in the rifled shaft 290 (not shown). Simultaneously, the slave-pins 260 (not shown) then engages slave-pin rifling 296 (not shown) in the rifled shaft 290 (not shown). The combined action of the pins 232, 260, the rifling 296, 298 and rotation of rifled shaft 290 shifts intake cam and rifled shaft 290 laterally on their axes from the primary position to the secondary position or vice-versa. When the shifting is complete, the pins 232, 260 engage either the rifled shaft positioning detent-primary 301 (not shown) or the rifled shaft positioning detent-secondary 300 (not shown). Faces of intake cam 11 are identified as follows: camshaft intake proximal 730.

Figure 22:
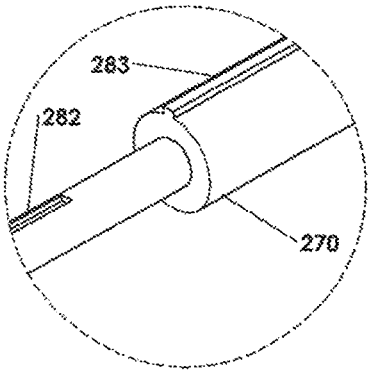
FIG. 22 shows an enlarged view of intake telescoping shaft.

FIG. 22 is an enlarged view of the male telescoping shaft 270 that identifies indexing spline-male telescoping shaft 283 and square key slot 282. The indexing spline-male telescoping shaft 283 mates with the indexing fossa 284, in the rifled shaft 290, to align the male telescoping shaft 270 and the rifled shaft 290.

Figure 23:
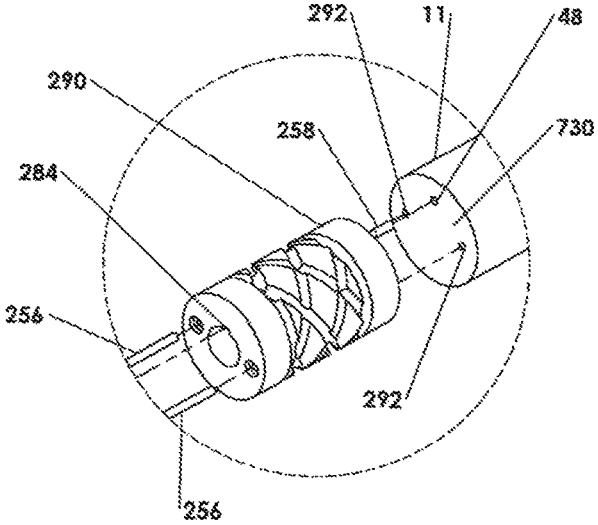
FIG. 23 show an enlarged view of intake camshaft, male telescoping shaft-intake, and the rifled shaft.

FIG. 23 is an enlarged view illustrating how the rifled shaft 290, and intake cam 11, and male telescoping shaft-intake 270 are aligned by intake cam indexing bore 48, cam-to-rifled shaft dowel pin 258, rifled shaft indexing bore 294 (not shown), and cam attachment bore 293. Indexing fossa 284 mates with indexing spline-male telescoping shaft 283+shaft 290. Rifled shaft/cam bolts (2) 256 attach the rifled shaft 290 to intake cam 11. This arrangement allows the intake cam 11 and rifled shaft 290 to nutate the mail telescoping shaft-intake 270 thus changing from the primary intake aperture to the secondary intake aperture or vice-versa Faces of intake cam 11 are identified as follows: camshaft intake proximal 730.

Figure 24:
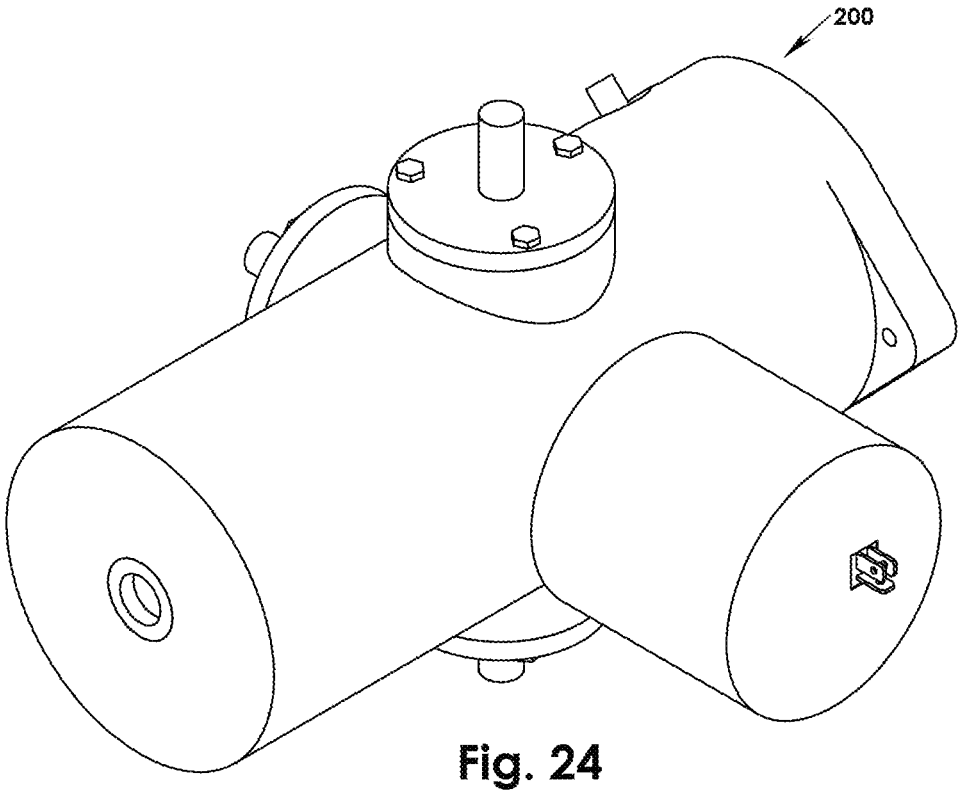
FIG. 24 shows the rifled shaft actuator.

FIG. 24 discloses an embodiment of the rifled shaft actuator 200. The rifled shaft actuator 200 function is two-fold: 1) Position intake cam 11 (not shown) and exhaust cam 12 (not shown) in either the rifled shaft positioning detent-primary 301 (not shown) or the rifled shaft positioning detent-secondary 300 (not shown); 2) Shift intake cam 11 (not shown) and exhaust cam 12 (not shown) from the primary position to the secondary position or vice-versa.

Figure 25:
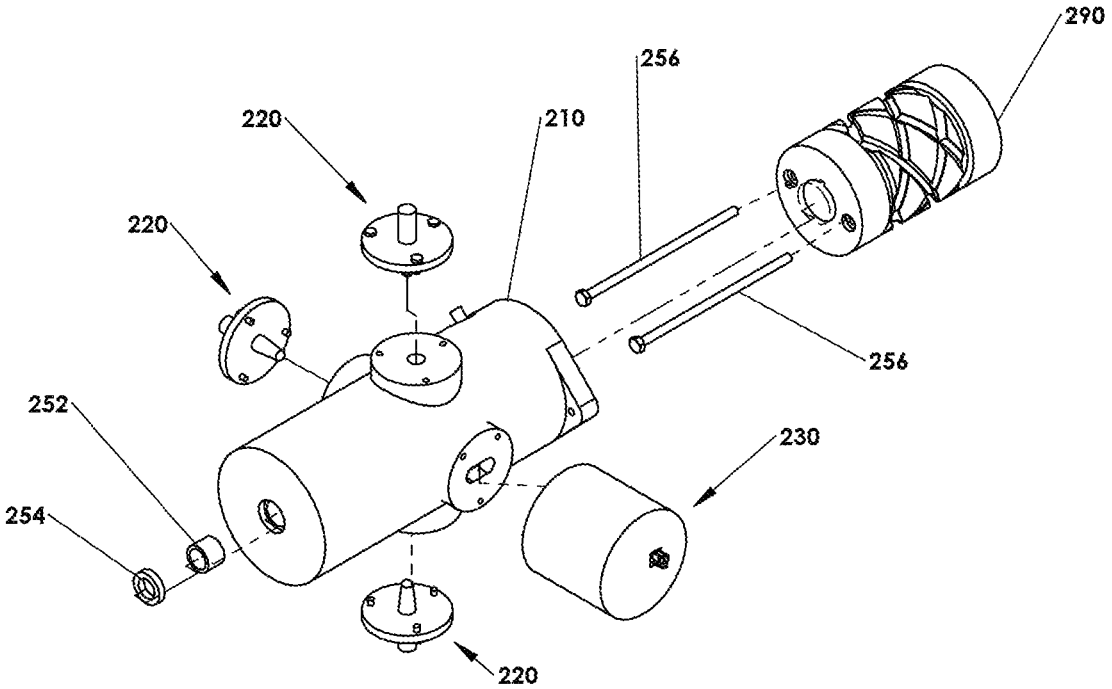
FIG. 25 shows an exploded view of the rifled shaft actuator.

FIG. 25 discloses exploded view of the rifled shaft actuator 200. Projection lines provide relationships of parts and assemblies. Starting with the rifled shaft 290, followed by the rifled shaft to camshaft retaining bolts 256, rifled shaft housing 210, rifled shaft housing bushing 252, rifled shaft housing oil seal 254, slave-pin assemblies (3) 220, and master-pin assembly 230. Three slave-pins 260 (not shown), members of slave-pin assemblies 220, and the master-pin 232 (not shown), member of the master-pin assembly 230, function to position the rifled shaft 290 in one of the two detent positions: rifled shaft positioning detent-primary 301 (not shown), rifled shaft positioning detent-secondary 300 (not shown) or shift the rifled shaft 290, using the master-pin rifling 298 (not shown), and slave-pin rifling 296 (not shown).

Figure 26:
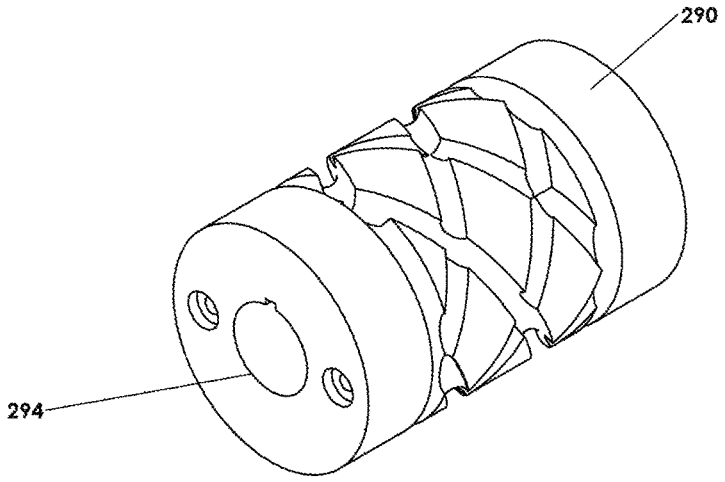
FIG. 26 shows the rifled shaft.

FIG. 26 (orthographic view) provides an overview of the rifled shaft 290 and the rifled shaft indexing bore 294.

Figure 27:
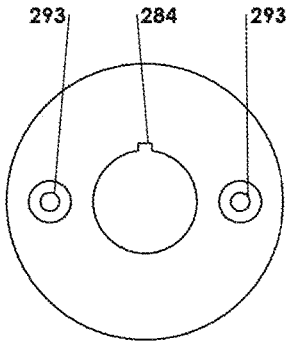
FIG. 27 shows a front view of the rifled shaft.

FIG. 27 (front view) identifies the: cam attachment bore 293 (2) and indexing fossa for a male telescoping shaft 284.

Figure 28:
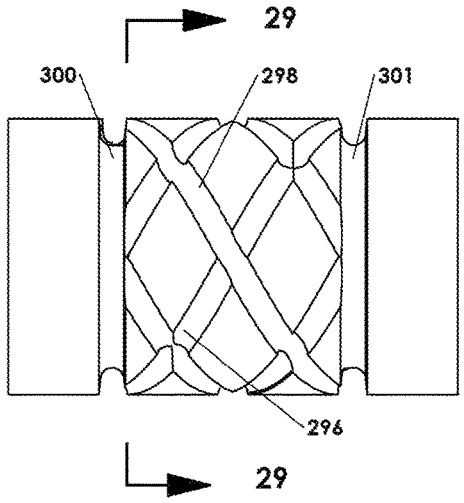
FIG. 28 shows a side view of the rifled shaft.

FIG. 28 identifies the following feature: rifled shaft positioning detent-primary 300, rifled shaft positioning detent-secondary 301, slave-pin rifling 296 (3), and the master-pin rifling 298. The positioning detents 300, 301 mates with the slave-pin 260 (3) (not shown) members of slave-pin assembly 220 (6), and the master-pin 232 (not shown) member of the master-pin assembly 230. Cutting line 29 is shown.

Figure 29:
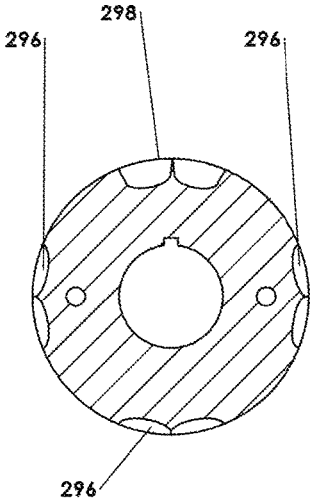
FIG. 29 shows a sectional view of the rifled shaft.

FIG. 29 Sectional view identifies the following features: slave-pin rifling 296 (3) and the master-pin rifling 298. The rifling 298, 296 engage the master-pin 232 (not shown) and slave-pins (3) 260 (not shown) shift the rifled shaft 290 from primary position to secondary position or vice-versa.

Figure 30:
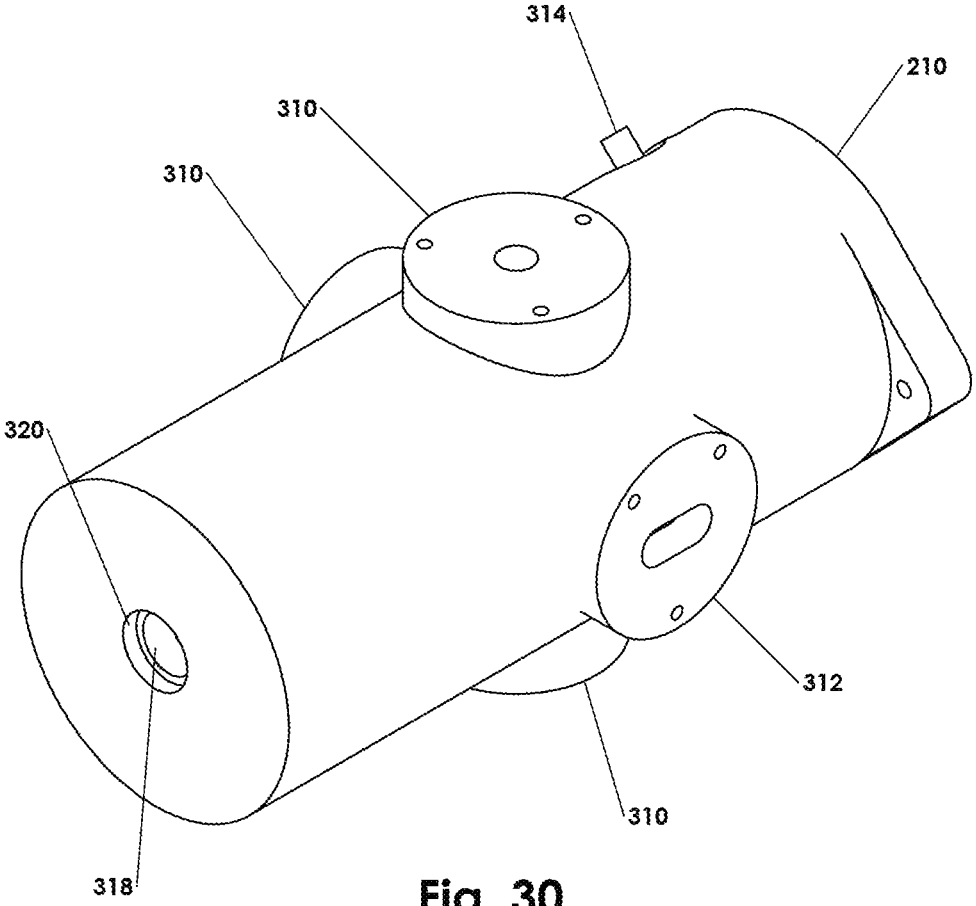
FIG. 30 shows the rifled shaft cover.

FIG. 30 discloses an embodiment of the rifled shaft housing 210. Features identified are: lubricating oil inlet 100, slave-pin assembly bosses (3) 310, master-pin assembly boss 312, oil return/vent ports (2) 314, bore for spiral housing-to-cylinder head bolts (2) 316, bore for spiral shift housing bushing 318, and bore for spiral shift housing oil seal 320.

Figure 31:
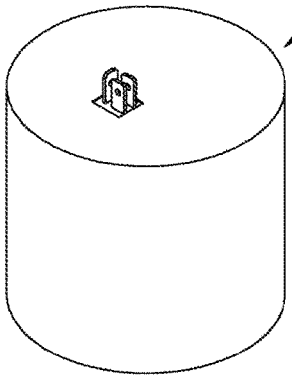
FIG. 31 shows the master-pin assembly.

FIG. 31 discloses an embodiment of the master-pin assembly 230. There are two (2) master-pin assemblies in the cylinder head assembly 5. The master-pin assembly 230 is bolted to the master-pin assembly boss 312 (not shown) by three master-pin assembly retainer bolts 246 (not shown).

Figure 32:
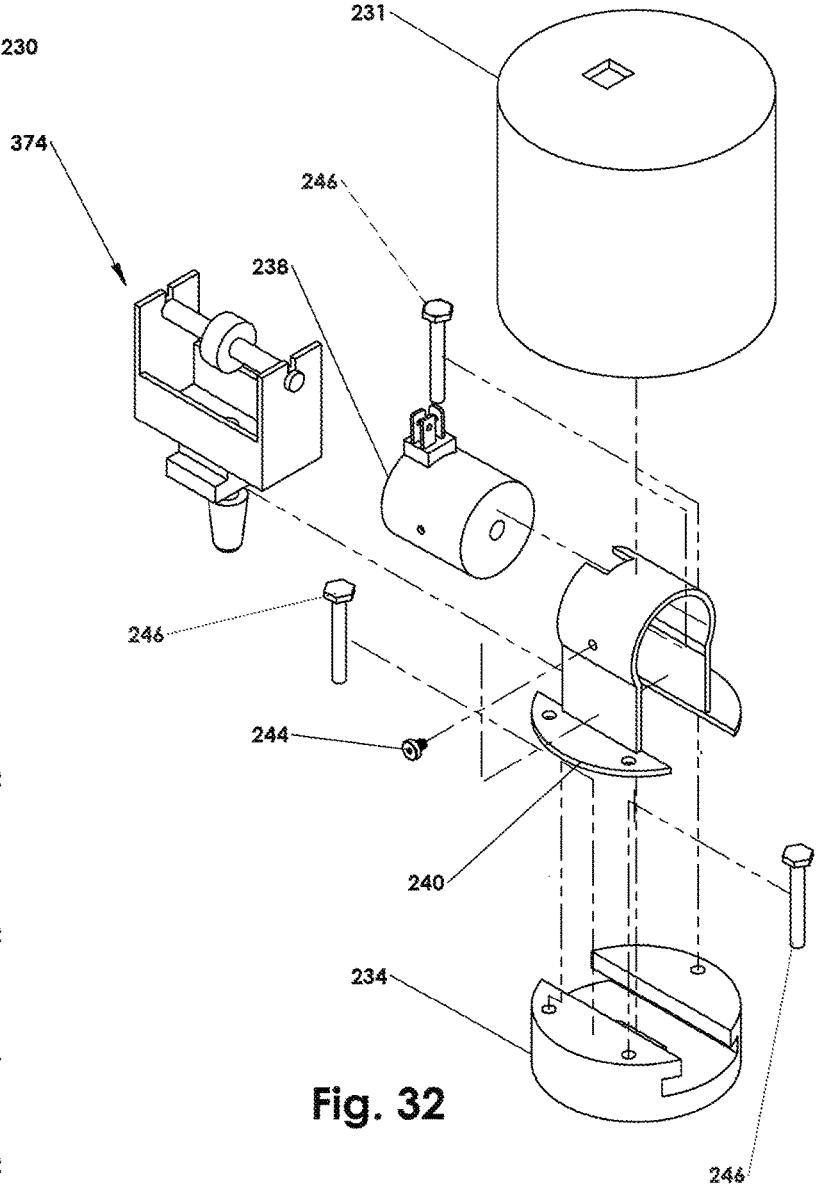
FIG. 32 show an exploded view of the master-pin assembly.

FIG. 32 discloses an exploded view of the master-pin assembly 230. Projection lines provide relationships of parts in the assembly and identifies the following features: master-pin enclosure 231, master-pin base 234, double-acting solenoid shell 238, solenoid holder 240, solenoid retainer bolt 244, master-pin assembly retainer bolts (3) 246 and sliding assembly 374. The engine control module (unclaimed matter) sends a signal to the double-acting solenoid shell 238 to momentarily move the master-pin 374, a member of the sliding assembly 374, to or fro. This action results in intake cam 11 (not shown) being shifted to either the primary position or the secondary position.

Figure 33:
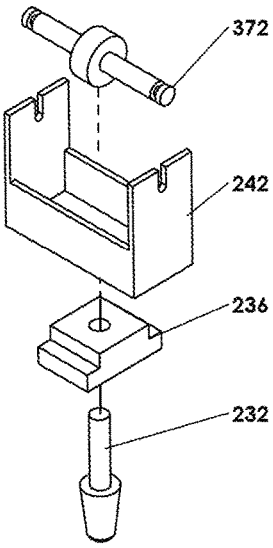
FIG. 33 shows an exploded view of the sliding assembly.

FIG. 33 discloses an exploded view of the sliding assembly 374. Projection lines provide relationships of parts in the assembly and identifies the following features: solenoid armature 372, solenoid to master-pin connector 242, master-pin slider 236, and master pin 232. When engine control module (unclaimed matter) sends a signal to the double-acting solenoid shell 238, the solenoid armature 372 moves the sliding assembly 374 which also moves the master-pin 232. The master-pin 232 and slave pin (3) 260 ride in either rifled shaft positioning detent-secondary 300 or rifled shaft positioning detent-primary 301. When the master pin 232, a member of the sliding assembly 374, is moved it engages the master-pin rifling 298, a feature on the rifled shaft 290, initiating latitudinal movement of the rotating camshaft (intake cam 11 or exhaust cam 12) and rifled shaft 290. Simultaneously, the slave pin (3) 260 engage the slave-pin rifling 296, a feature on the rifled shaft 290. As the camshaft (intake cam 11 or exhaust cam 12) and rifled shaft 290 rotates, the master pin 232 and slave pin (3) 260 ride in the master-pin rifling 298 and slave-pin rifling 296, respectively, continuing the latitudinal movement of the camshaft (intake cam 11 or exhaust cam 12) and rifled shaft 290 until the master pin 232 and slave pin (3) 260 reach the rifled shaft positioning detent-secondary 300 or rifled shaft positioning detent-primary 301. Latitudinal movement ceases at this point.

Solenoids are electromagnets. They are made of a large coil of copper wire with an armature (a slug of metal) in the middle. Upon energization (current is applied), the armature is pulled into the center of the coil. A double-acting solenoid contains two (2) coils, one at each end of the housing. Depending on which coil is energized, the armature can be pulled either direction. When neither coil is energized, the armature rides in the middle of the double-acting solenoid. An example of double-acting solenoid is found at "Double acting solenoids." See reference MGPU019.

Figure 34:
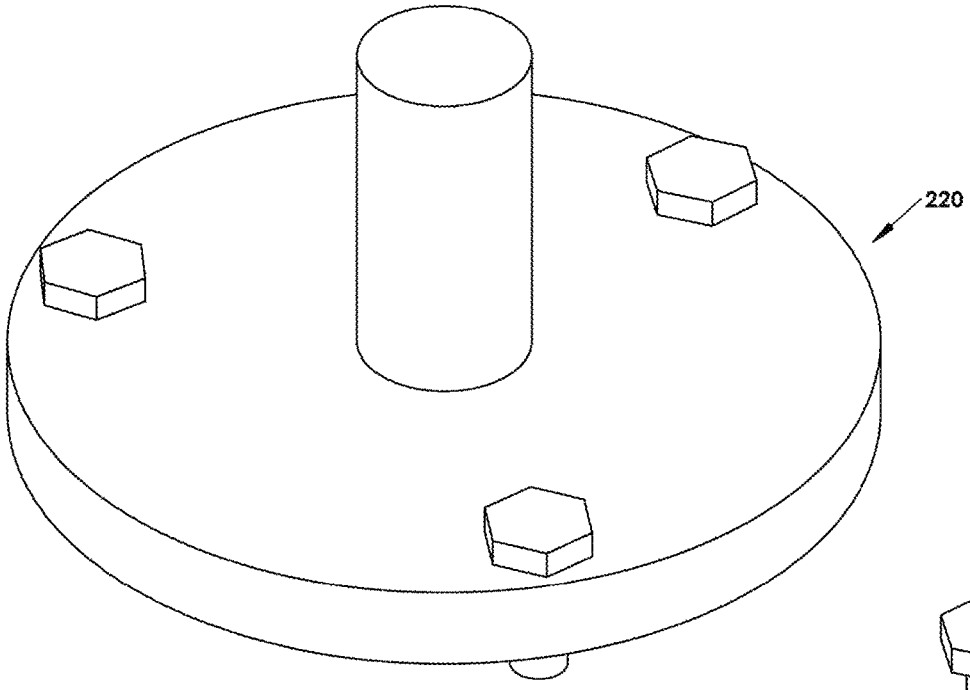
FIG. 34 shows the slave-pin assembly.

FIG. 34 discloses an embodiment of the slave-pin assembly 220. There are six (6) in the cylinder head assembly 5.

The slave-pin assembly 220 is bolted to the slave-pin assembly boss 310 (not shown) by three slave-pin assembly retainer bolts 264.

Figure 35:
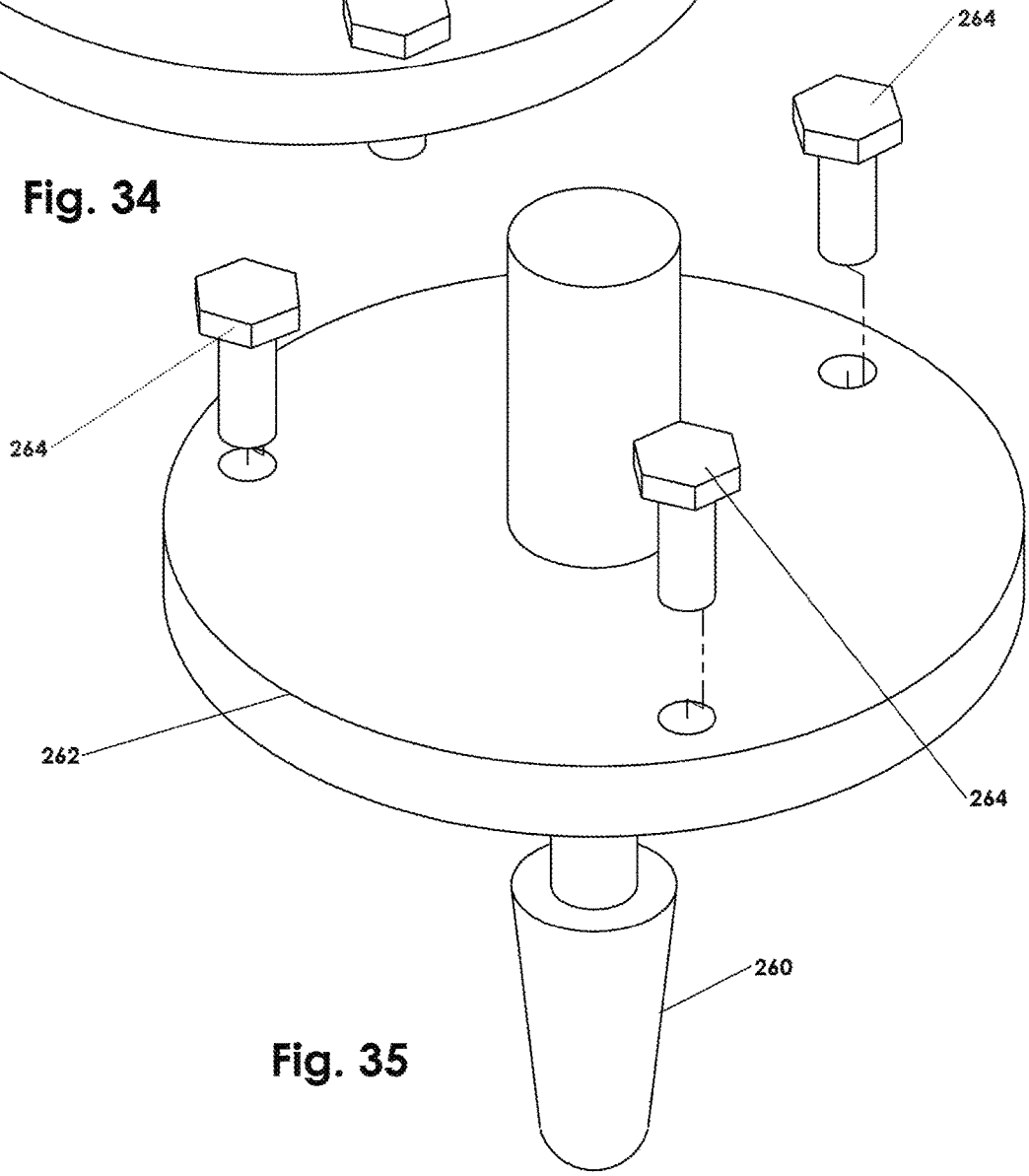
FIG. 35 shows an exploded view of the slave-pin assembly.

FIG. 35 provides an exploded view of the slave-pin assembly 220. Projection lines provide relationships of parts in the assembly and the following features: slave-pin 260, slave-pin housing 262, and slave-pin assembly retainer bolts (3) 264. Slave-pins 260 (3) are used as positioning detents 300, 301. Additionally, during camshaft shifts, they transit the slave-pin rifling 296 (3) to shift the rifled shaft 290 from primary position to secondary position or vice-versa.

Figure 36:
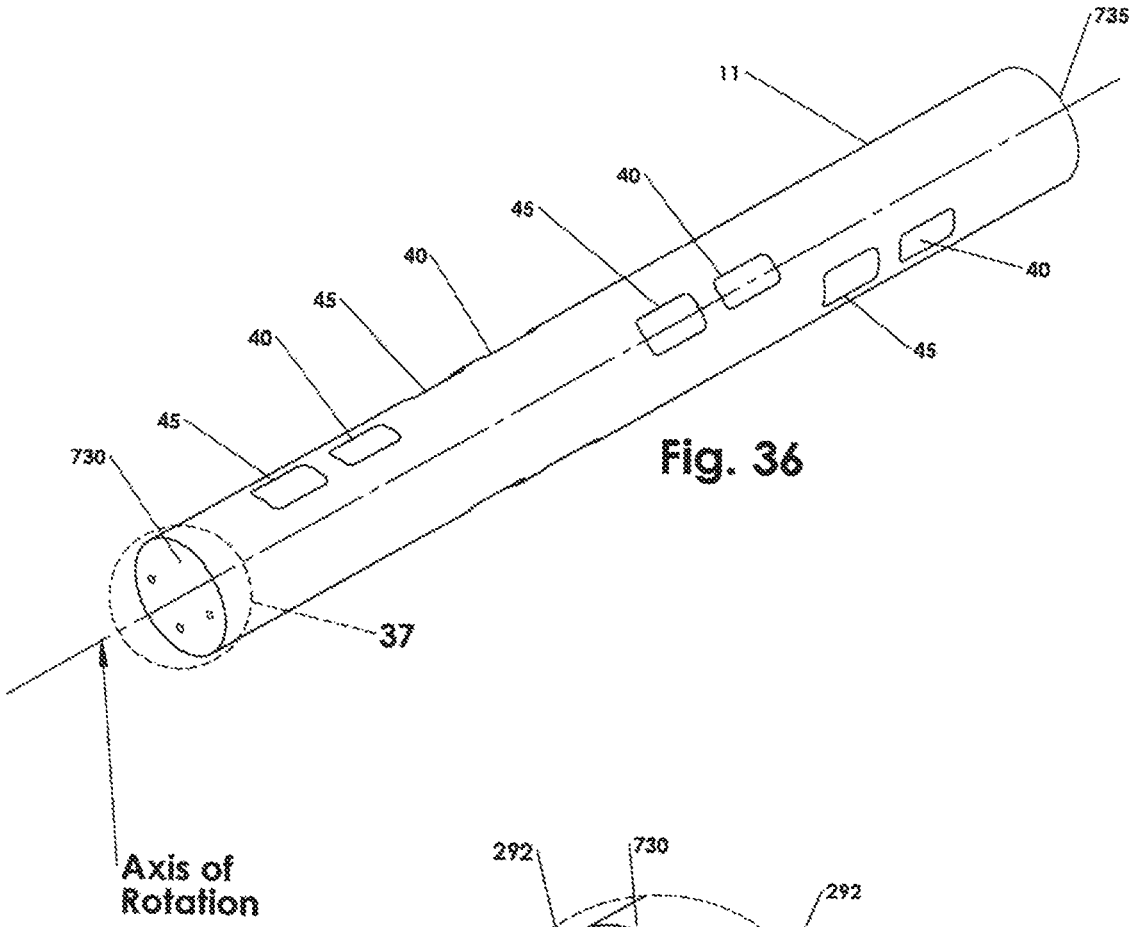
FIG. 36 shows intake cam.

FIG. 36 discloses an embodiment of intake cam 11. Depicted are the following features: primary intake apertures 40 (i.e. primary intake cam ports 40), secondary intake apertures 45 (i.e. secondary intake cam ports 45) and 'Axis of rotation'. The apertures are shown in an orientation for four cylinder engine with firing order: 1, 3, 4, 2. As intake cam 11 rotates, periodically, the primary intake apertures 40 or the secondary intake apertures 45 will align with a an intake port 10 in intake section 6 (not shown), allowing air/fuel mixture to pass into the combustion chamber 90 in the center section 7 (not shown) through the combustion chamber intake port 91. Faces of intake cam 11 are identified as follows: camshaft intake proximal 730, and camshaft intake distal 735. The "axis of rotation" is delineated.

Figure 37:
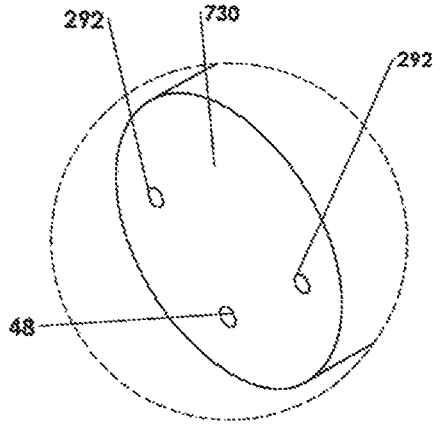
FIG. 37 shows enlarged view of intake cam.

FIG. 37 depicts the following features in an enlarged view: intake cam 11 attachment points, threaded holes for camshaft mounting bolt 292 and alignment by intake cam indexing bore 48. Face of intake cam 11 is identified as follows: camshaft intake proximal 730.

Figure 38:
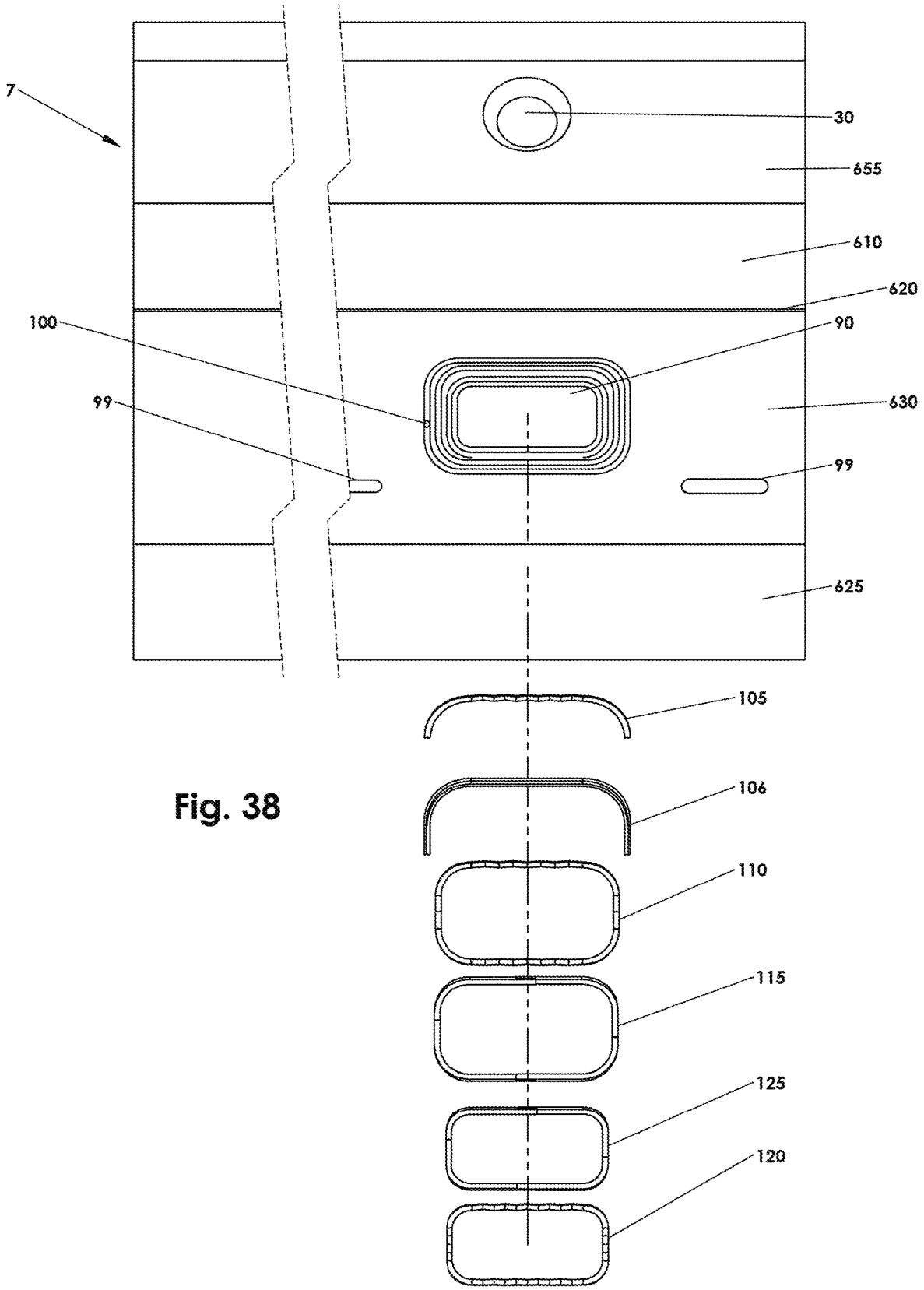
FIG. 38 shows an exploded view of a partial center section of the cylinder head oriented to display intake side.

FIG. 38 shows an exploded and partial view of the center section 7. The view is oriented to display intake side of the head and depicts the following features: spark plug access opening 30, combustion chamber 90, oil return passageways 99, lubricating oil inlets 100, intake oil-control spring 105, intake oil-control device 106, intake middle-ring spring 110, intake middle-ring 115, intake inner-ring spring 120, and intake inner-ring 125. The center section 7 functions to bring an air/fuel mixture in via intake port 10 (not shown) in intake cam 11 to the combustion chamber 90 and functions as a seal to intake cam 11 (not shown). Faces of center section 7 are identified as follows: center intake side face 610, center upper sealing face-intake 620, center lower sealing face-intake 625, center intake cam apse 630, and center top face 655.

Figure 39:
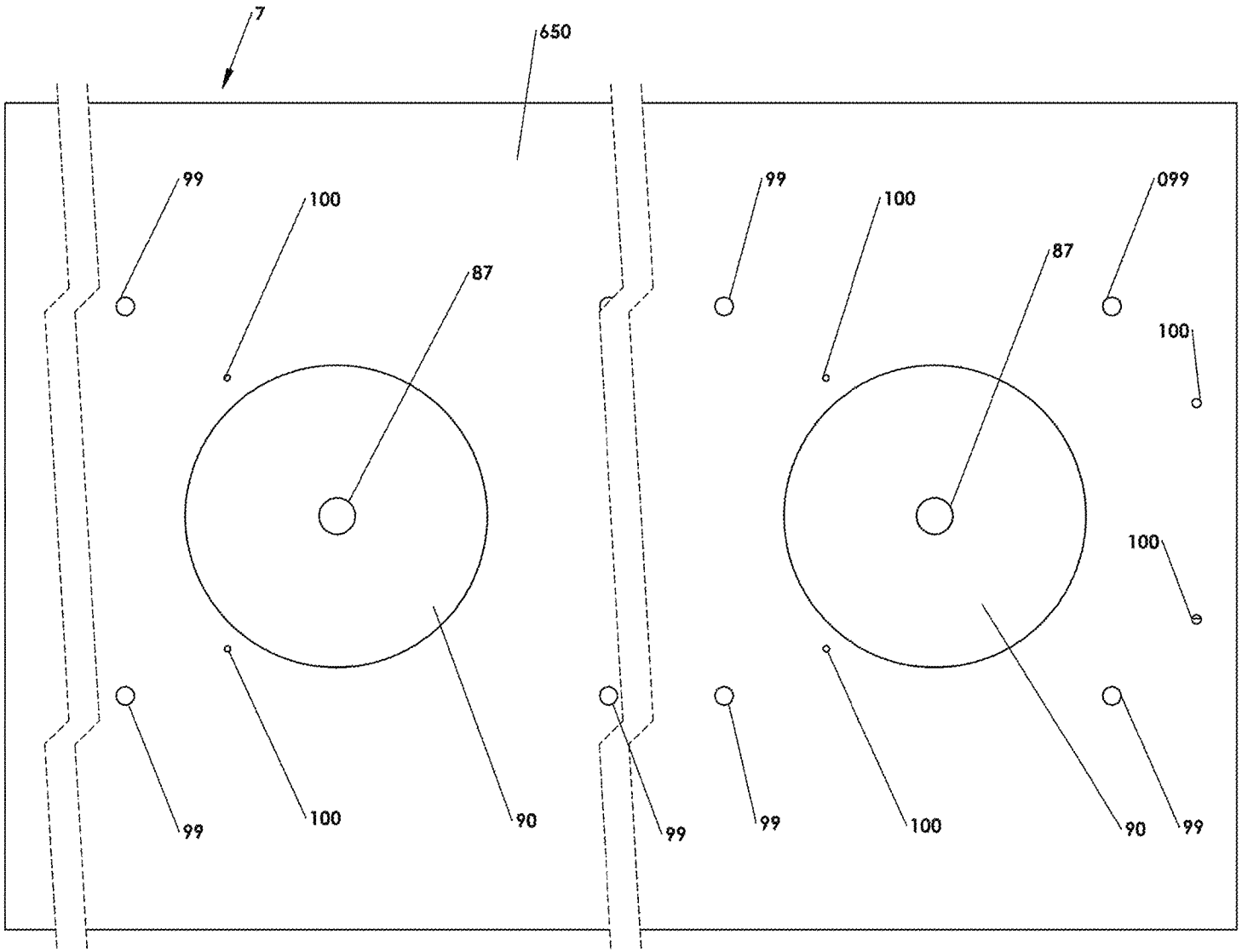
FIG. 39 shows a view of the bottom of the partial center section.

FIG. 39 shows a partial bottom view of the center section 7 and depicts the following features: threaded spark plug bores 87, combustion chambers 90, oil return passageways 99, and lubricating oil inlets 100. Air/fuel mixture is pulled into the combustion chamber 90 by the piston's downward movement in the engine block 376 (unclaimed matter) through intake port 10 (not shown). At this point the exhaust port 20 (not shown) is sealed. Intake port 10 will be sealed when the piston reaches (BDC). The piston then moves to (TDC), compressing the air/fuel mixture. At (TDC), spark plug 375 (unclaimed matter/not shown), located in the threaded spark plug bore 87, ignites the mixture, forcing the piston to (BDC). At (BDC) the exhaust valve 98 (not shown) opens, the piston moves to (TDC) forcing the burnt air/fuel mixture through the combustion chamber exhaust port 89 and out the exhaust valve 98. Faces of center section 7 are identified as follows: center bottom face 650.

Figure 40:
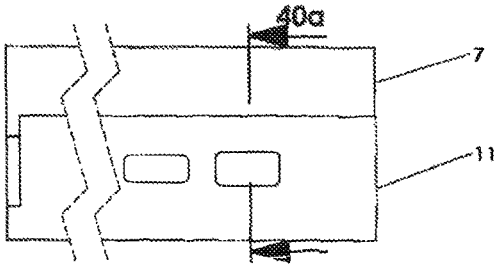
FIG. 40 shows a view of intake cam and center section.

FIG. 40 depicts an embodiment of intake cam 11 and center section 7 as a partial view side. A cutting line for FIG. 41 is identified.

Figure 41:
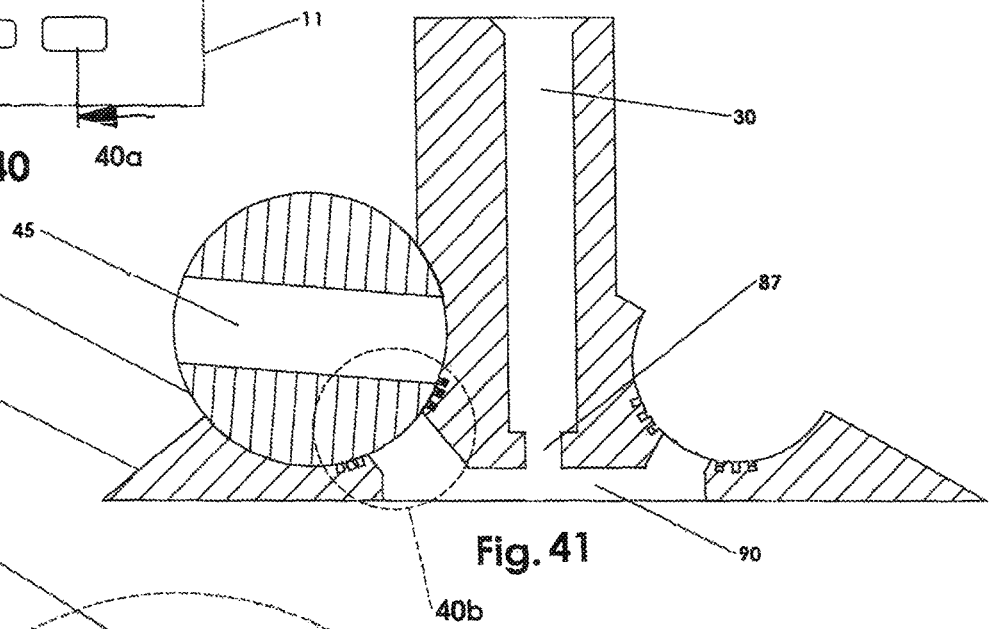
FIG. 41 shows a sectional view of intake cam and center section.

FIG. 41 shows a partial and sectional view of intake cam 11 and center section 7. Depicted are the following features: spark plug access opening 30, threaded spark plug bore 87, intake cam 11, center section 7, secondary intake aperture 45, and combustion chamber 90. Grooves 81, 83, 85, hold intake oil-control device and intake oil-control spring 105, 106, and intake sealing rings 110, 115, 120, 125, respectively. The spark plug access opening 30 allows for routine maintenance. Threaded spark plug bore 87 holds spark plugs in place.

Figure 42:
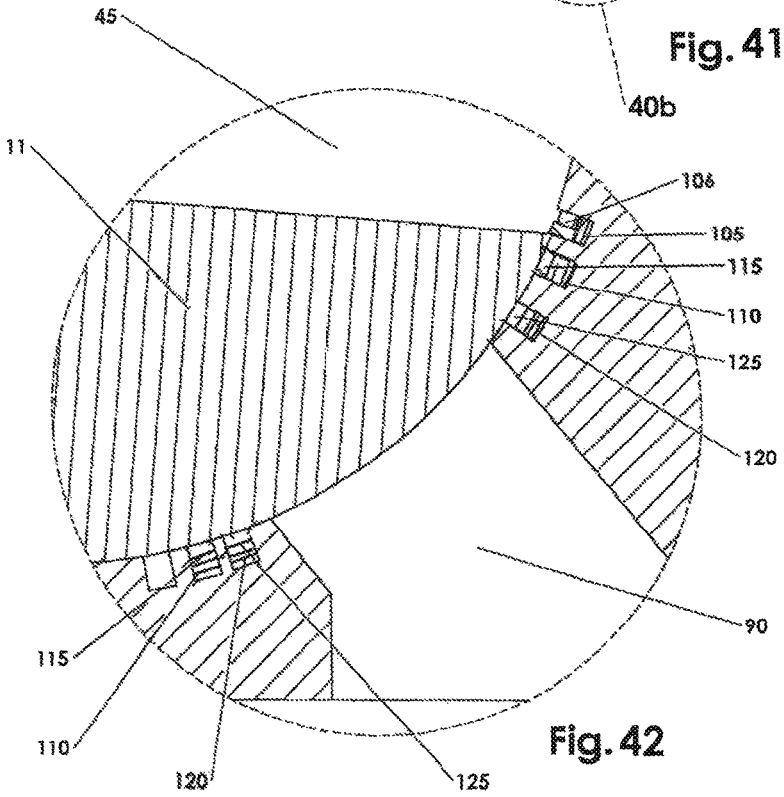
FIG. 42 shows enlarged view intake cam, center section, oil-control device/spring, and the sealing rings/springs.

FIG. 42 depicts an enlarged view of FIG. 41. Placement of the oil-control device 106 and spring 105, and intake sealing rings 115, 125, and springs 110, 120 is depicted. The spark plug access opening 30 allows for routine maintenance. The secondary intake aperture 45 is crossing the oil-control device and spring 105, 106. As intake cam 11 continues rotating clockwise, the secondary intake aperture 45 crosses intake sealing rings and springs 110, 115, 120, and 125. This illustrates the correct placement of the oil-control device and spring 105, 106, and intake sealing rings and springs 110, 115, 120, and 125 for engines with camshafts rotating clockwise. Air/fuel mixture is pulled through the secondary intake aperture 45 into the combustion chamber 90, where the mixture is burned, then out the exhaust valve 98 (not shown). Note: This drawing is with intake cam 11 in the secondary position. When intake cam 11 is in the primary position, the primary intake aperture 40 is in use.

Figure 43:
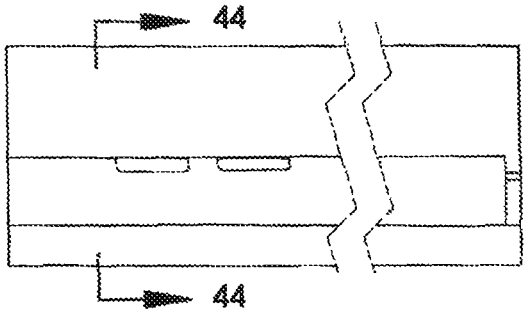
FIG. 43 shows sectioned view of the exhaust side of the center section.

FIG. 43 shows a partial side view of the exhaust side of the center section 7 and exhaust cam 12. Cutting line for FIG. 44 identified.

Figure 44:
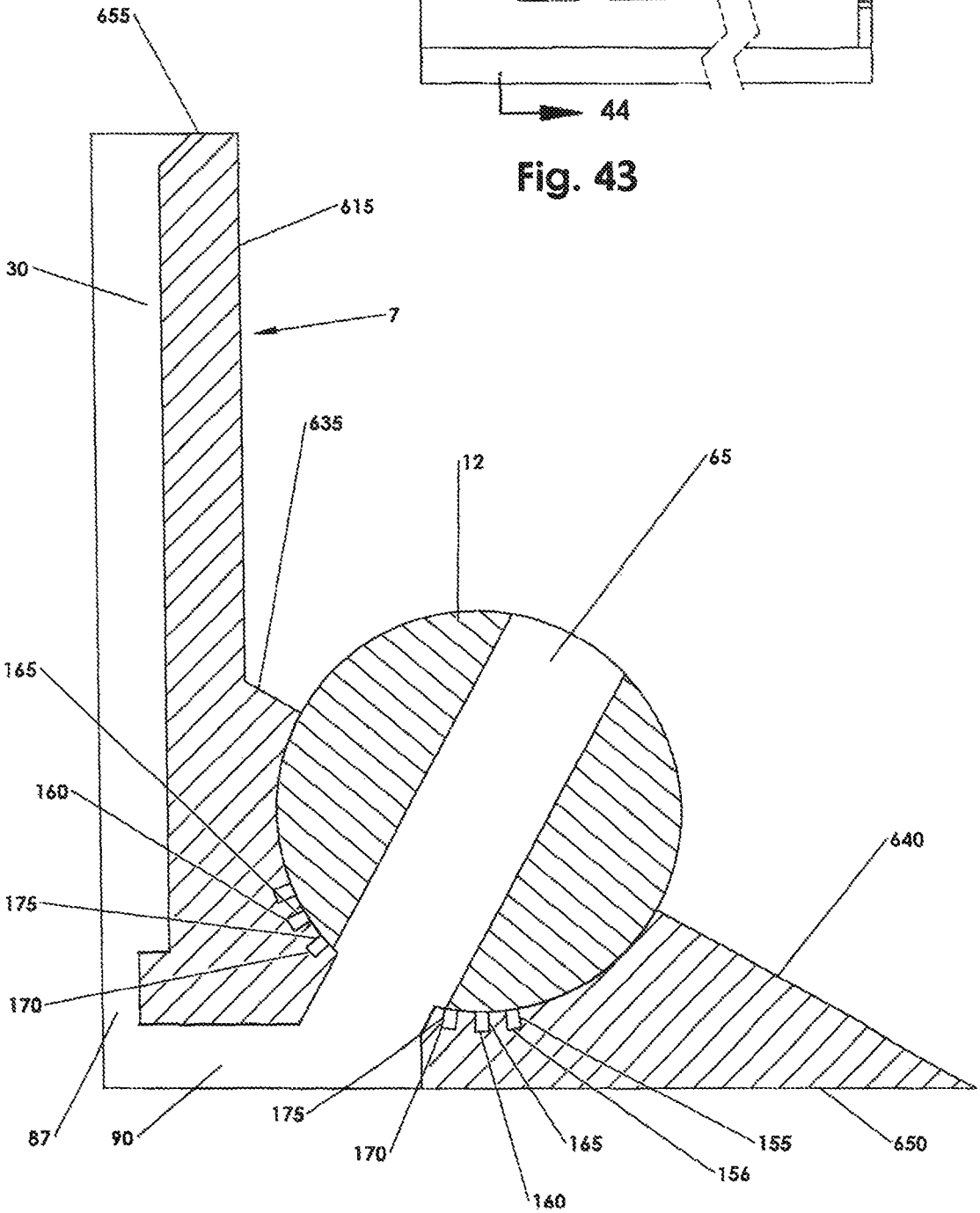
FIG. 44 shows enlarged view of the exhaust port with lands and grooves.

FIG. 44 shows a partial and sectional view of the center section 7 and exhaust cam 12. Placement of the oil-control device 156, spring 155, and the exhaust sealing rings 165, 175 and springs 160, 170, is depicted. The spark plug access opening 30 allows for routine maintenance. The secondary exhaust aperture 65 (i.e. secondary exhaust cam ports 65) has crossed the oil-control device and spring 155, 156. As the exhaust cam 12 continues rotating clockwise, the secondary exhaust aperture 65 crosses the exhaust sealing rings and springs 160, 165, 170, and 175. This illustrates the correct placement of the oil-control device and spring 155, 156, and intake sealing rings and springs 160, 165, 170, and 175 for engines with camshafts rotating clockwise. Air/fuel mixture is burned in combustion chamber 90. The burned mixture is passes through the exhaust valve 98 (not shown) and then into the secondary exhaust aperture 65. Note: This drawing is with the exhaust cam 12 in the secondary position. When the exhaust cam 12 is in the primary position, the secondary exhaust aperture 60 is in use. Faces of center section 7 and exhaust cam 12 are identified as follows: center exhaust side face 615, center upper sealing face-exhaust 635, center lower sealing face-exhaust 640, center bottom face 650, center top face 655.

Figure 45:
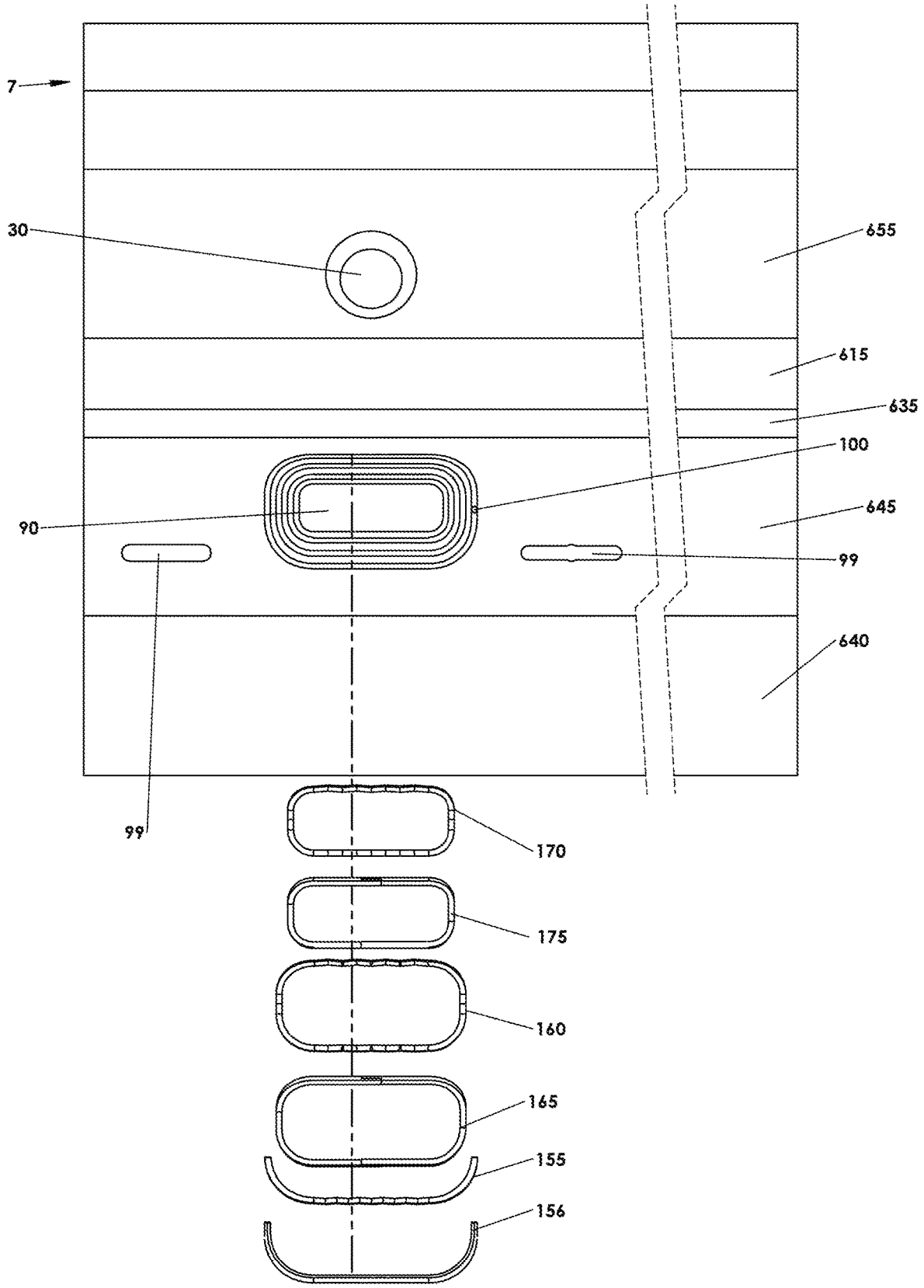
FIG. 45 shows an exploded view of the partial center section oriented to display the exhaust side of the head.

FIG. 45 shows an exploded and partial view of the center section 7. The view is oriented to display the exhaust side of the head and depicts the following features: spark plug access opening 30, combustion chamber 90, lubricating oil return passageways 99, lubricating oil inlets 100, exhaust oil-control spring 155, exhaust oil-control device 156, exhaust middle-ring spring 160, exhaust middle-ring 165, exhaust inner-ring spring 170, and exhaust inner-ring 175. The center section 7 functions to guide the burnt air/fuel mixture, in the combustion chamber 90, through primary exhaust aperture 60 (i.e. primary exhaust cam ports 60) or secondary exhaust aperture 65 in exhaust cam 12. Additionally, functions as a seal to the exhaust cam 12 (not shown). Faces of center section 7 are identified as follows: center exhaust side face 615, center upper sealing face-exhaust 635, center lower sealing face-exhaust 640, center exhaust cam apse 645, center top face 655.

Figure 46:
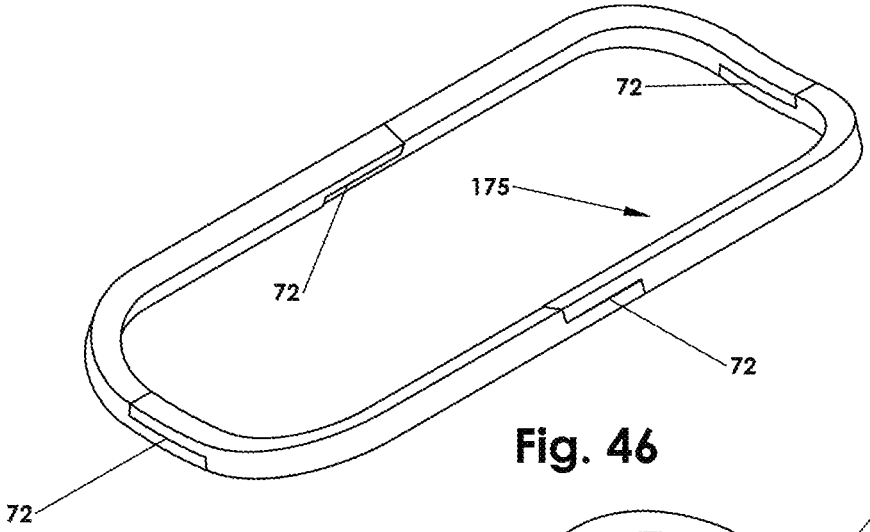
FIG. 46 shows the exhaust inner-ring sealing assembly.

FIG. 46 depicts an embodiment of the exhaust inner-ring sealing assembly 175 that seals the combustion chamber so there is minimal blowback of gases to the crankcase. Sealing ring overlap joints 72 identified. The overlap joints 72 allows for expansion and contraction of cylinder head during engine warm-up and cool-down and compensates for wear while maintaining their original sealing competence. The exhaust inner-ring 175 functions as a seal between the exhaust cam 12 (not shown) and the exhaust section 7 (not shown).

Figure 47:
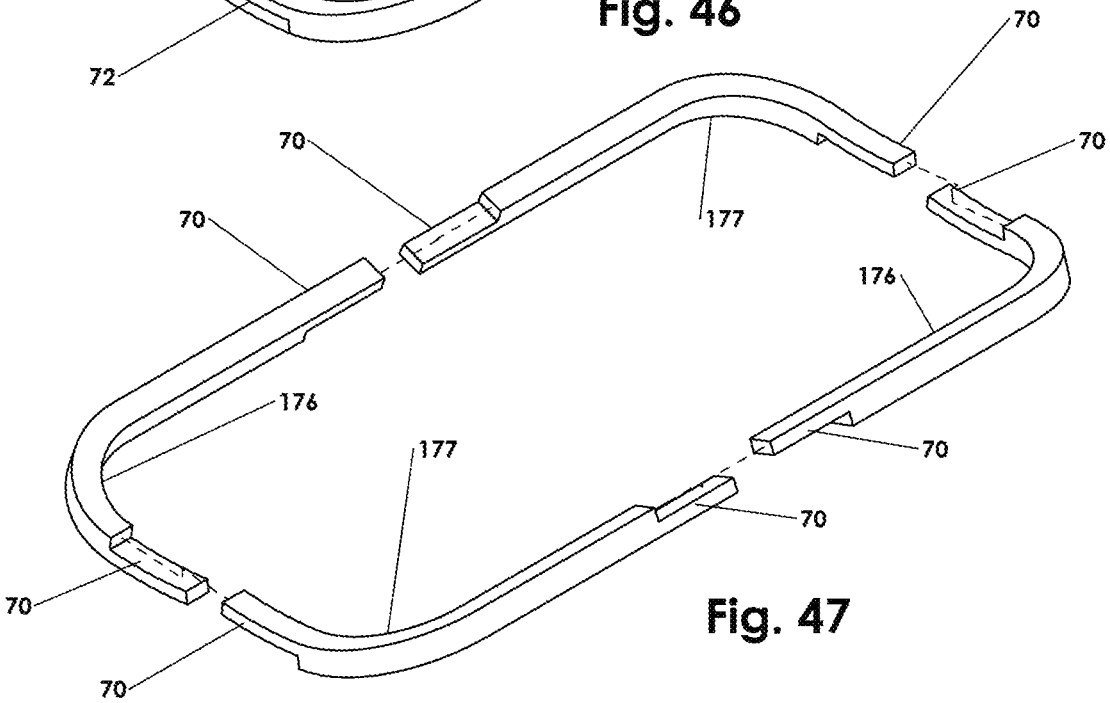
FIG. 47 shows an exploded view of the exhaust inner-ring.

FIG. 47 depicts an exploded view of the exhaust inner-ring 175. Illustrated features: exhaust right-hand inner-ring segments (2) 176, exhaust left-hand inner-ring segments (2) 177 and sealing ring mating member (8) 70. Sealing of the sealing ring mating member parts 175, 176 accomplished by overlapping the mating members 70. The overlapping mating members 70 forms a sealing ring mating member joints 72 (not shown) that allows for expansion and contraction of cylinder head during engine warm-up and cool-down and compensates for wear while maintaining their original sealing competence. Projection lines indicate fitment relationships.

Figure 48:
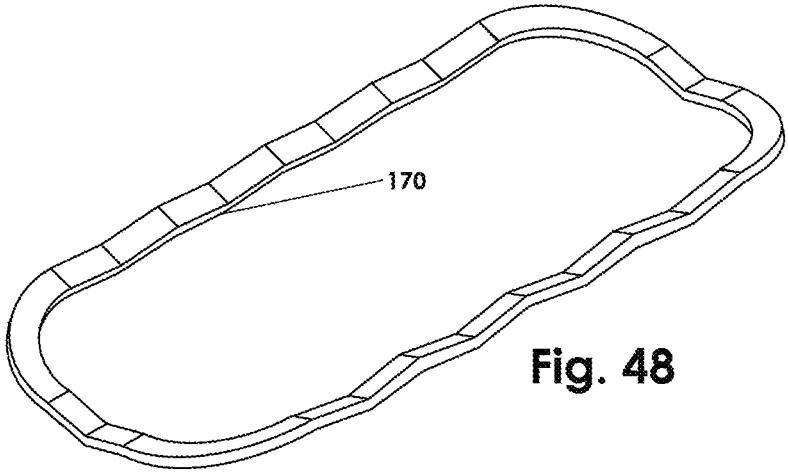
FIG. 48 shows the exhaust inner-ring sealing assembly spring.

FIG. 48 depicts an embodiment of the exhaust inner-ring spring 170. The exhaust inner-ring spring 170 provides pressure to assure contact between the exhaust inner-ring 175 and the exhaust valve shaft 12 (not shown).

Figure 49:
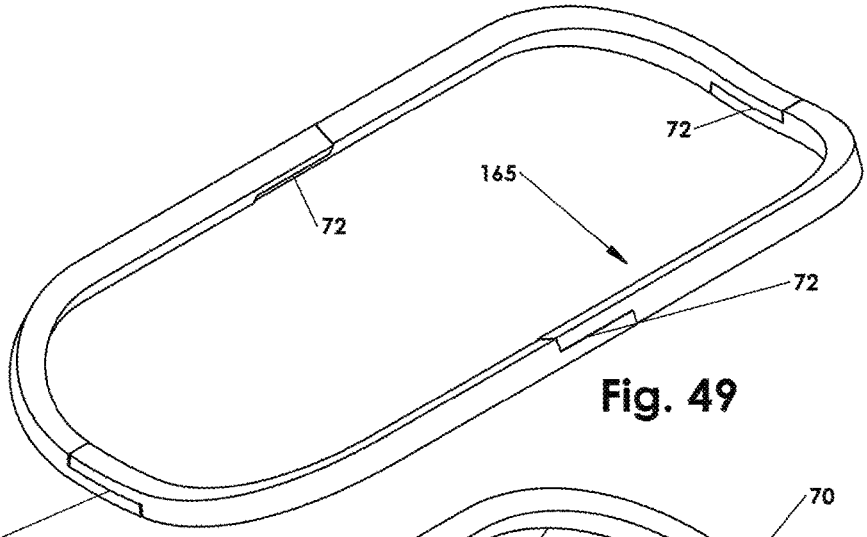
FIG. 49 shows the exhaust middle-ring sealing assembly.

FIG. 49 depicts an embodiment of the exhaust middle-ring 165 that seals the combustion chamber so there is minimal blowback of gases to the crankcase. Sealing ring overlap joints (4) 72 identified. The overlap joints 72 allows for expansion and contraction of cylinder head during engine warm-up and cool-down and compensates for wear while maintaining their original sealing competence. The exhaust middle-ring 165 function as a seal between the exhaust cam 12 (not shown) and the center section 7 (not shown).

Figure 50:
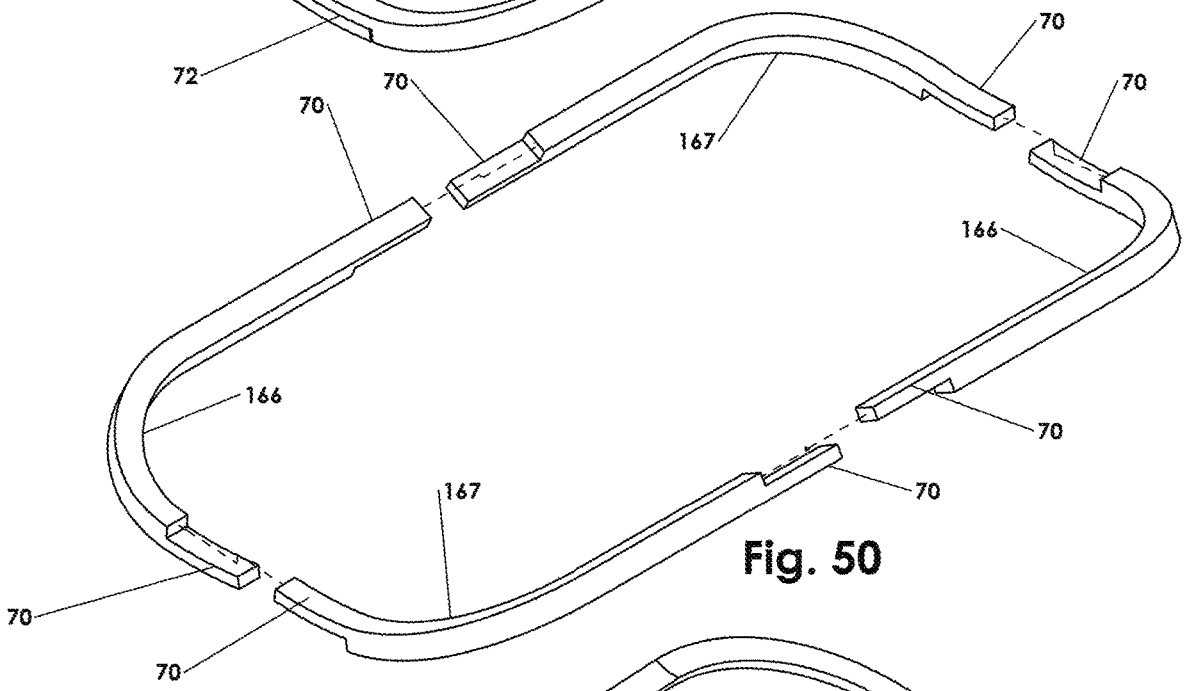
FIG. 50 shows an exploded view of the exhaust middle-ring.

FIG. 50 depicts an exploded view of the exhaust middle-ring 165. Illustrated features: exhaust right-hand middle-ring segments (2) 166, exhaust left-hand middle-ring segments (2) 167 and sealing ring mating member (8) 70. Sealing of the sealing ring mating member parts 165, 166 accomplished by overlapping the mating members 70. The overlapping mating members 70 forms a sealing ring mating member joints 72 (not shown) that allows for expansion and contraction of cylinder head during engine warm-up and cool-down and compensates for wear while maintaining their original sealing competence. Projection lines indicate fitment relationships.

Figure 51:
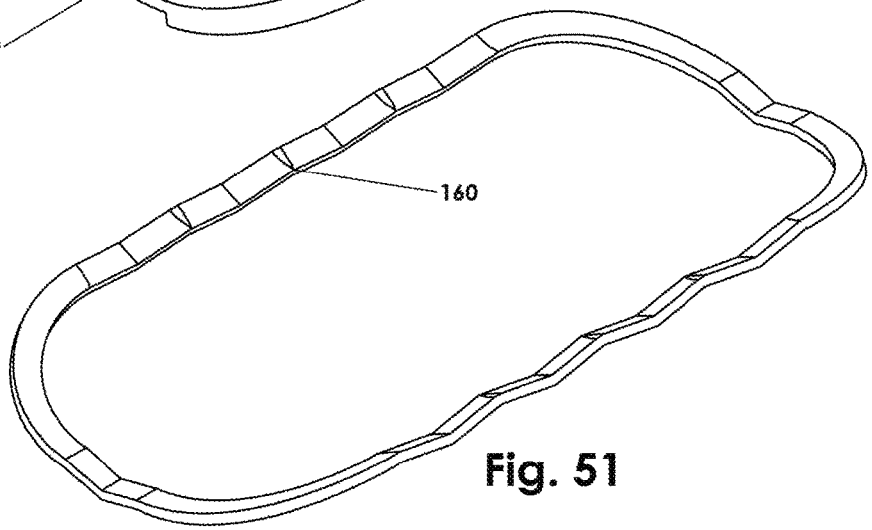
FIG. 51 shows the exhaust middle-ring sealing assembly spring.

FIG. 51 depicts an embodiment of the exhaust middle-ring spring 160. The exhaust middle-ring spring 160 provides pressure to assure contact between the exhaust middle-ring 165 (not shown) and the exhaust cam 12 (not shown).

Figure 52:
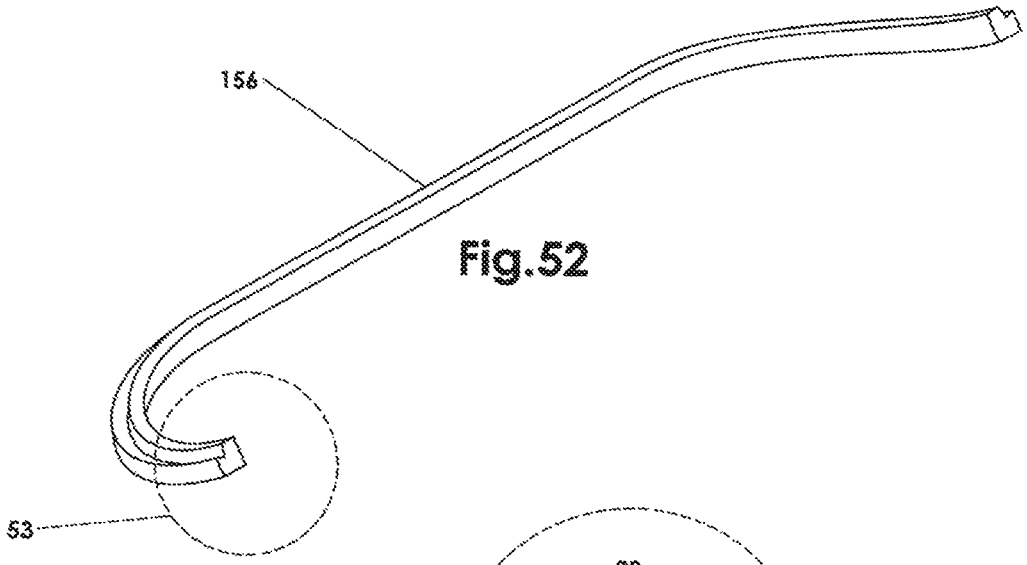
FIG. 52 shows the exhaust oil-control device.

FIG. 52 depicts the exhaust oil-control device 156. The exhaust oil-control device and spring 155, 156 occupy the leading edge (first half) of the groove for oil-control device 81. The trailing edge (second half) channels and distributes lubricating oil to exhaust side of the cylinder head assembly 5. Excess oil flows into an oil channel 94 where it flows into an oil-control groove 81 when the oil-control segment 156 contacts the exhaust cam 12.

Figure 53:
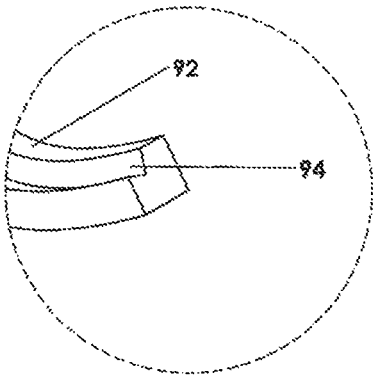
FIG. 53 shows an enlarged view of the exhaust oil-control device.

FIG. 53 depicts an enlarged view of the oil scraper face 92 and the oil scraper leading face 94. The oil scraper leading face 94 collects lubricating oil and channels it to oil return passageways 99 (not shown).

Figure 54:
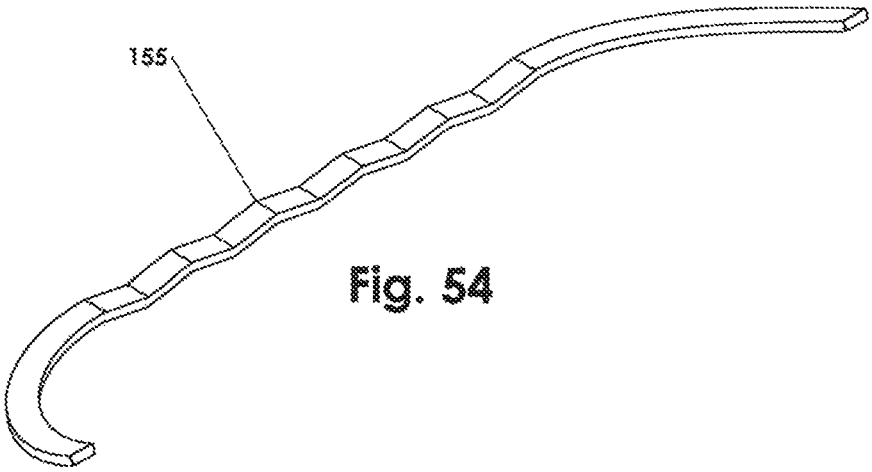
FIG. 54 shows the exhaust oil-control spring.

FIG. 54 depicts an exhaust oil-control spring 155, which provides pressure to assure sealing between the exhaust oil-control segment 156 (not shown) and exhaust cam 12 (not shown).

Figure 55:
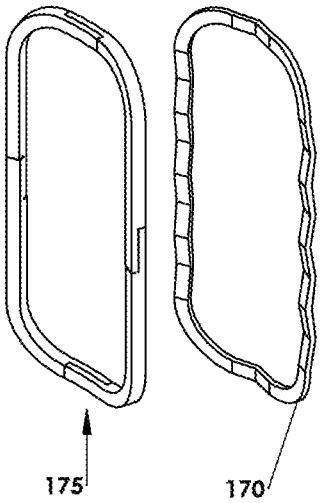
FIG. 55 shows an exhaust inner-ring positioned with exhaust inner-ring spring.

FIG. 55 depicts an embodiment of exhaust inner-ring 175 and exhaust inner-ring spring 170 positioned to show relationship.

Figure 56:
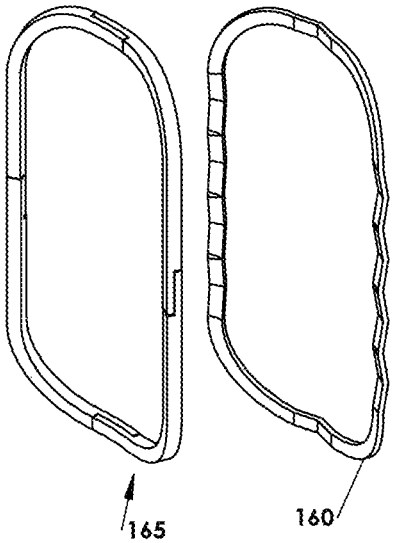
FIG. 56 shows an exhaust middle-ring positioned with exhaust middle-ring spring.

FIG. 56 depicts the exhaust middle-ring 165 and the exhaust middle-ring spring 160 positioned to show relationship.

Figure 57:
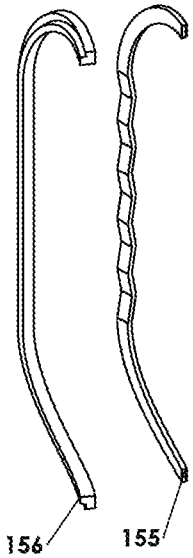
FIG. 57 shows an exhaust oil-control device positioned with exhaust oil-control spring.

FIG. 57 depicts the exhaust oil-control device 156 and exhaust oil-control spring 155 positioned to show relationship.

Figure 58:
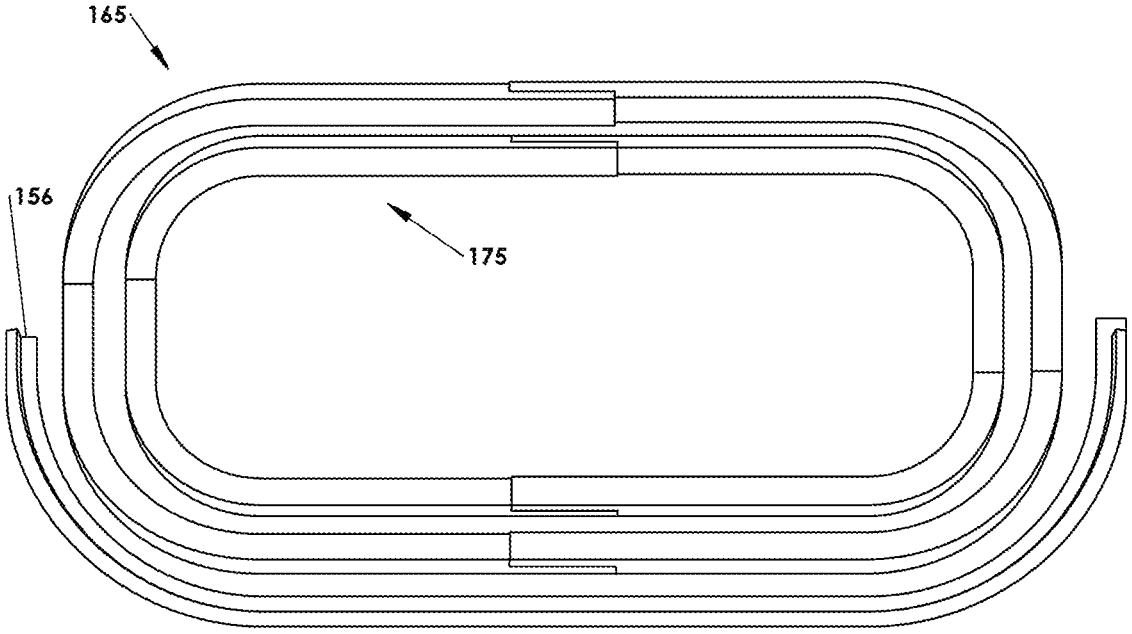
FIG. 58 shows an exhaust inner-ring, exhaust middle-ring, and exhaust oil-control device.

FIG. 58 depicts the exhaust middle-ring 165, the exhaust inner-ring 175, and exhaust oil-control device 156 to display their orientation when installed in the exhaust sides of the cylinder head assembly 5.

Figure 59:
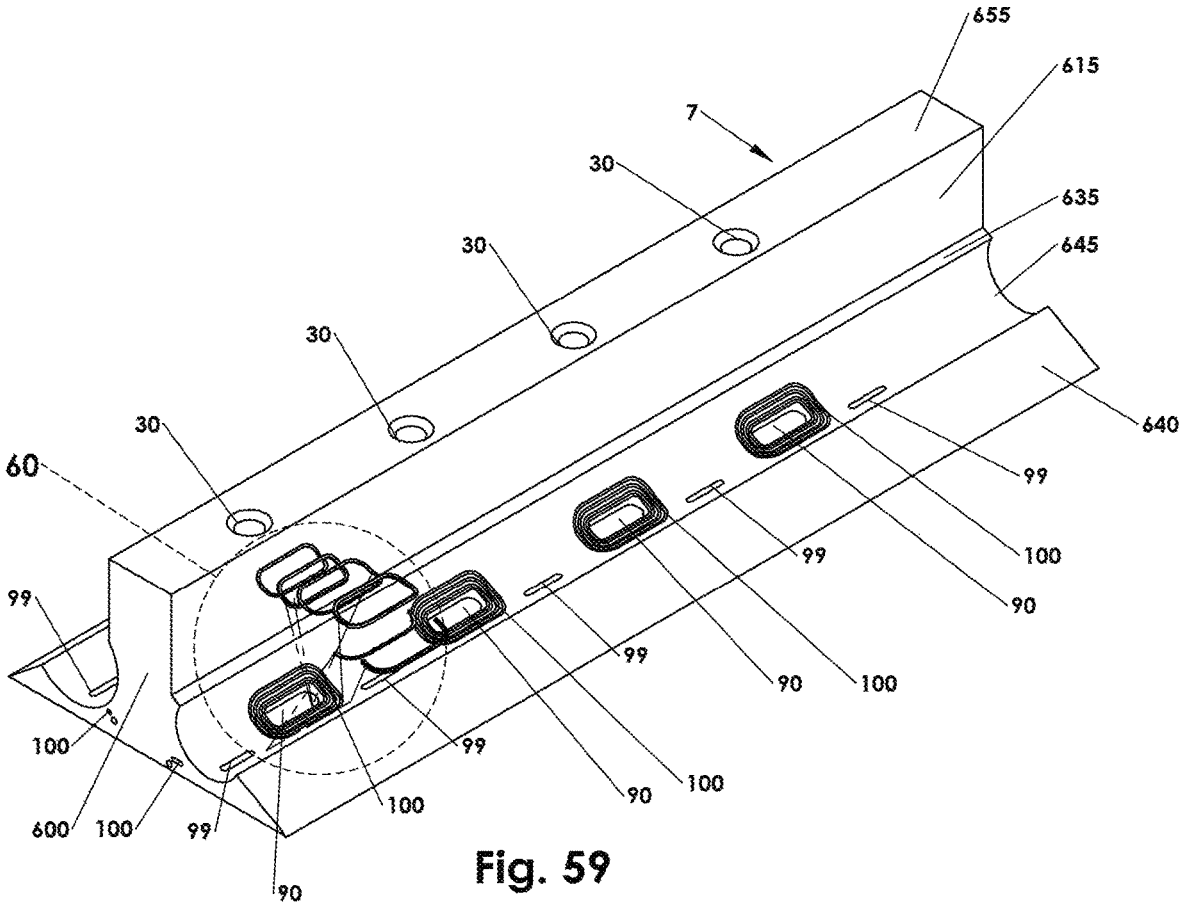
FIG. 59 shows the center section oriented to display the exhaust side.

FIG. 59 discloses the center section 7 oriented to display the exhaust side of the head in an exploded view of the following features: spark plug access openings (4) 30, combustion chamber (4) 90, oil return passageways (5) 99, and lubricating oil inlets (6) 100. Faces of center section 7 are identified as follows: center front face 600, center exhaust side face 615, center upper sealing face-exhaust 635, center lower sealing face-exhaust 640, center exhaust cam apse 645, center top face 655.

Figure 60:
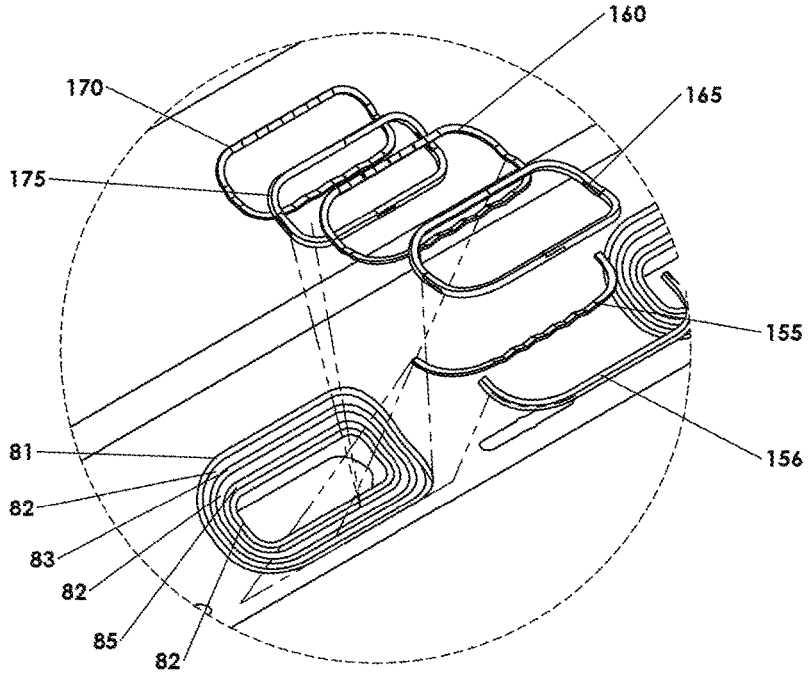
FIG. 60 shows an enlarged view of the exhaust side of the center section.

FIG. 60 depicts an enlarged view of the following features: exhaust oil-control spring 155, exhaust oil-control device 156, exhaust middle-ring assembly spring 160, exhaust middle-ring assembly 165, exhaust inner-ring assembly spring 170, and exhaust inner-ring assembly 175. Projection lines indicate placement of exhaust oil-control devices 155, 156, and exhaust sealing rings 160, 165, 170, 175, and in grooves 81, 83, 85 respectively. Lands (3) 82 between grooves are also identified.

Figure 61:
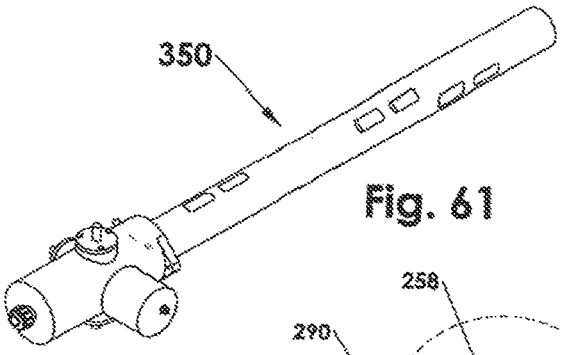
FIG. 61 shows the exhaust camshaft drive and shift assembly.

FIG. 61 discloses an embodiment of the exhaust cam drive/shift 350. This device rotates the exhaust cam 12. In addition, nutate the exhaust cam 12 between its operating positions (primary or secondary). Nutation is controlled by the engine control module (unclaimed matter).

Figure 62:
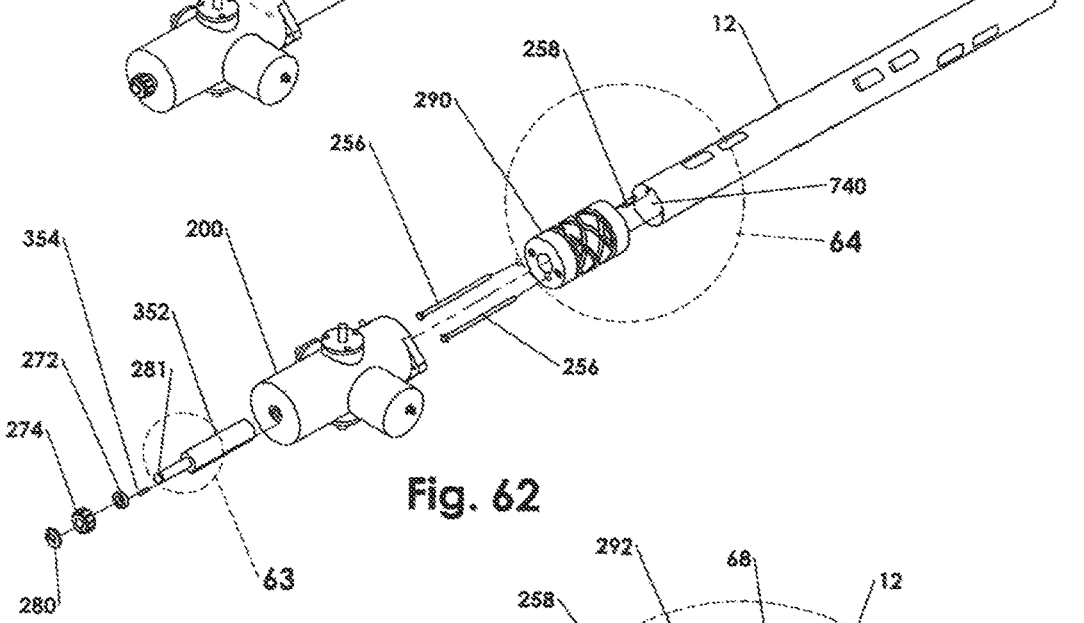
FIG. 62 shows an exploded view of the exhaust cam drive/shift.

FIG. 62 provides an exploded view of the exhaust cam drive/shift 350. Projection lines provide relationships of parts in the device. Starting with the exhaust cam 12, followed by cam-to-rifled shaft dowel pin 258, rifled shaft 290, rifled shaft to camshaft retaining bolts (2) 256, rifled shaft actuator 200, male telescoping shaft-exhaust 352, exhaust square key 354, slotted shaft spacer 272, cam-to-cam pulley 274, and ending with the snap ring 280. The cam-to-cam pulley 274 rotates the exhaust cam drive/shift 350 except for the rifled shaft housing 210 (not shown), which is bolted to the cylinder head assembly 5. There are two (2) cam-to-cam pullies 274 in the cylinder head assembly 5. One on intake cam drive/shift 190 that rotates via the cam-to-cam belt 328 the second on the exhaust cam drive/shift 350. Nutation occurs when, with the engine assembly 3 is running, the engine control module (unclaimed matter) sends a signal to the double-acting solenoid shell 238 (not shown), a member of the master-pin assembly 230 (not shown), to momentarily move the master-pin 232 (not shown) to or fro. The master-pin 232 (not shown), a member of the master-pin assembly 230 (not shown), then engages master-pin rifling 298 (not shown) in the rifled shaft 290 (not shown). Simultaneously, slave-pins (3) 260 (not shown) then engages slave-pin rifling 296 (not shown) in the rifled shaft 290 (not shown). The combined action of the pins 232, 260, the rifling 296, 298 and rotation of rifled shaft 290 shifts the exhaust cam and rifled shaft 290 laterally on their axes from the primary position to the secondary position or vice-versa. When the shifting is complete the pins 232, 260 engage either the rifled shaft positioning detent-primary 301 (not shown) or the rifled shaft positioning detent-secondary 300 (not shown).

Figure 63:
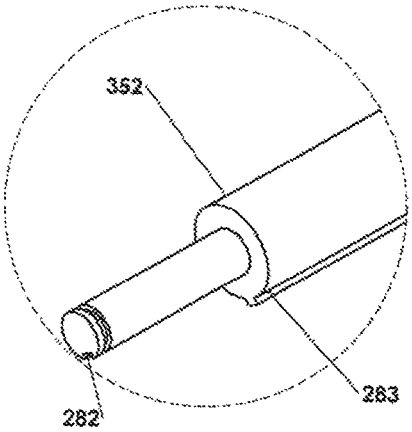
FIG. 63 shows an enlarged view of exhaust telescoping shaft.

FIG. 63 is an enlarged view of the male telescoping shaft-exhaust 352 that identifies indexing spline-male telescoping shaft 283 and square key slot 282. The indexing spline-male telescoping shaft 283 mates with the indexing fossa 284, in the rifled shaft 290, to align the male telescoping shaft-exhaust 352 and the rifled shaft 290.

Figure 64:
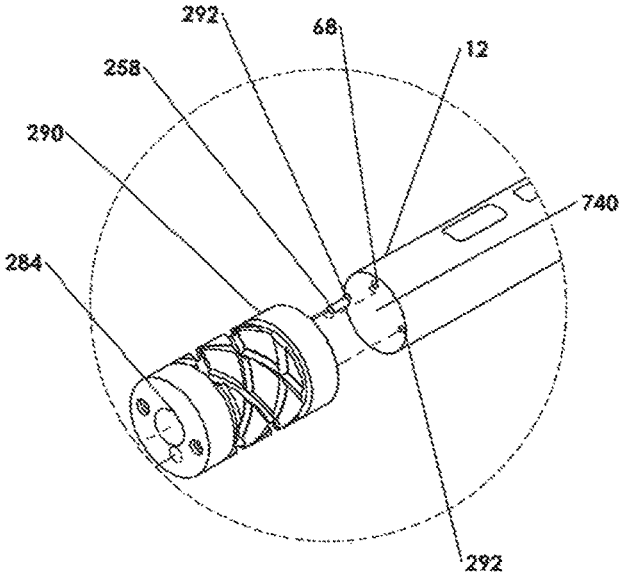
FIG. 64 show an enlarged view of the exhaust camshaft and the rifled shaft.

FIG. 64 is an enlarged view illustrating how the rifled shaft 290, and exhaust cam 12, are aligned by exhaust cam indexing bore 68, cam-to-rifled shaft dowel pin 258, rifled shaft indexing bore 294, and threaded holes (2) for camshaft mounting bolts (2) 292. Indexing fossa 284 mates with indexing spline-male telescoping shaft 283 (not shown) to align male telescoping shaft-exhaust 352 and the rifled shaft 290. Faces of exhaust cam 12 are identified as follows: camshaft exhaust proximal 740.

Figure 65:
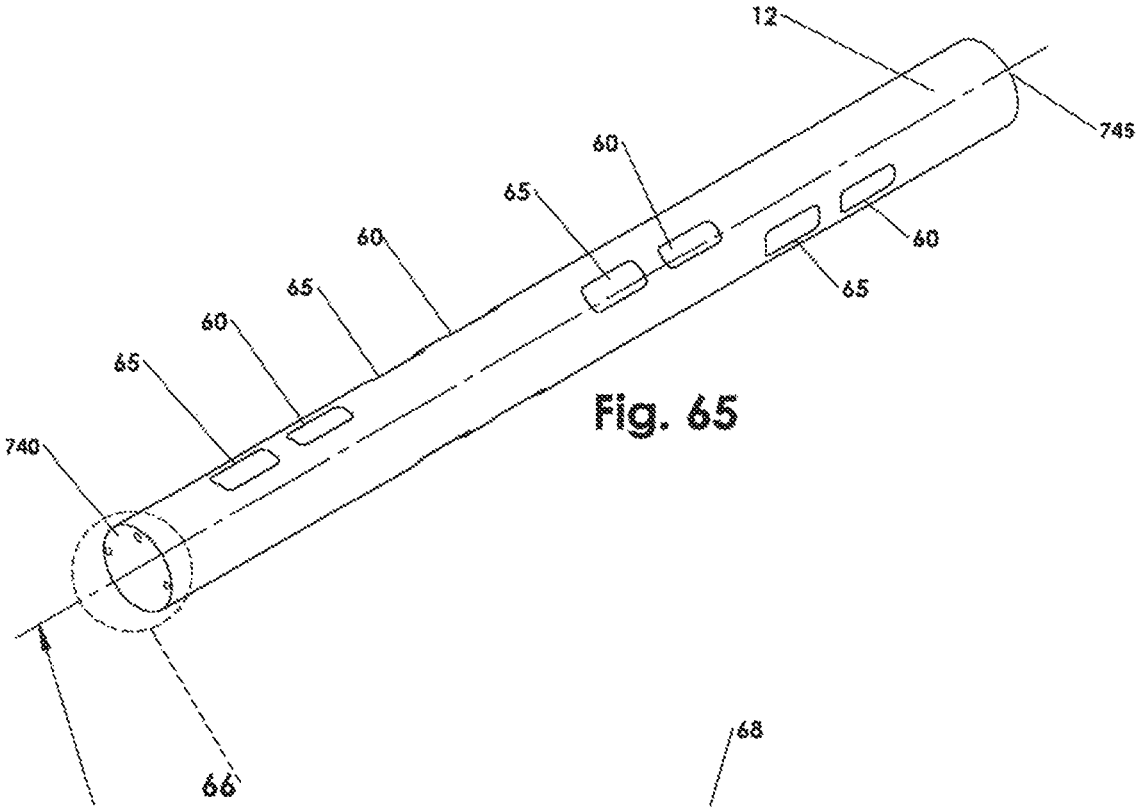
FIG. 65 shows the exhaust camshaft.

FIG. 65 discloses an embodiment of the exhaust cam 12 and depicts the following features: primary exhaust apertures (4) 60, the secondary exhaust apertures (4) 65 and 'Axis of rotation'. The apertures are shown in an orientation for a four (4) cylinder engine with firing order: 1, 3, 4, 2. As the exhaust cam 12 rotates, periodically, the primary exhaust apertures (4) 60 or the secondary exhaust apertures (4) 65 will align with exhaust port 20 (4) in the center section 7 (not shown) allowing burnt air/fuel mixture to exit the combustion chamber 90 in the center section 7 (not shown). Faces of exhaust cam 12 are identified as follows: camshaft exhaust proximal 740, camshaft exhaust distal 745. The "axis of rotation" is delineated.

Figure 66:
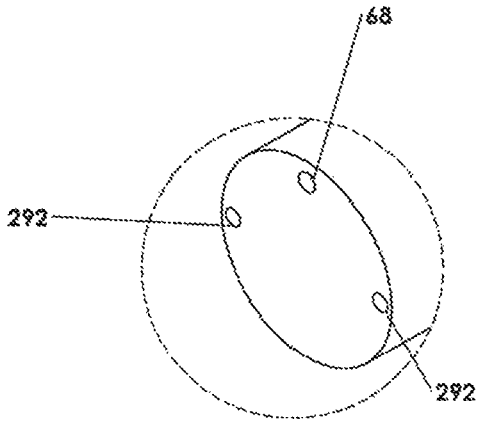
FIG. 66 shows an enlarged view of the exhaust cam.

FIG. 66 depicts the following features: exhaust cam 12 attachment points, threaded hole for camshaft mounting bolt (2) 292, and alignment by exhaust cam indexing bore 68.

Figure 67:
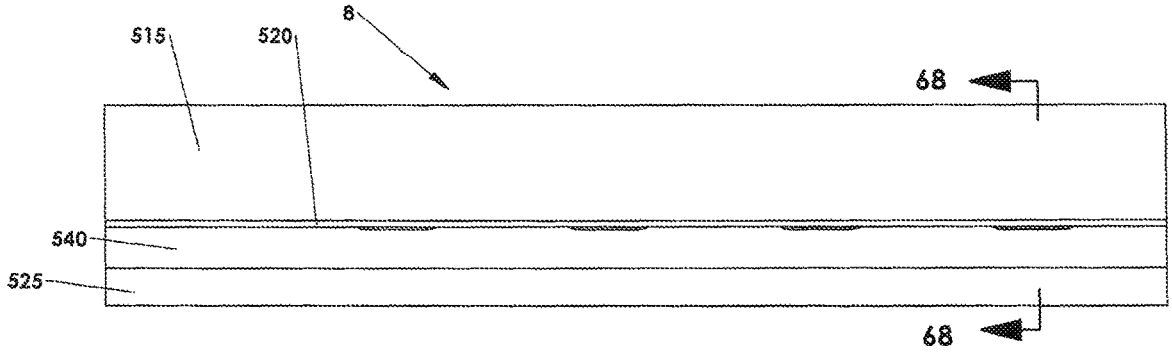
FIG. 67 shows the exhaust section of cylinder head.

FIG. 67 provides a side view of the exhaust section 8 and cutting line 68. Faces of Exhaust section 8 are identified as follows: exhaust inside face 515, exhaust upper sealing face 520, exhaust lower sealing face 525, exhaust cam apse 540.

Figure 68:
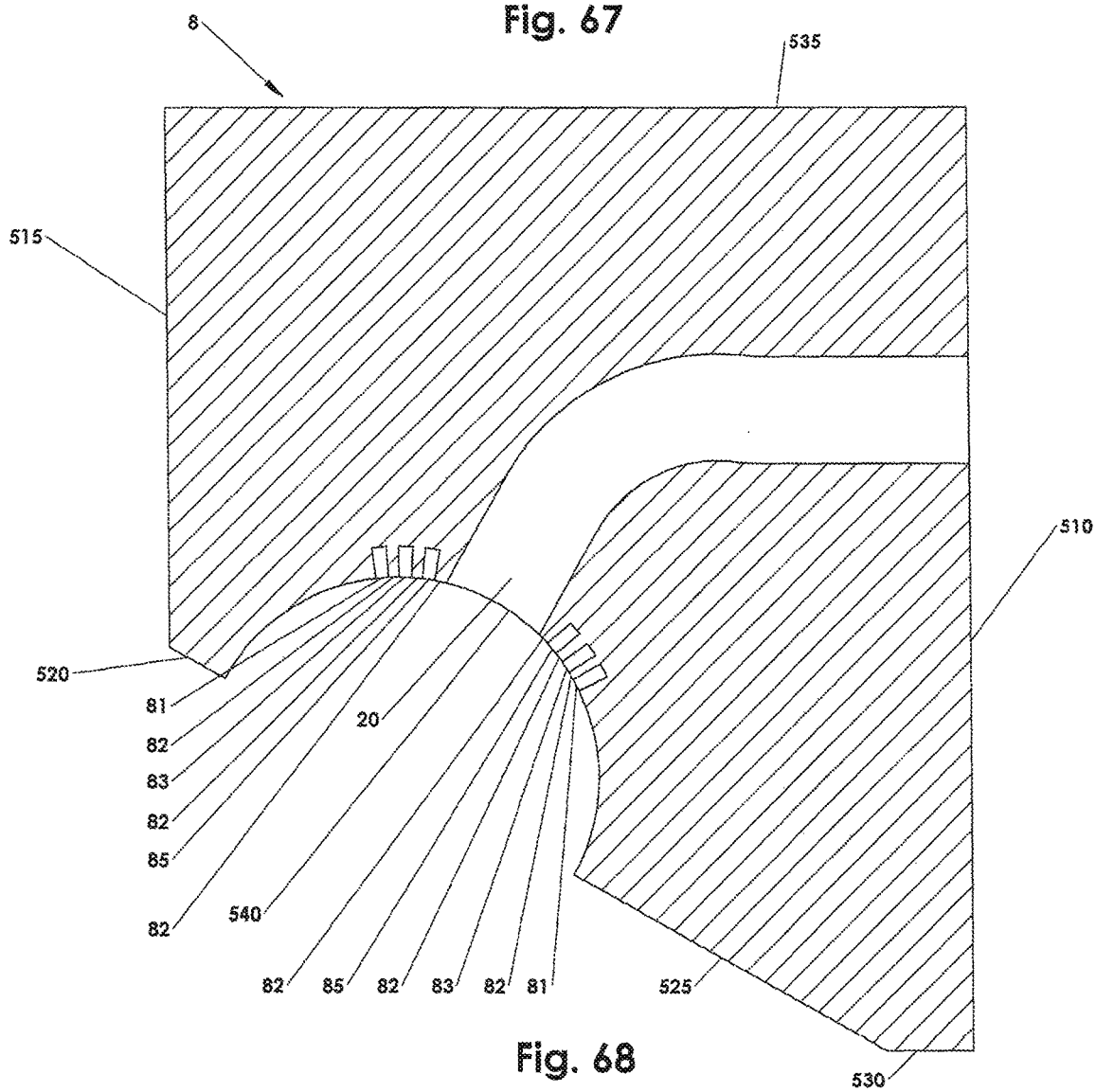
FIG. 68 shows a sectional view of exhaust section.

FIG. 68 depicts an embodiment of the exhaust section 8, in a sectional view, illustrating the relationship between the exhaust port 20, lands (3) 82, and grooves 81, 83, 85. This view is a "bare part" (i.e., the exhaust section 8 only). Faces of exhaust section 8 are identified as follows:

exhaust outside face 510, exhaust inside face 515, exhaust upper sealing face 520, exhaust lower sealing face 525, exhaust bottom face 530, exhaust top face 535, exhaust cam apse 540.

Figure 69:
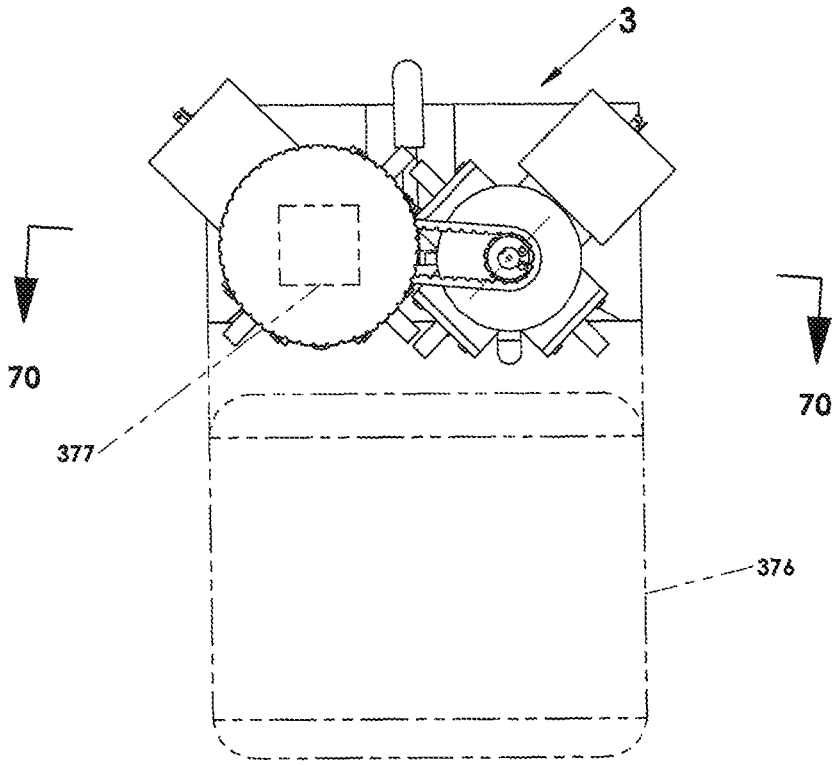
FIG. 69 shows a front view of the engine assembly.

FIG. 69 depicts a front view of the engine assembly 3, engine block 376 (unclaimed matter), electronic cam advance-retard device 377 (unclaimed matter), and cutting line 70. Cutting line 70 is set at an angle so that it bisects intake cam 11 and the exhaust cam 12 axially.

Figure 70:
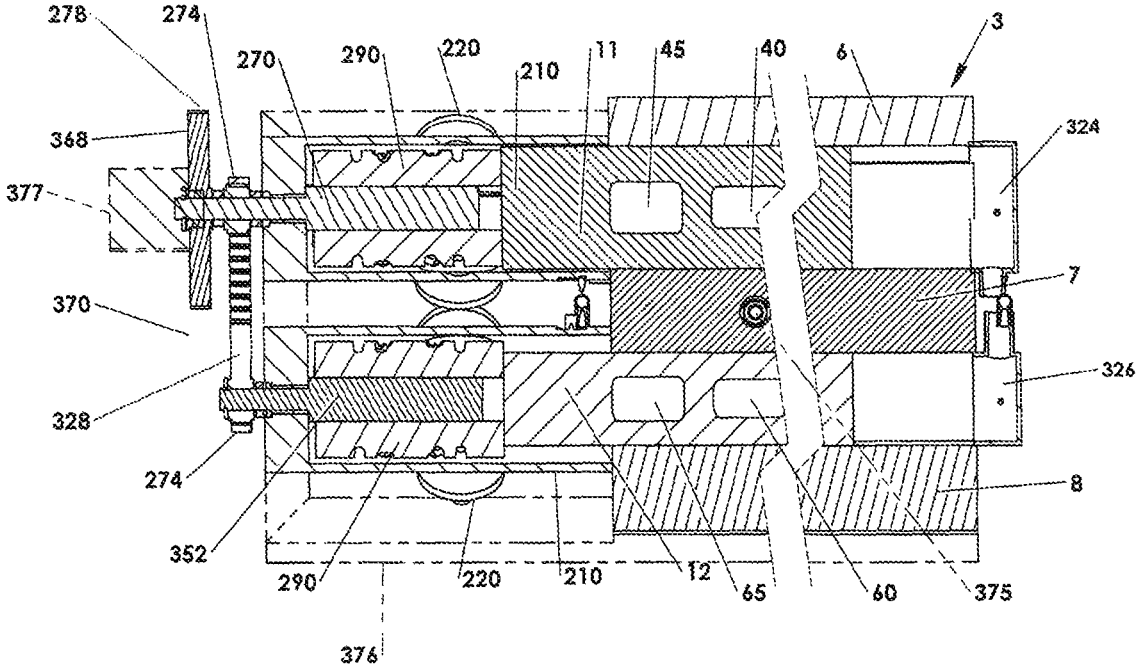
FIG. 70 shows a sectional and partial view of the engine assembly with cams in primary position.

FIG. 70 depicts a sectional view of the engine assembly 3. Intake cam 11 and exhaust cam 12 are in the primary position. The primary intake aperture 40 and primary exhaust aperture 60 are operational. Spark plug 375 (unclaimed matter), located between intake aperture 40 and primary exhaust aperture 60, ignites the incoming air/fuel mixture. By design, the ports and apertures line up laterally to maximize fluid flow through the open valve. The secondary intake aperture 45 and secondary exhaust aperture 65 are in retracted position and not involved in engine operation. While in these retracted positions, oil return passageway 99 (not shown) removes extraneous oil. The rifled shafts 290 telescope over the male telescoping shaft-intake 270 and male telescoping shaft-exhaust 352 to allow intake cam 11 and exhaust cam 12 to move laterally. The crankshaft pulley 370 rotates the cam-to-crankshaft pulley 278 by the crankshaft-to-cam belt 368. The crankshaft pulley 278 rotates the cam-to-cam pulley 274 on intake side of the cylinder head assembly 5. The cam-to-cam belt 328 rotates the cam-to-cam pulley 274 on the exhaust side of the cylinder head assembly 5 in sync with the cam-to-cam pulley 274 on intake side of the cylinder head assembly 5. Slave pin assemblies 220 maintain lateral position of intake cam 11 and exhaust cam 12. The rifled shaft housing 210, rear cam cover-intake 324 and rear cam cover-exhaust 326 are depicted.

Figure 71:
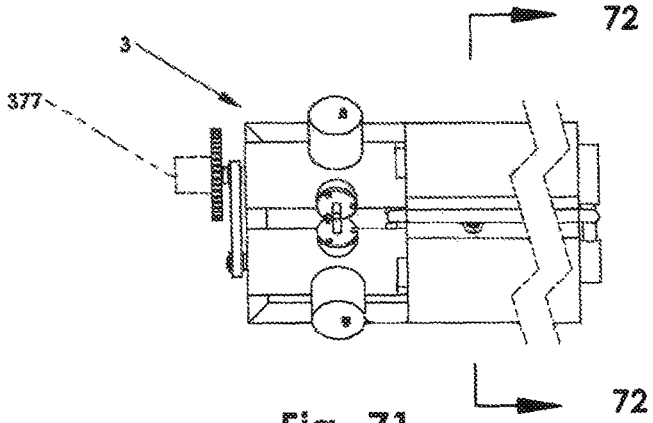
FIG. 71 shows a partial view of the engine assembly.

FIG. 71 depicts a partial view of the engine assembly 3 and cutting line 72. The electronic cam advance-retard device 377 (unclaimed matter) is identified.

Figure 72:
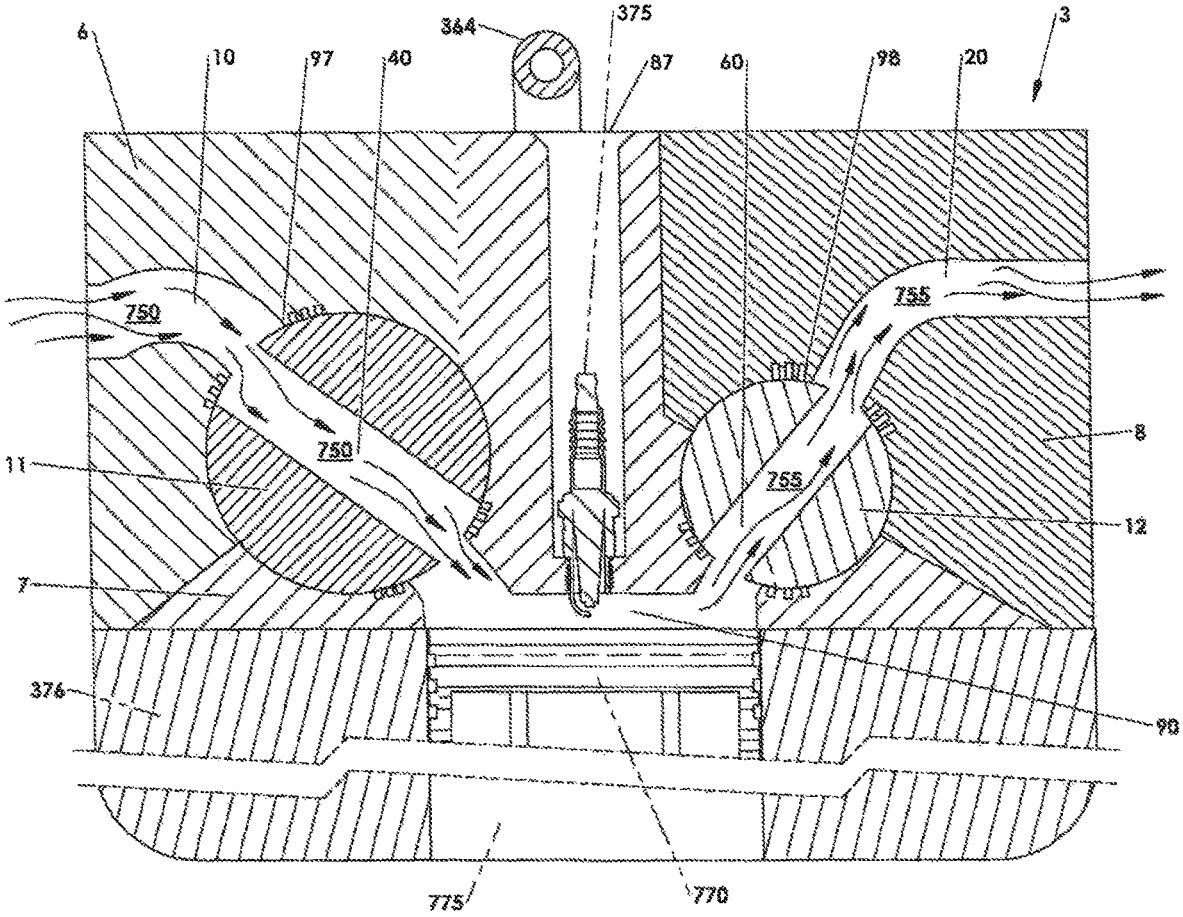
FIG. 72 shows a sectional and partial view of the engine assembly with the camshafts in the primary position at the start of the intake stroke.

FIG. 72 depicts a sectional and partial view of engine assembly 3. Shown are the positions of intake cam 11 and exhaust cam 12 during intake stroke when the primary apertures 40, 60 align with intake port 10 and exhaust port 20 respectively. Intake cam 11 has rotated so that intake valve 97 is beginning to open. The air/fuel mixture flows through the intake runner 750 into the combustion chamber 90. The exhaust cam 12 has rotated so that it is starting to close the exhaust valve 98. Burnt air/fuel mixture has been expelled through the exhaust runner 755. The piston 770 (unclaimed matter) is at TDC. During this period, both valves are open, creating overlap. The engine block 376 (unclaimed matter), spark plug 375 (unclaimed matter), cylinder head assembly 5, intake section 6, center section 7, exhaust section 8, combustion chamber 90, threaded spark plug bore 87, fluid transfer tube 366, piston 770 (unclaimed matter), cylinder 775 (unclaimed matter), intake runner 750 and exhaust runner 755 are depicted. The intake runner 750 and exhaust runner 755 are also referred to individually and collectively as aspiration ports.

Figure 73:
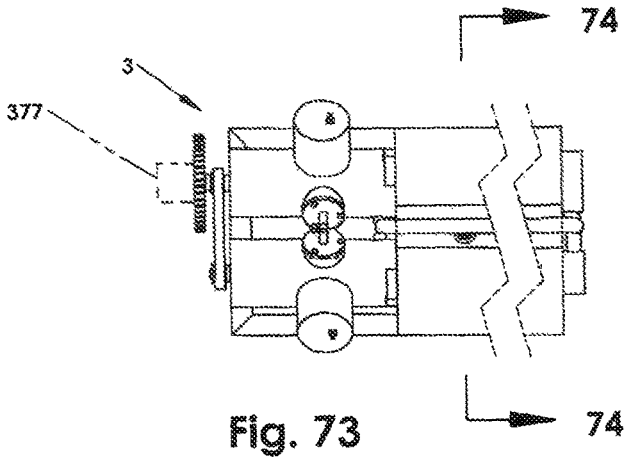
FIG. 73 shows a partial view of the engine assembly.

FIG. 73 depicts a partial view of the engine assembly 3 and cutting line 74. The electronic cam advance-retard device 377 (unclaimed matter) is identified.

Figure 74:
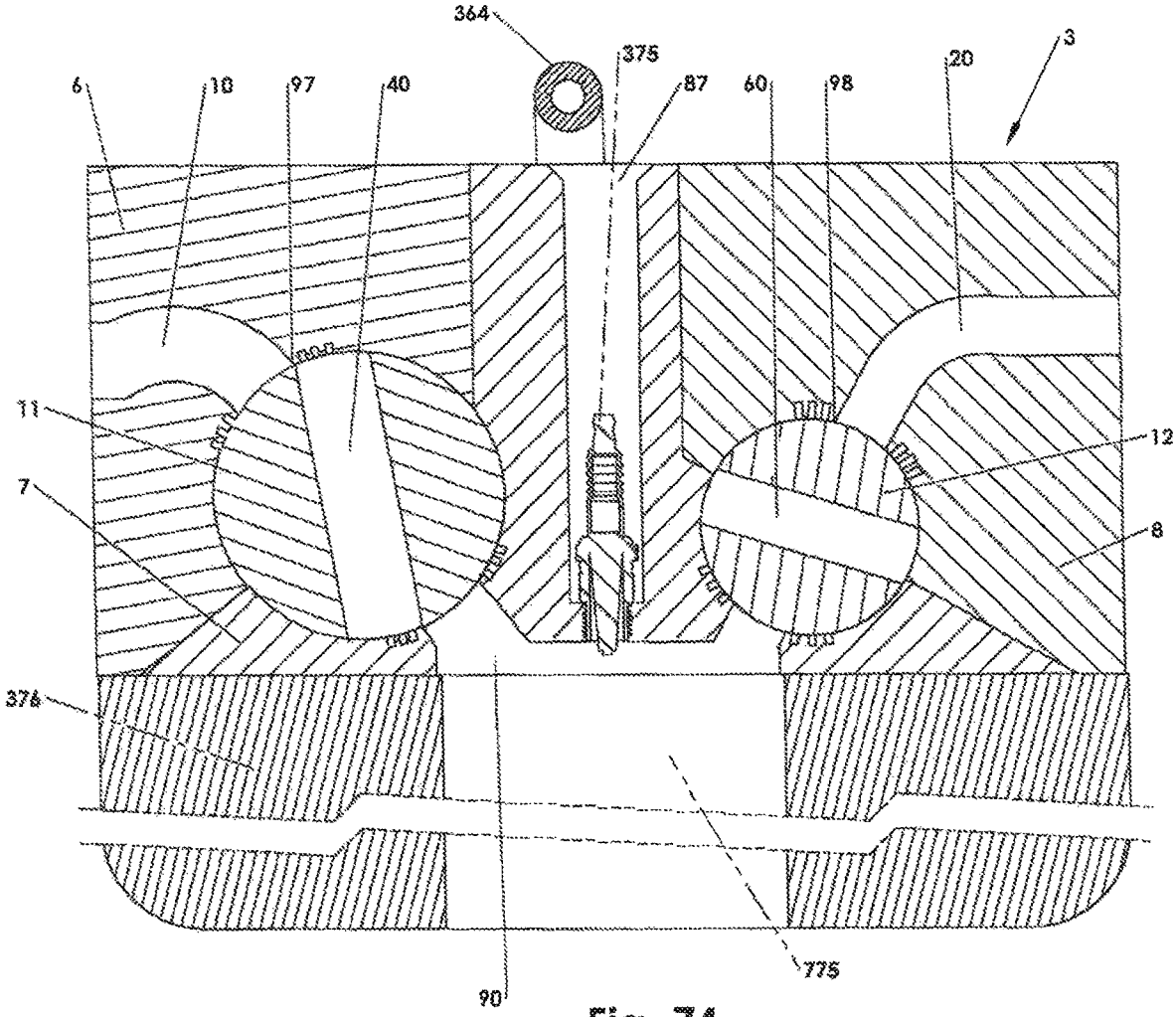
FIG. 74 shows a sectional and partial view of the engine assembly with the camshafts in the primary position at the start of the compression stroke.

FIG. 74 depicts a sectional and partial view of the engine assembly 3. Shown are the positions of intake cam 11 and exhaust cam 12 during the compression stroke when the primary apertures 40, 60 align with intake port 10 and exhaust port 20 respectively. Intake cam 11 has rotated so that intake valve 97 is closed. The exhaust cam 12 has rotated so that the exhaust valve 98 is closed. The piston 770 (unclaimed matter & not seen) is at BDC. As the piston 770 (unclaimed matter & not seen) moves upward, in the cylinder 775 (unclaimed matter), it compress the air/fuel mixture. The engine block 376 (unclaimed matter), spark plug 375 (unclaimed matter), cylinder head assembly 5, intake section 6, center section 7, exhaust section 8, combustion chamber 90, threaded spark plug bore 87, fluid transfer tube 366, cylinder wall 775 (unclaimed matter) are depicted.

Figure 75:
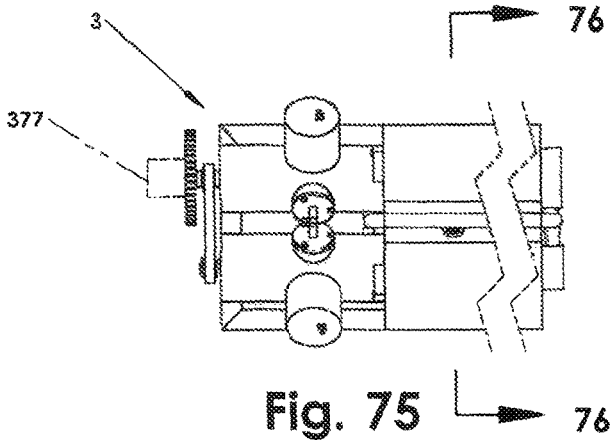
FIG. 75 shows a partial view of the engine assembly.

FIG. 75 depicts a partial view of the engine assembly 3 and cutting line 76. The electronic cam advance-retard device 377 (unclaimed matter) is identified.

Figure 76:
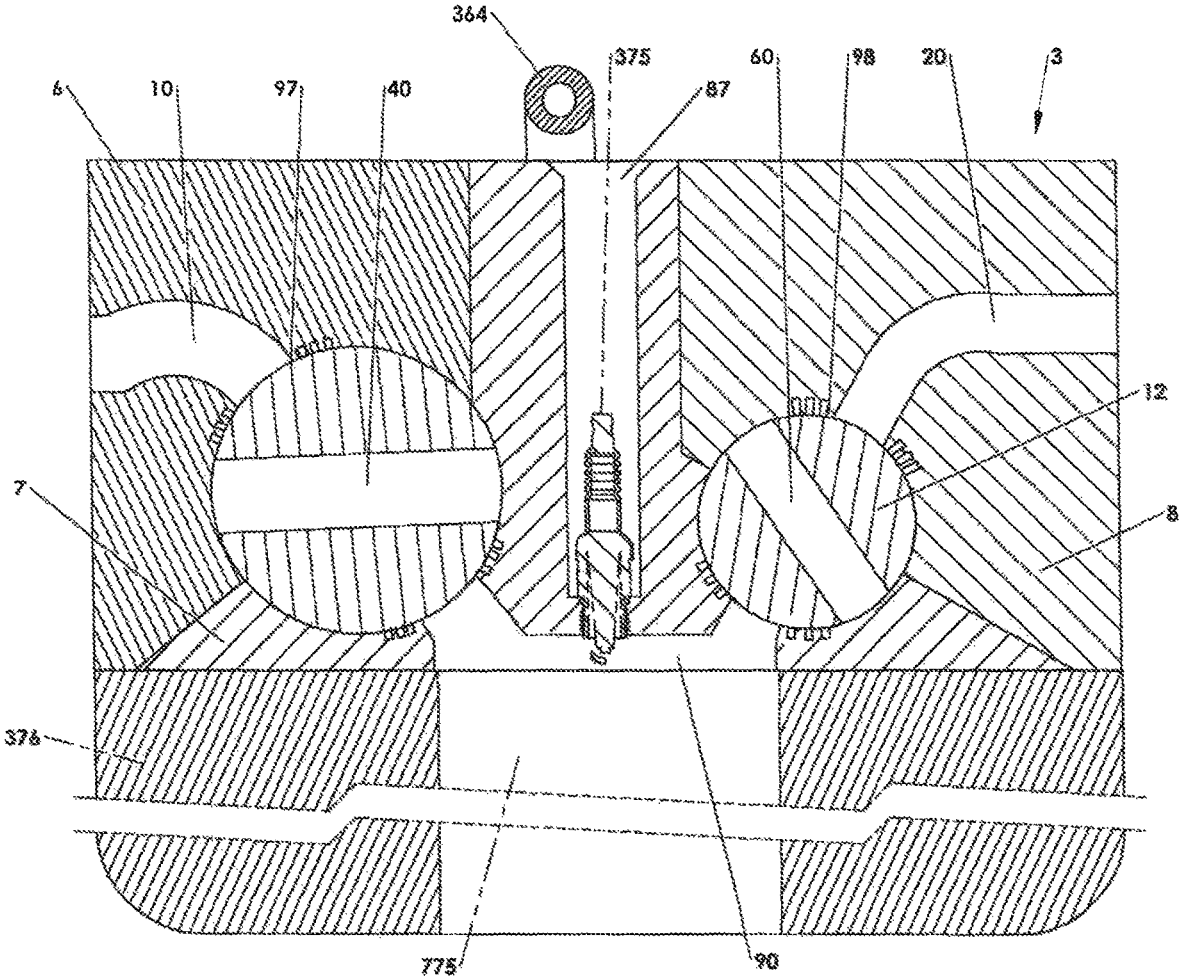
FIG. 76 shows a sectional and partial view of the engine assembly with the camshafts in the primary position at the start of the power stroke.

FIG. 76 depicts a sectional and partial view of the engine assembly 3. Shown are the positions of intake cam 11 and exhaust cam 12 during the power stroke when the primary apertures 40, 60 align with intake port 10 and exhaust port 20 respectively. Intake cam 11 has rotated so that intake valve 97 has closed. The exhaust cam 12 has rotated so that the exhaust valve 98 has closed. The spark plug 375 (unclaimed matter) has ignited the air/fuel mixture. Pressure from the burning air/fuel mixture has pushed the piston 770 (unclaimed matter & not seen), through the cylinder 775

(unclaimed matter), to BDC. The engine block 376 (unclaimed matter), spark plug 375 (unclaimed matter), cylinder head assembly 5, intake section 6, center section 7, exhaust section 8, combustion chamber 90, threaded spark plug bore 87, fluid transfer tube 366, and cylinder 775 (unclaimed matter) are depicted.

Figure 77:
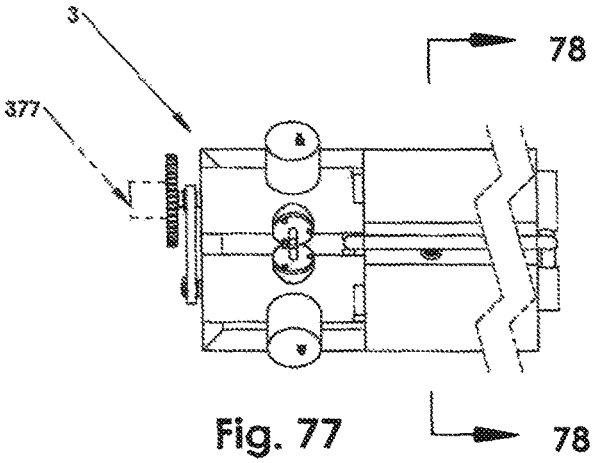
FIG. 77 shows a partial view of the engine assembly.

FIG. 77 depicts a partial view of the engine assembly 3 and cutting line 78. The electronic cam advance-retard device 377 (unclaimed matter) is identified.

Figure 78:
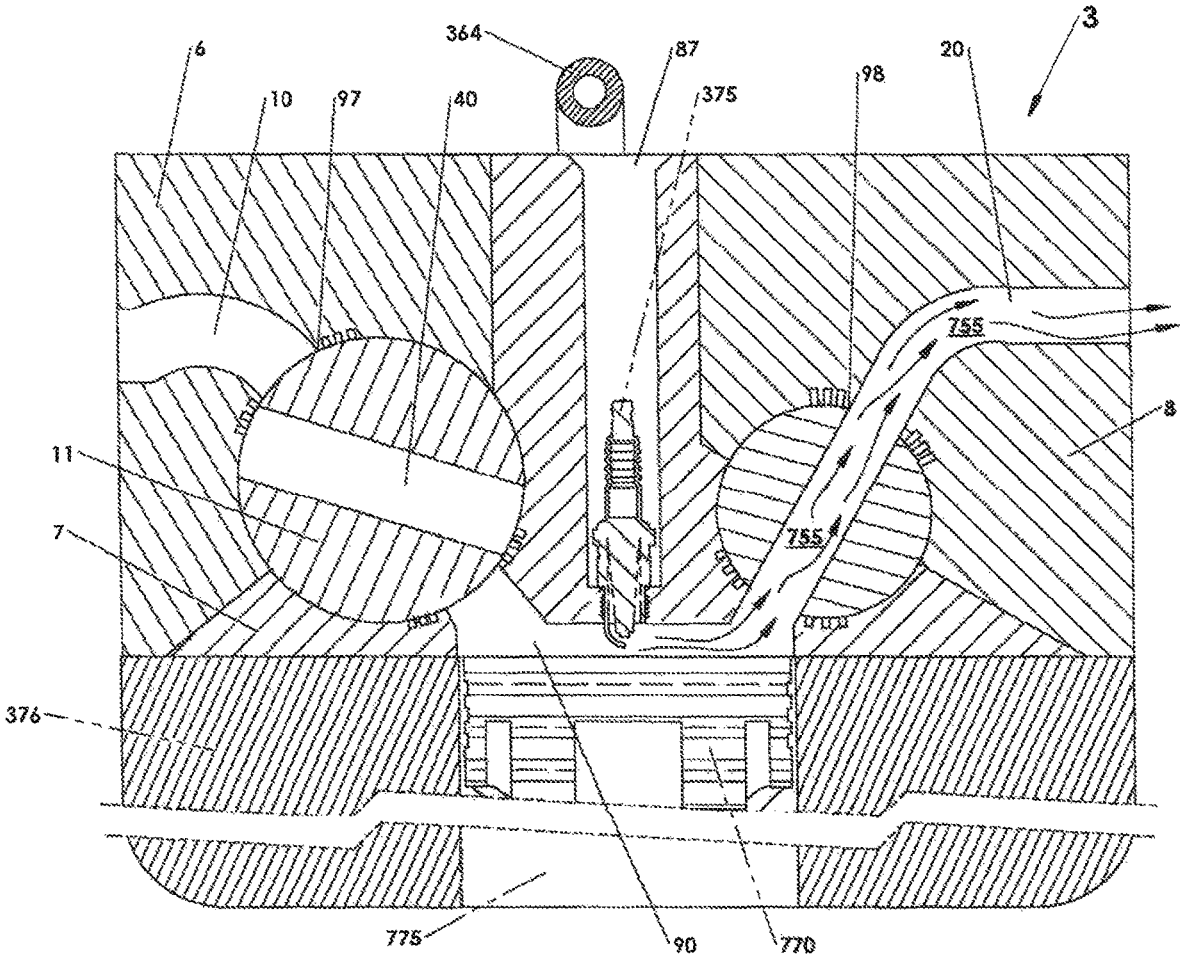
FIG. 78 shows a sectional and partial view of the engine assembly with the camshafts in the primary position in the exhaust stroke.

FIG. 78 depicts a sectional and partial view of the engine assembly 3. Shown are the positions of intake cam 11 and exhaust cam 12 during the exhaust stroke when the primary apertures 40, 60 align with intake port 10 and exhaust port 20 respectively. Intake cam 11 has rotated so that intake valve 97 has closed. The exhaust cam 12 has rotated so that the exhaust valve 98 is open. Burnt air/fuel mixture has been expelled through the exhaust runner 755. The piston 770 (unclaimed matter) is at TDC. The engine block 376 (unclaimed matter), spark plug 375 (unclaimed matter), cylinder head assembly 5, intake section 6, center section 7, exhaust section 8, combustion chamber 90, threaded spark plug bore 87, fluid transfer tube 366, piston 770 (unclaimed matter), cylinder 775 (unclaimed matter) and exhaust runner 755 are depicted.

Figure 79:
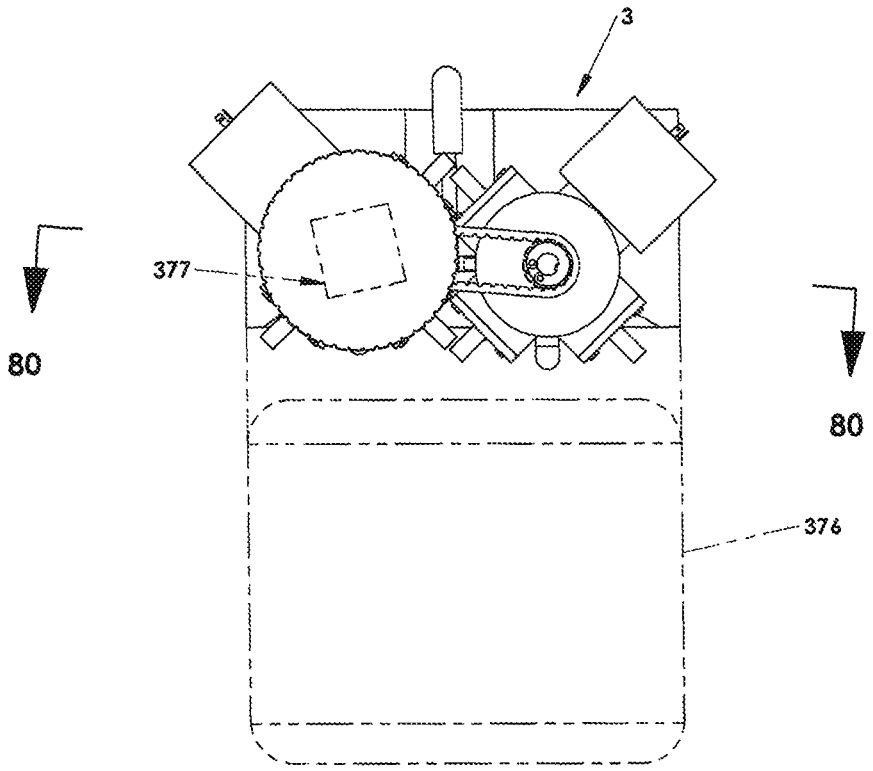
FIG. 79 shows a front view of the engine assembly.

FIG. 79 depicts a front view of the engine assembly 3, engine block 376 (unclaimed matter), electronic cam advance-retard device 377 (unclaimed matter) and cutting line 80.

Figure 80:
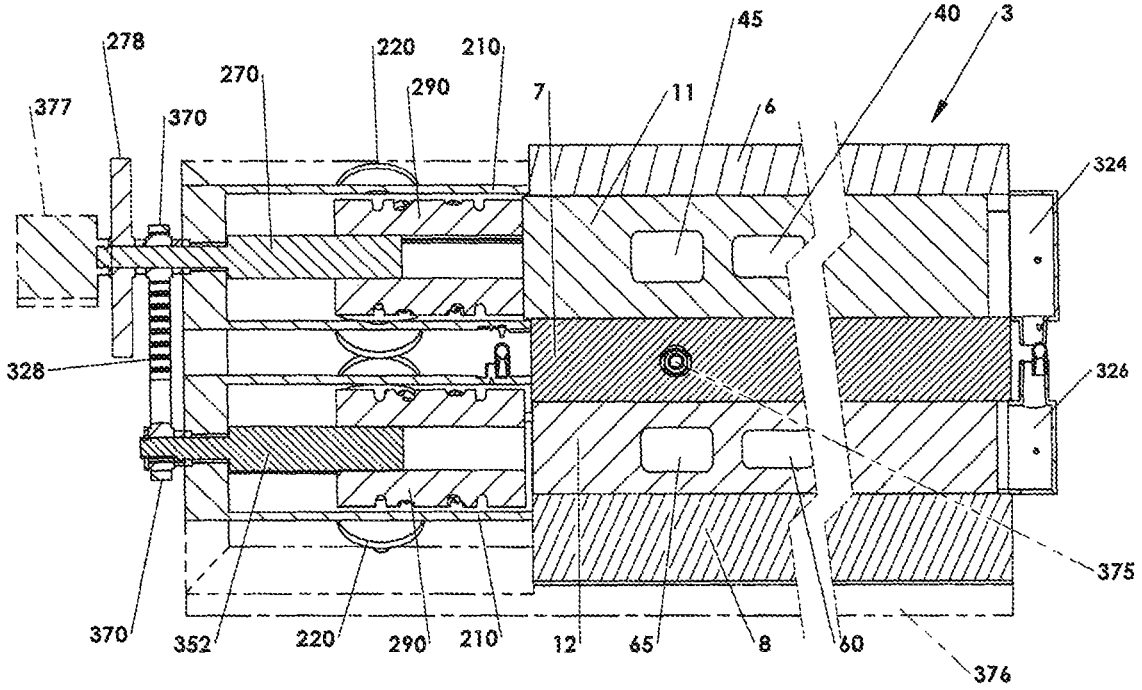
FIG. 80 depicts a sectional and partial view of the engine assembly with the cams in secondary position.

FIG. 80 depicts a sectional and partial view of the engine assembly 3. Intake cam 11 and exhaust cam 12 are in the secondary position. The secondary intake aperture 45 and secondary exhaust aperture 65 are operational. Spark plug 375 (unclaimed matter), located between intake aperture 45 and primary exhaust aperture 65, ignites the incoming air/fuel mixture. By design, the ports and apertures line up laterally to maximize fluid flow through the open valve. The primary intake aperture 40 and primary exhaust aperture 60 are in retracted position and not involved in engine operation. While in these retracted positions, oil return passageway 99 (not shown) removes extraneous oil. The rifled shafts 290 telescope over the male telescoping shaft-intake 270 and male telescoping shaft-exhaust 352 to allow intake cam 11 and exhaust cam 12 to move laterally. The crankshaft pulley 370 rotates the cam-to-crankshaft pulley 278 by the crankshaft-to-cam belt 368. The crankshaft pulley 278 rotates the cam-to-cam pulley 274 on intake side of the cylinder head assembly 5. The cam-to-cam belt 328 rotates the cam-to-cam pulley 274 on the exhaust side of the cylinder head assembly 5 in sync with the cam-to-cam pulley 274 on intake side of the cylinder head assembly 5. Slave pin assemblies 220 maintain lateral position of intake cam 11 and exhaust cam 12. The rifled shaft housing 210, rear cam cover-intake 324 and rear cam cover-exhaust 326 are depicted.

Figure 81:
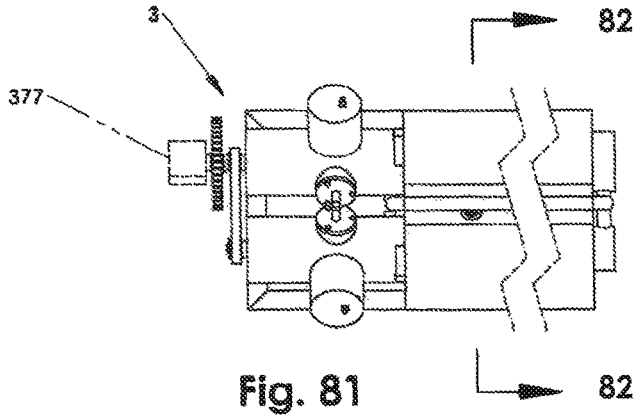
FIG. 81 shows a partial view of the engine assembly.

FIG. 81 depicts a partial view of the engine assembly 3 and cutting line 82. The electronic cam advance-retard device 377 (unclaimed matter) is identified.

Figure 82:
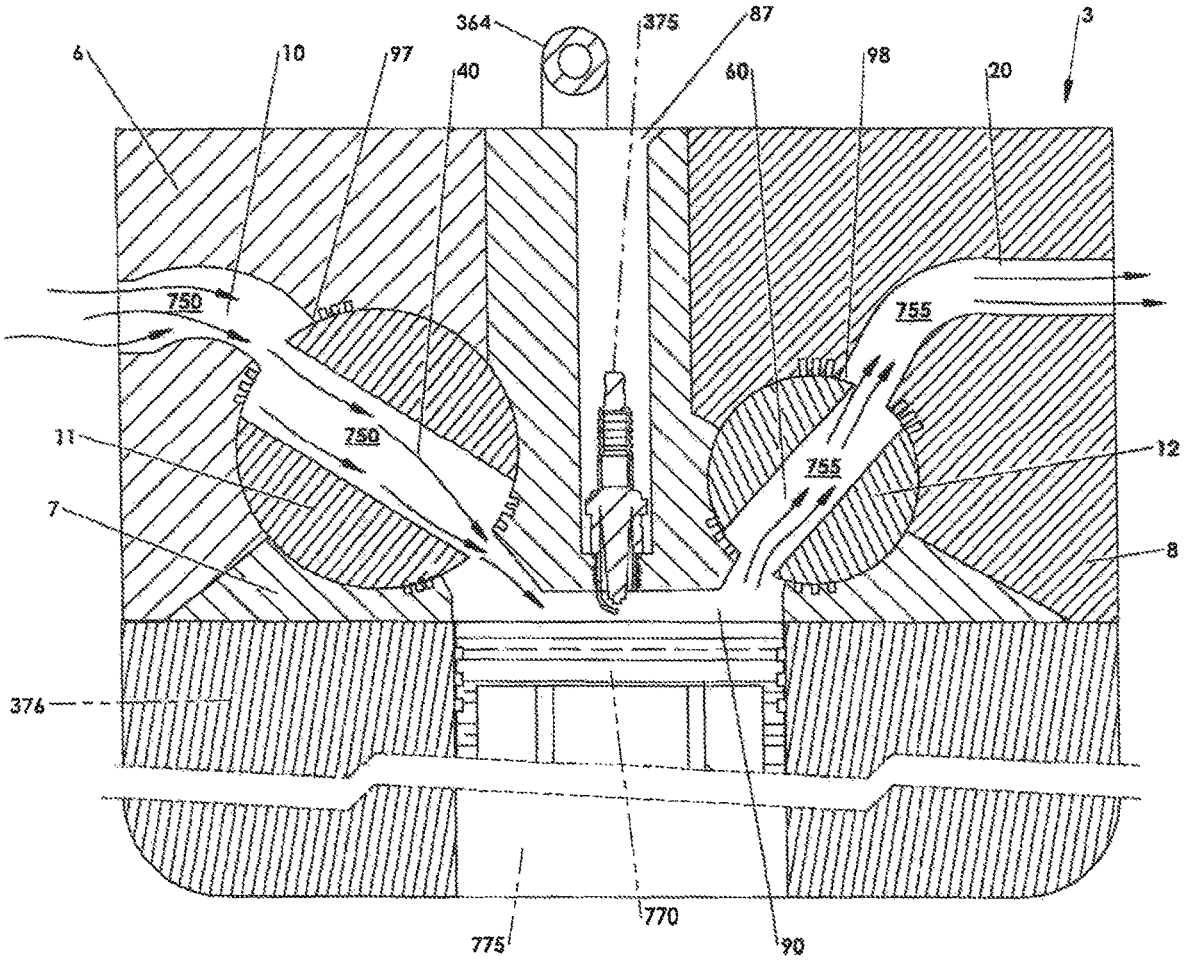
FIG. 82 shows a sectional and partial view of the engine assembly with the camshafts in the secondary position at the start of the intake stroke.

FIG. 82 depicts a sectional and partial view of the engine assembly 3. Shown are the positions of intake cam 11 and exhaust cam 12 during intake stroke when the secondary apertures 45, 65 align with intake port 10 and exhaust port 20 respectively. Intake cam 11 has rotated so that intake valve 97 is starting to open. The air/fuel mixture flows through the intake runner 750 into the combustion chamber 90. The exhaust cam 12 has rotated so that it is starting to close the exhaust valve 98. Burnt air/fuel mixture has been expelled through the exhaust runner 755. The piston 770 (unclaimed matter) is at TDC. During this period, both valves are open, creating overlap. The engine block 376 (unclaimed matter), spark plug 375 (unclaimed matter), cylinder head assembly 5, intake section 6, center section 7, exhaust section 8, combustion chamber 90, threaded spark plug bore 87, fluid transfer tube 366, rear cam cover-intake 324 and rear cam cover-exhaust 326 are depicted. piston 770 (unclaimed matter), cylinder 775 (unclaimed matter), intake runner 750 and exhaust runner 755 are depicted.

Figure 83:
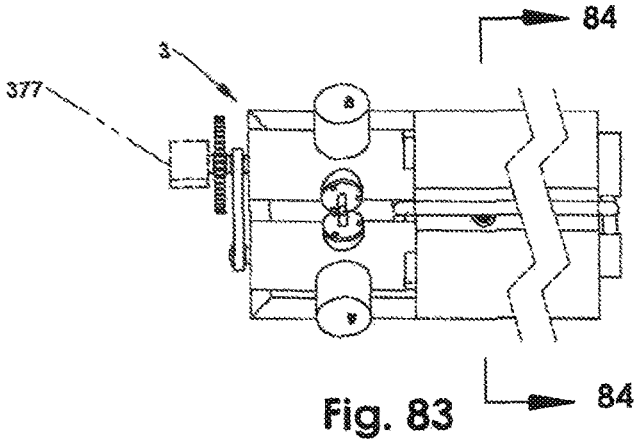
FIG. 83 shows a partial view of the engine assembly.

FIG. 83 depicts a partial view of the engine assembly 3 and cutting line 84. The electronic cam advance-retard device 377 (unclaimed matter) is identified.

Figure 84:
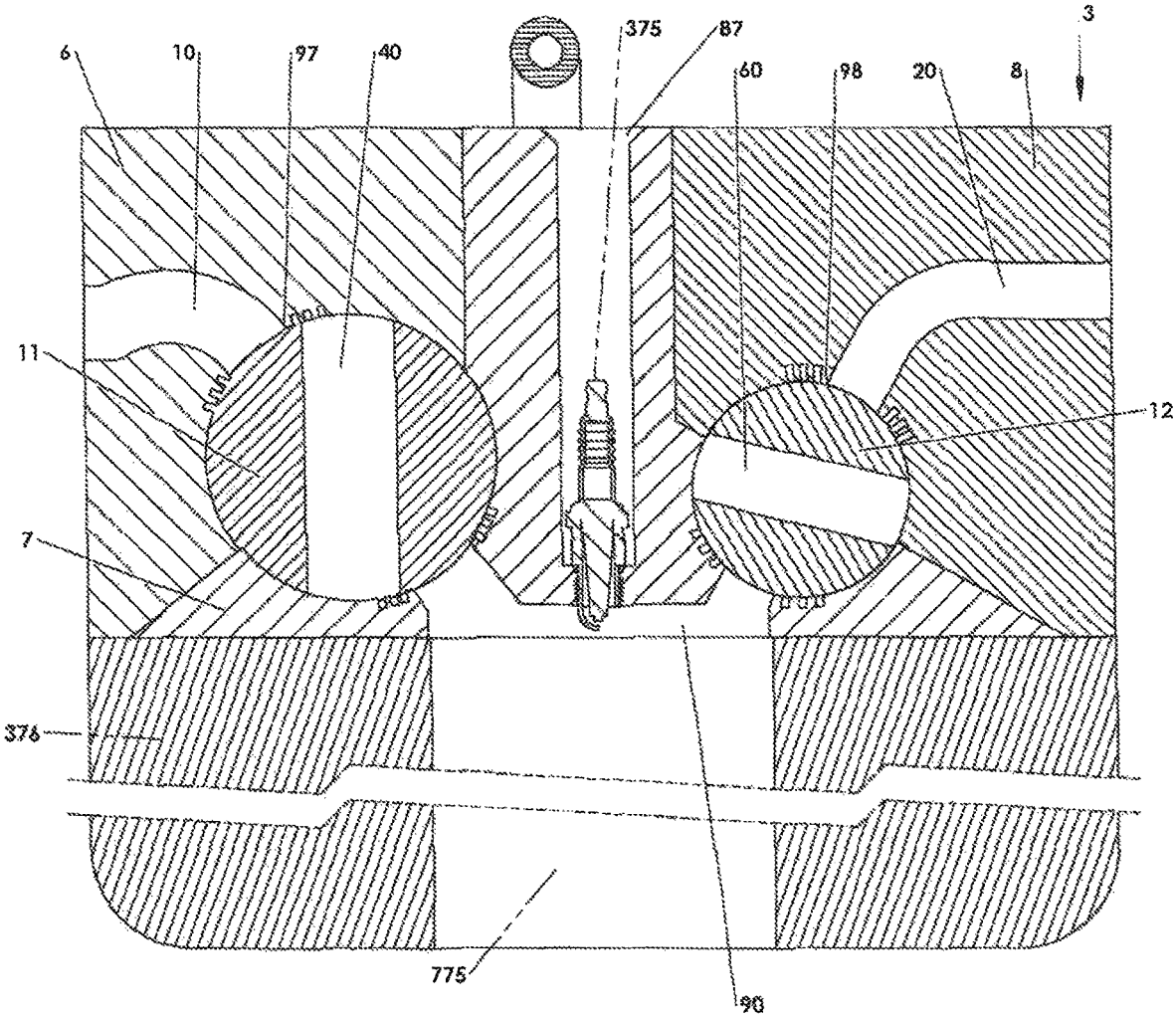
FIG. 84 shows a sectional and partial view of the engine assembly with the camshafts in the secondary position at the start of the compression stroke.

FIG. 84 depicts a sectional and partial view of the engine assembly 3. Shown are the positions of intake cam 11 and exhaust cam 12 during the compression stroke when the secondary apertures 45, 65 align with intake port 10 and exhaust port 20 respectively. Intake cam 11 has rotated so that intake valve 97 is closed. The exhaust cam 12 has rotated so that the exhaust valve 98 is closed. The piston 770 (unclaimed matter & not seen) is at BDC. As the piston 770 (unclaimed matter & not seen) moves upward, in the cylinder 775 (unclaimed matter), it compress the air/fuel mixture. The engine block 376 (unclaimed matter), spark plug 375 (unclaimed matter), cylinder head assembly 5, intake section 6, center section 7, exhaust section 8, combustion chamber 90, threaded spark plug bore 87, fluid transfer tube 366, cylinder 775 (unclaimed matter) are depicted.

Figure 85:
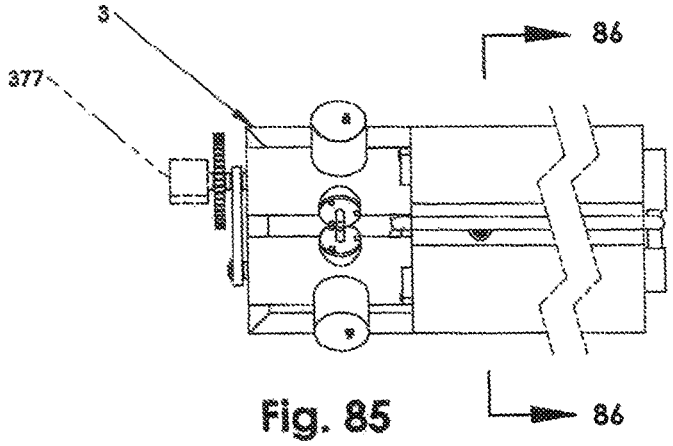
FIG. 85 shows a partial view of the engine assembly.

FIG. 85 depicts a partial view of the engine assembly 3 and cutting line 86. The electronic cam advance-retard device 377 (unclaimed matter) is identified.

Figure 86:
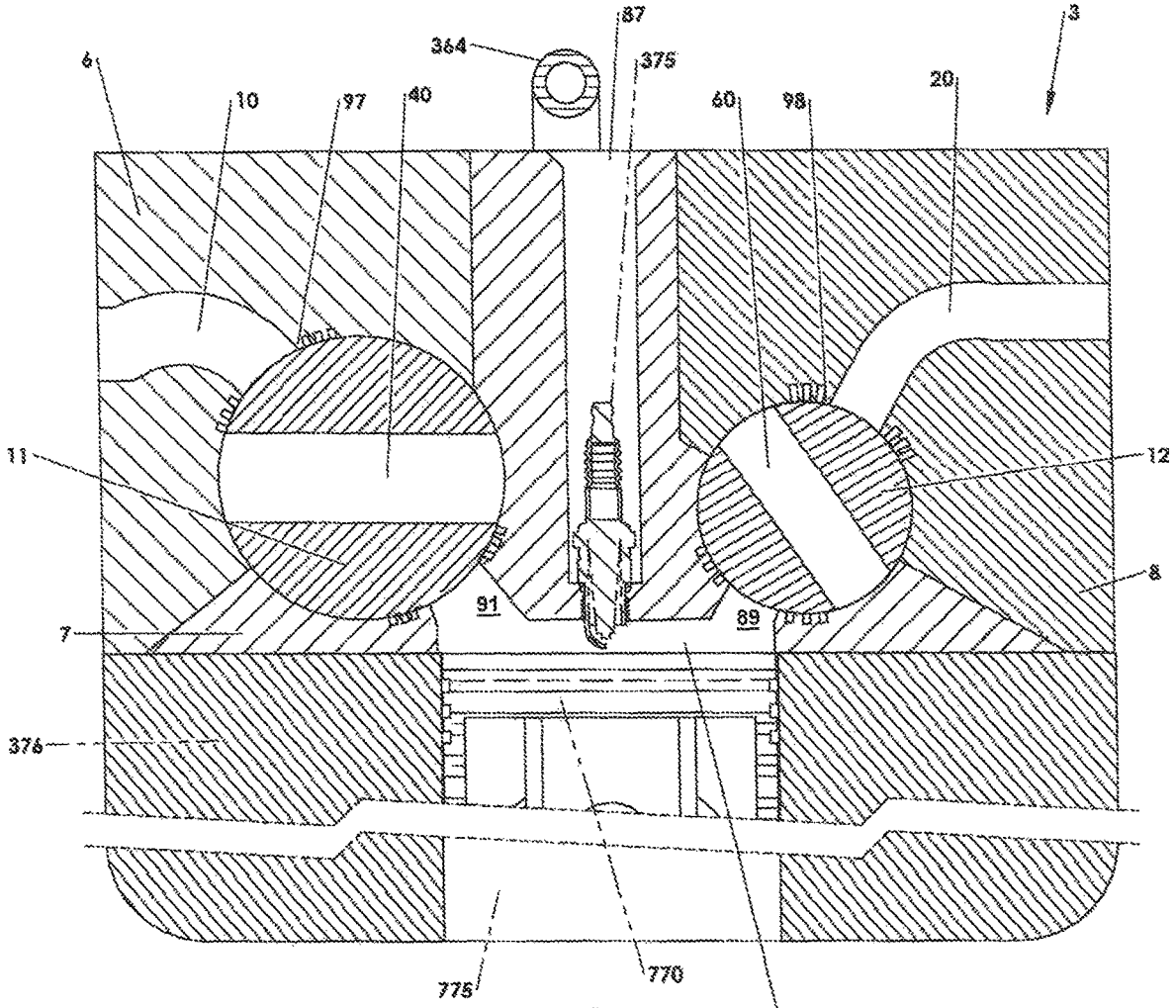
FIG. 86 shows a sectional and partial view of the engine assembly with the camshafts in the secondary position at the start of the power stroke.

FIG. 86 depicts a sectional and partial view of the engine assembly 3. Shown are the positions of intake cam 11 and exhaust cam 12 during the power stroke when the secondary apertures 45, 65 align with intake port 10 and exhaust port 20 respectively. Intake cam 11 has rotated so that intake valve 97 has closed. The spark plug 375 (unclaimed matter) has ignited the air/fuel mixture. Pressure from the burning air/fuel mixture has pushed the piston 770 (unclaimed matter & not seen), through the cylinder 775 (unclaimed matter), to BDC. The exhaust cam 12 has rotated so that the exhaust valve 98 has closed. The engine block 376 (unclaimed matter), spark plug 375 (unclaimed matter), cylinder head assembly 5, intake section 6, center section 7, exhaust section 8, combustion chamber 90, threaded spark plug bore 87, and fluid transfer tube 366, and cylinder 775 (unclaimed matter) are depicted.

Figure 87:
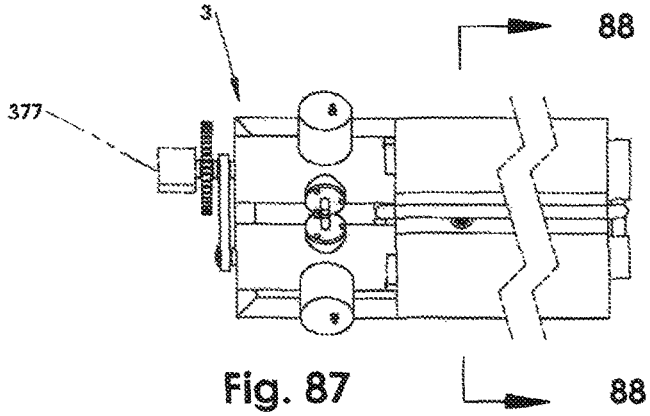
FIG. 87 shows a sectional view of the engine assembly.

FIG. 87 depicts a partial view of the engine assembly 3 and cutting line 88. The electronic cam advance-retard device 377 (unclaimed matter) is identified.

Figure 88:
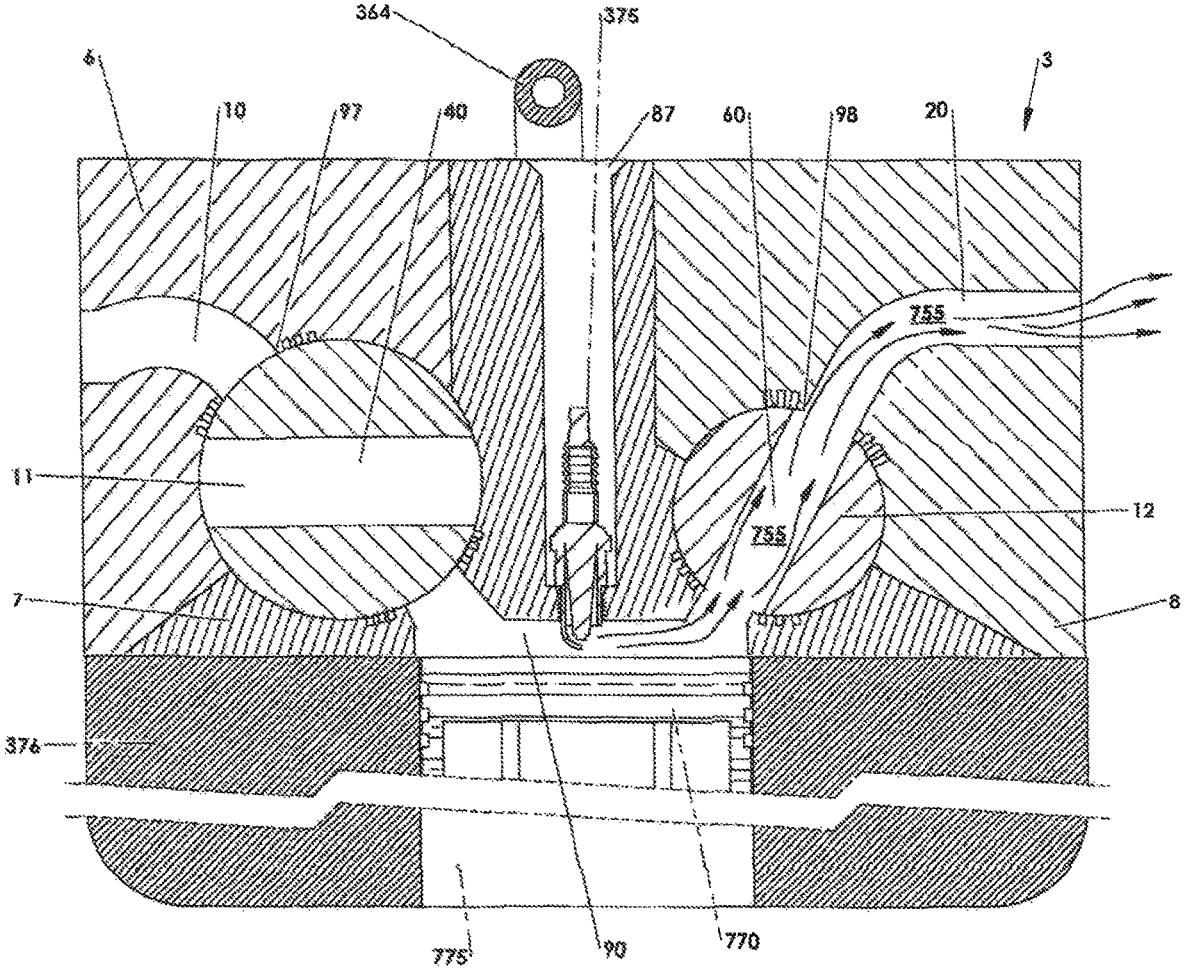
FIG. 88 shows a sectional and partial view of the engine assembly with the camshafts in the secondary position in the exhaust stroke.

FIG. 88 depicts a sectional and partial view of the engine assembly 3. Shown are the positions of intake cam 11 and exhaust cam 12 during the exhaust stroke when the primary apertures 45, 65 align with intake port 10 and exhaust port 20 respectively. Intake cam 11 has rotated so that intake valve 97 has closed. The exhaust cam 12 has rotated so that the exhaust valve 98 is open. Burnt air/fuel mixture has been expelled through the exhaust runner 755. The piston 770 (unclaimed matter) is at TDC. The engine block 376 (unclaimed matter), spark plug 375 (unclaimed matter), cylinder head assembly 5, intake section 6, center section 7, exhaust section 8, combustion chamber 90, threaded spark plug bore 87, and fluid transfer tube 366, piston 770 (unclaimed matter), cylinder 775 (unclaimed matter) and exhaust runner 755 are depicted.

Figure 89:
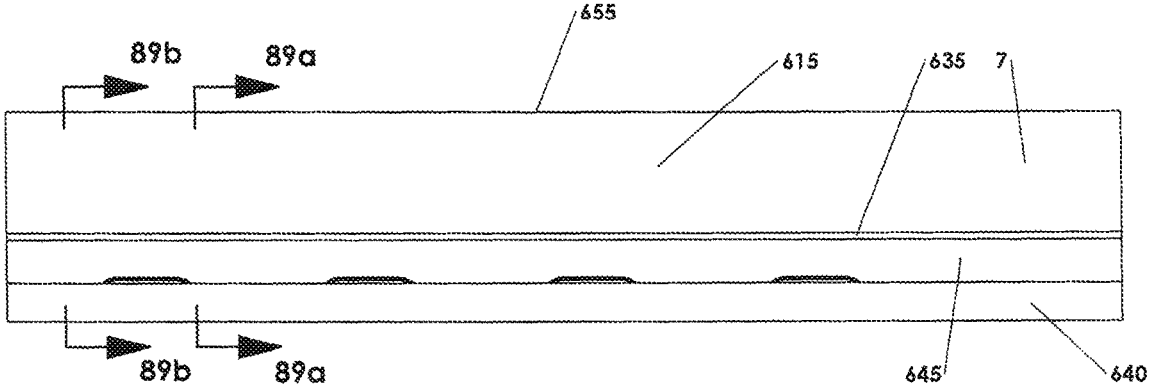
FIG. 89 shows the lubricating oil inlets and oil returns in two sectional views of the partial center section.

FIG. 89 depicts a side view of the center section 7 and cutting lines 90 and 91. Faces of center section 7 are identified as follows: center exhaust side face 615, center upper sealing face-exhaust 635, center lower sealing face-exhaust 640, center exhaust cam apse 645, center top face 655.

Figure 90:
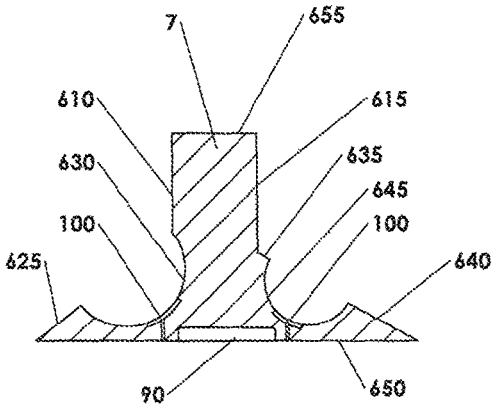
FIG. 90 shows the lubricating oil inlets.

FIG. 90 depicts lubricating oil inlets 100 and combustion chamber 90 in sectional view of the center section 7. Faces of center section 7 are identified as follows: center intake side face 610, center exhaust side face 615, center lower sealing face-intake 625, center intake cam apse 630, center upper sealing face-exhaust 635, center lower sealing face-exhaust 640, center exhaust cam apse 645, center bottom face 650, center top face 655.

Figure 91:
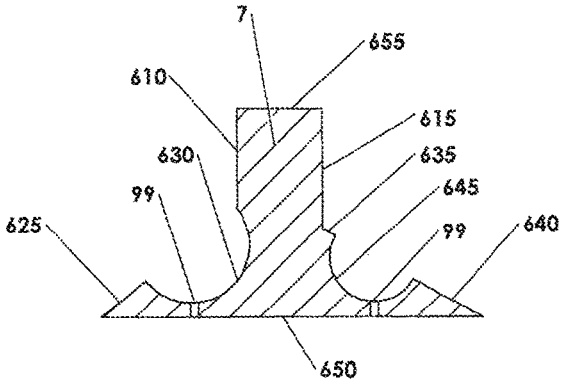
FIG. 91 shows the lubricating oil returns.

FIG. 91 depicts oil return passageways 99 in a sectional view of the center section 7. Faces of center section 7 are identified as follows: center intake side face 610, center exhaust side face 615, center lower sealing face-intake 625, center intake cam apse 630, center upper sealing face-exhaust 635, center lower sealing face-exhaust 640, center exhaust cam apse 645, center bottom face 650, center top face 655.

Figure 92:
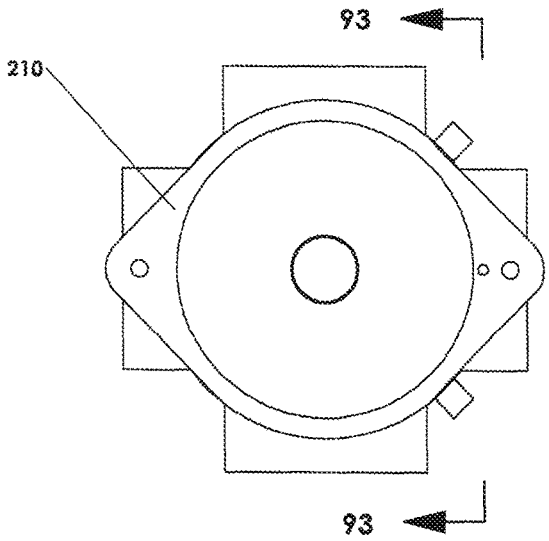
FIG. 92 shows a back view of the rifled shaft housing.

FIG. 92 discloses a back view of the rifled shaft housing 210 and cutting line 93.

Figure 93:
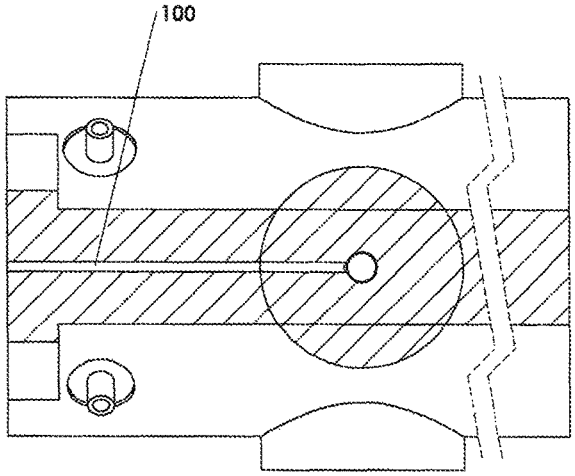
FIG. 93 shows a sectional and partial view of the rifled shaft housing.

FIG. 93 depicts a sectional view of the rifled shaft housing 210 and a lubricating oil inlet 100.

Figure 94:
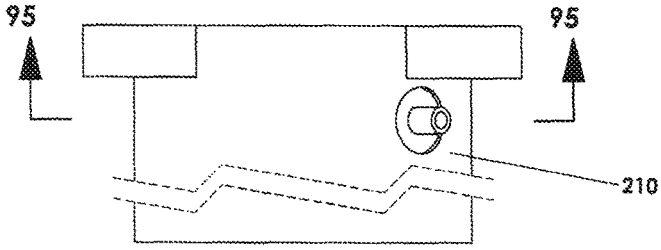
FIG. 94 shows a partial side view of the rifled shaft housing.

FIG. 94 depicts a partial view of the rifled shaft housing 210 and cutting line 95.

Figure 95:
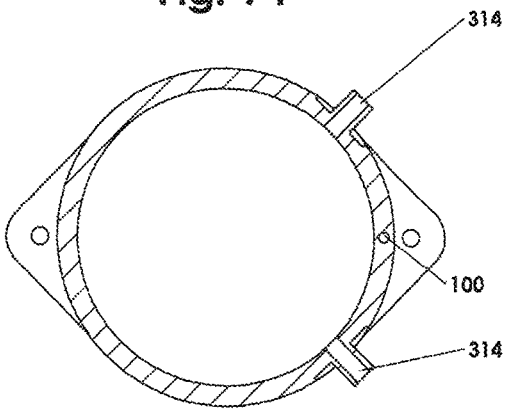
FIG. 95 shows a sectional view of the rifled shaft housing.

FIG. 95 depicts a sectional view of the rifled shaft housing 210, lubricating oil inlet 100, and oil return/vent port 314.

Figure 96:
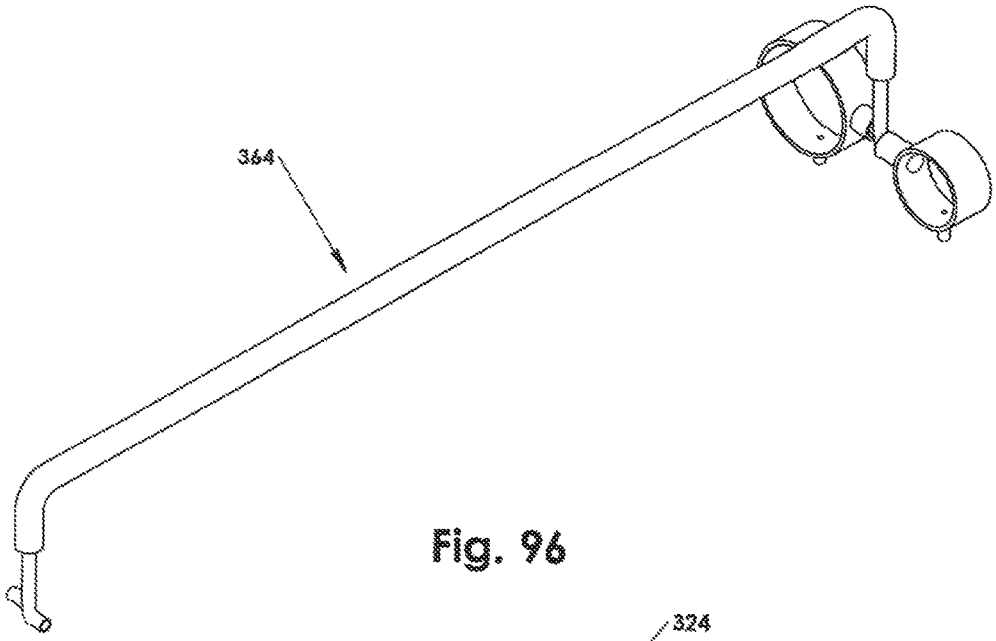
FIG. 96 shows the fluid containment system.

FIG. 96 discloses an embodiment of the fluid containment system 364 and is part of the emissions control system.

Figure 97:
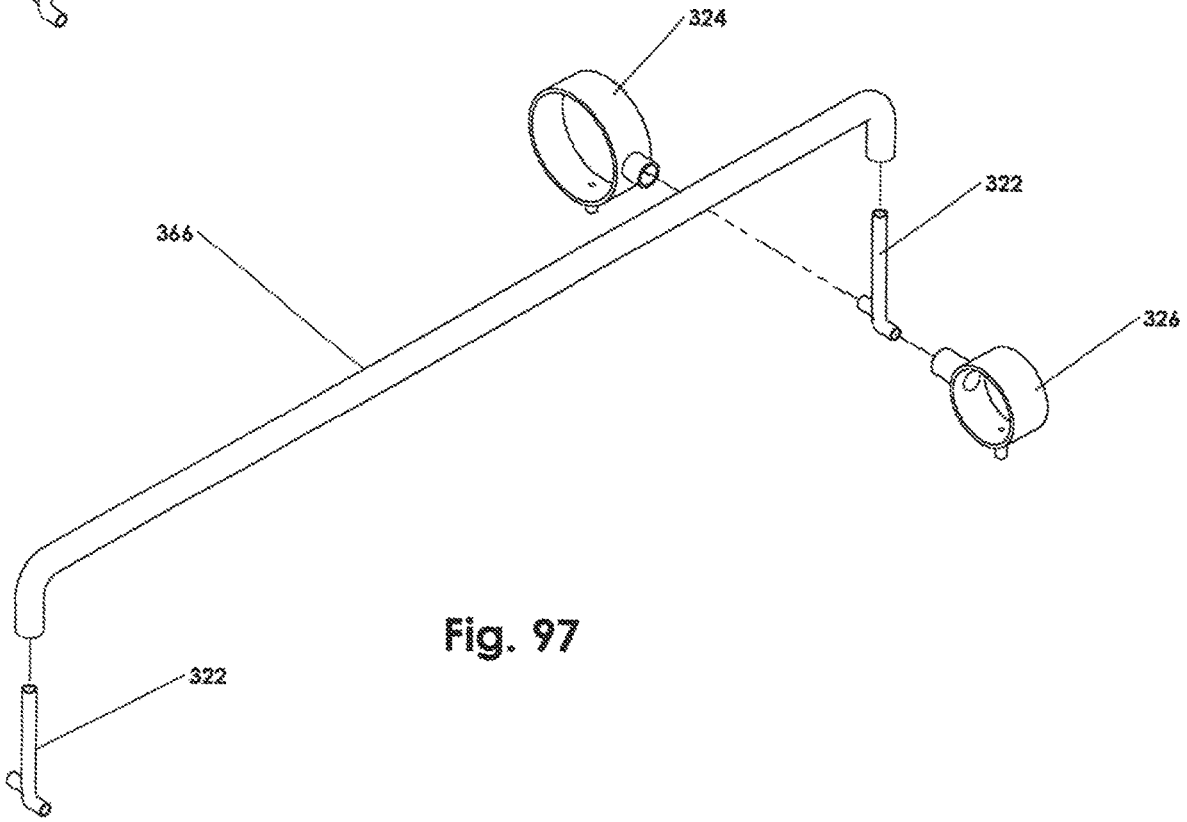
FIG. 97 shows an exploded view of the fluid containment system.

FIG. 97 depicts an exploded view of the fluid containment system 364: housing-to-housing vent tube (2) 322, rear cam cover-intake 324, rear cam cover-exhaust 326, and fluid transfer tube 366. When intake camshaft 11 (not shown) and the exhaust cam 12 (not shown) shifts from the primary position to the secondary position and visa-versa, materials at one end of the camshafts are displaced/replaced and is replaced/displaced to the opposite end of the camshafts through the fluid containment system 364, preventing fluid loss to the atmosphere.

Figure 98:
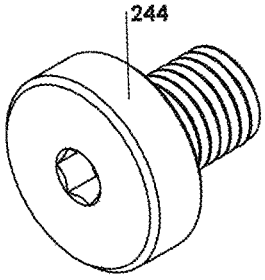
FIG. 98 shows the solenoid retainer bolt.

FIG. 98 depicts the solenoid retainer bolt 244. There are two solenoid retainer bolts 244 in the cylinder head assembly 5 and one in each master-pin assembly 230. The double-acting solenoid shell 238 is secured to the solenoid holder 240 by the solenoid retainer bolt 244.

Figure 99:
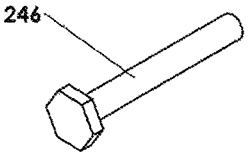
FIG. 99 shows the master-pin assembly retainer bolt.

FIG. 99 depicts the master-pin assembly retainer bolt 246. There are six master-pin assembly retainer bolts 246 in the cylinder head assembly 5 and three master-pin assembly retainer bolts 246 in each master-pin assembly 230. The master-pin assembly 230 is secured to the rifled shaft housings 210 by three master-pin assembly retainer bolts 246.

Figure 100:
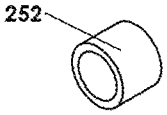
FIG. 100 shows the rifled shaft housing bushing.

FIG. 100 depicts the rifled shaft housing bushing 252. There are two rifled shaft housing bushings 252 in the cylinder head assembly 5. These bushings hold the male telescoping shaft-intake 270 and the male telescoping shaft-exhaust 352 in alignment and allows them to rotate. These bushings are oil impregnated to reduce friction.

Figure 101:
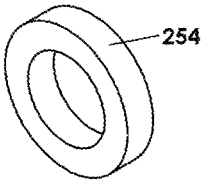
FIG. 101 shows the rifled shaft housing oil seal.

FIG. 101 depicts the rifled shaft housing oil seal 254. There are two rifled shaft housing oil seals 254 in the cylinder head assembly 5. This oil seal prevents leakage of oil and fluids from the engine assembly 3.

Figure 102:
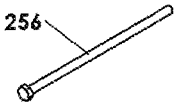
FIG. 102 shows the rifled shaft to camshaft retaining bolt.

FIG. 102 depicts the rifled shaft to camshaft retaining bolt 256. There are four retaining bolts 256 on the cylinder head assembly 5. The rifled shaft 290 is secured to intake cam 11 by two (2) rifled shaft to camshaft retaining bolts 256. The rifled shaft 290 is secured to the exhaust cam 12 by two (2) rifled shaft to camshaft retaining bolts 256.

Figure 103:
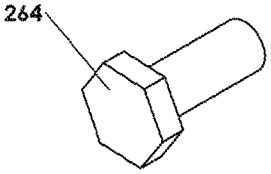
FIG. 103 shows the slave-pin assembly retainer bolt.

FIG. 103 depicts the slave-pin assembly retainer bolt 264. There are eighteen slave-pin assembly retainer bolts 264 on the cylinder head assembly 5. The slave-pin assemblies (6) 220 are secured to the rifled shaft housings (2) 210 by three (3) slave-pin assembly retainer bolts 264.

Figure 104:
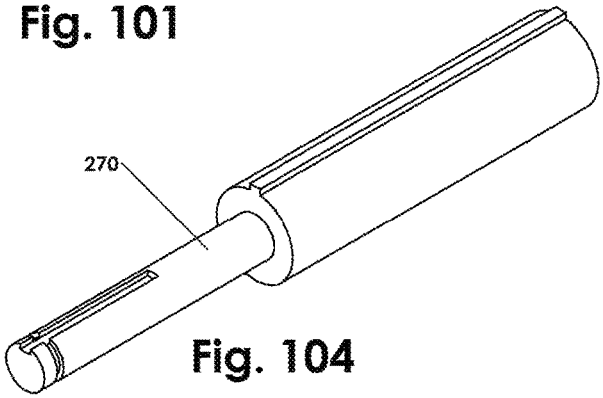
FIG. 104 shows the male telescoping shaft-intake.

FIG. 104 depicts the male telescoping shaft-intake 270. This shaft telescopes into the rifled shaft 290 allowing intake cam to shift from the primary position to the secondary position and vice versa. The indexing spline-male telescoping shaft 283 aligns the male telescoping shaft-intake 270 to the indexing fossa 284 in the rifled shaft 290 to synchronize them.

Figure 105:
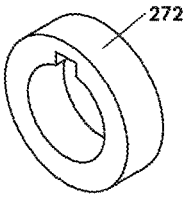
FIG. 105 shows the slotted shaft spacer.

FIG. 105 depicts the slotted shaft spacer 272. There are four slotted shaft spacers 272 on the cylinder head 5. Two (2) are mounted on the male telescoping shaft-intake 270 and two (2) are mounted on the male telescoping shaft-exhaust 352 to space components on the male telescoping shaft-intake 270 and the male telescoping shaft-exhaust 352.

Figure 106:
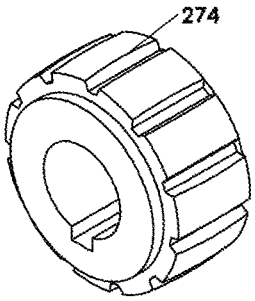
FIG. 106 shows the cam-to-cam pulley.

FIG. 106 depicts the cam-to-cam pulley 274. There are two cam-to-cam pulleys 274 are on cylinder head 5. One on the male telescoping shaft-intake 270 and one on the male telescoping shaft-exhaust 352. The cam-to-cam drive belt 328 is installed over the two cam-to-cam pulleys 274 rotate intake cam 11 and exhaust cam 12. This combination of parts functions to synchronize the camshafts.

Figure 107:
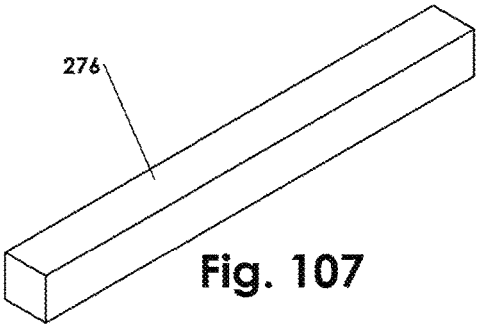
FIG. 107 shows intake square key.

FIG. 107 depicts intake square key 276. Intake square key 276 is inserted in square key slot 282 on the male telescoping shaft-intake 270. This arrangement assures that the following parts are indexed and rotate in unison: slotted shaft spacer 272, cam-to-cam pulley 274, and cam-to-crankshaft pulley 278.

Figure 108:
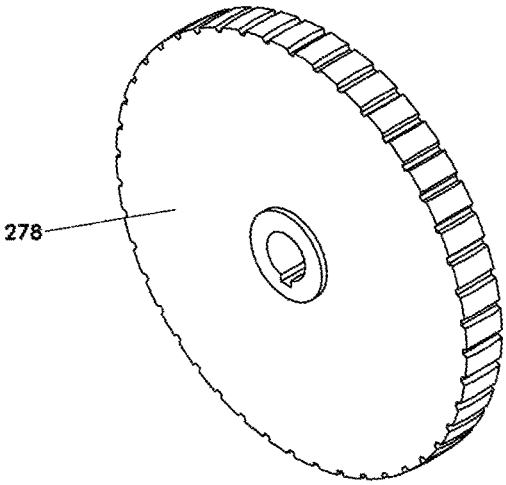
FIG. 108 shows the cam-to-crankshaft pulley.

FIG. 108 depicts the cam-to-crankshaft pulley 278. The cam-to-crankshaft pulley 278 is installed on the male telescoping shaft-intake 270 and rotates the male telescoping shaft-intake 270.

Figure 109:
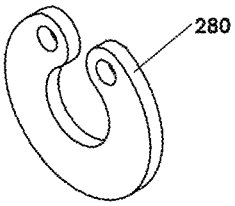
FIG. 109 shows the snap ring.

FIG. 109 depicts the snap ring 280. There are two snap rings 280 installed on the engine assembly 3. One (1) snap ring 280 is installed on the male telescoping shaft-intake 270 and secures the following parts: slotted shaft spacer 272, cam-to-cam pulley 274, and cam-to-crankshaft pulley 278. One (1) snap ring 280 is installed on the male telescoping shaft-exhaust 352 and secures the following parts: slotted shaft spacer 272 and cam-to-cam pulley 274.

Figure 110:
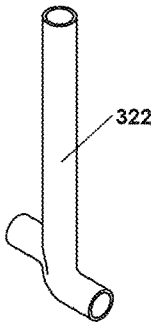
FIG. 110 shows the housing-to-housing vent tube.

FIG. 110 depicts the housing-to-housing vent tube 322. This device is part of the fluid containment system 364. There are two housing-to-housing vent tubes 322 in this system. One is attached to the oil return/vent port 314 of intake cam drive and shift assembly 190, the oil return/vent port 314 of the exhaust cam drive and shift assembly 350, and fluid transfer tube 366. The other is attached to the fluid transfer tube 366, the rear cam cover-intake 324, and the rear cam cover-exhaust 326.

Figure 111:
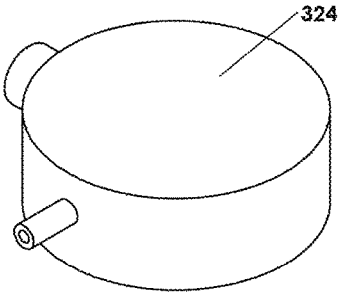
FIG. 111 shows the rear cam cover-intake.

FIG. 111 depicts the rear cam cover-intake 324. This device is part of the fluid containment system 364. It is attached to the fluid transfer tube 366 and the back of the cylinder head assembly 5. Fluid displaced/replaced, by the shifting of intake cam 11 and the exhaust cam 12 from primary position to secondary position and vice versa, passes through it to the fluid transfer tube 366 or the back of the cylinder head assembly 5.

Figure 112:
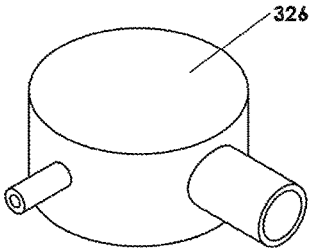
FIG. 112 shows the rear cam cover-exhaust.

FIG. 112 depicts the rear cam cover-exhaust 326. This device is part of the fluid containment system 364. It is attached to the fluid transfer tube 366 and the back of the cylinder head assembly 5. Fluid displaced/replaced, by the shifting of intake cam 11 and the exhaust cam 12 from primary position to secondary position and vice versa, passes through it to the fluid transfer tube 366 or the back of the cylinder head assembly 5.

Figure 113:
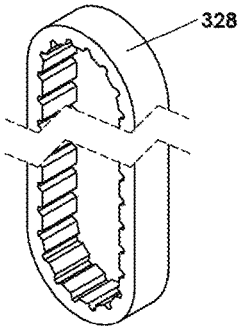
FIG. 113 shows the cam-to-cam drive belt.

FIG. 113 depicts the cam-to-cam drive belt 328. The cam-to-cam drive belt 328 is installed over the two cam-to-cam pullies 274 that rotate intake cam 11 and exhaust cam 12.

Figure 114:
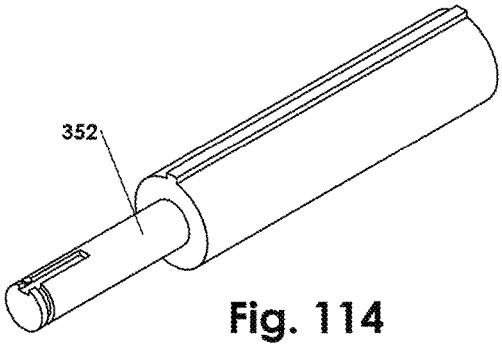
FIG. 114 shows the male telescoping shaft-exhaust.

FIG. 114 depicts the male telescoping shaft-exhaust 352. This shaft telescopes into the rifled shaft 290 allowing the exhaust cam to shift from the primary position to the secondary position and vice versa. The indexing spline-male telescoping shaft 283 aligns the male telescoping shaft-exhaust 352 to the indexing fossa 284 in the rifled shaft 290 to synchronize them.

Figure 115:
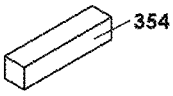
FIG. 115 shows the exhaust square key.

FIG. 115 depicts the exhaust square key 354. The exhaust square key 354 is inserted in square key slot 282 on the male telescoping shaft-exhaust 352. This arrangement assures that the following parts are indexed and rotate in unison: slotted shaft spacer 272 and cam-to-cam pulley 274.

Figure 116:
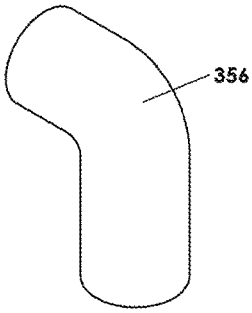
FIG. 116 shows the oil return tube.

FIG. 116 depicts the oil return tube 356. There are two oil return tubes 356 installed on the engine assembly 3. One is attached to the oil return/vent port 314 of intake cam drive and shift assembly 190 and the oil return port in the engine block. The second is attached to the oil return/vent port 314 of the exhaust cam drive and shift assembly 350 and the oil return port in the engine block.

Figure 117:
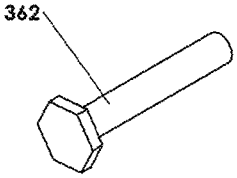
FIG. 117 shows the shift assembly to head bolt.

FIG. 117 depicts a shift assembly to the head bolt 362. There are four shift assembly to head bolts 362 installed on the engine assembly 3. Two bolts attach intake cam drive and shift assembly 190 to the cylinder head assembly 5. Two bolts attach the exhaust cam drive and shift assembly 350 to the cylinder head assembly 5.

Figure 118:
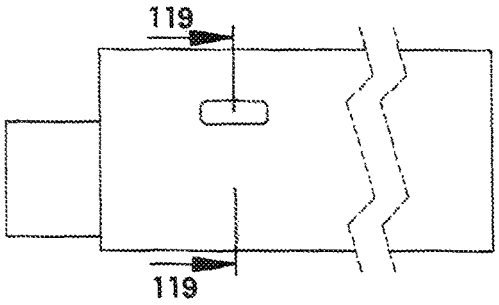
FIG. 118 shows a side view of the cylinder head assembly.

FIG. 118 provides a side view of cylinder head assembly 5. A cutting line for FIG. 119 is identified.

Figure 119:
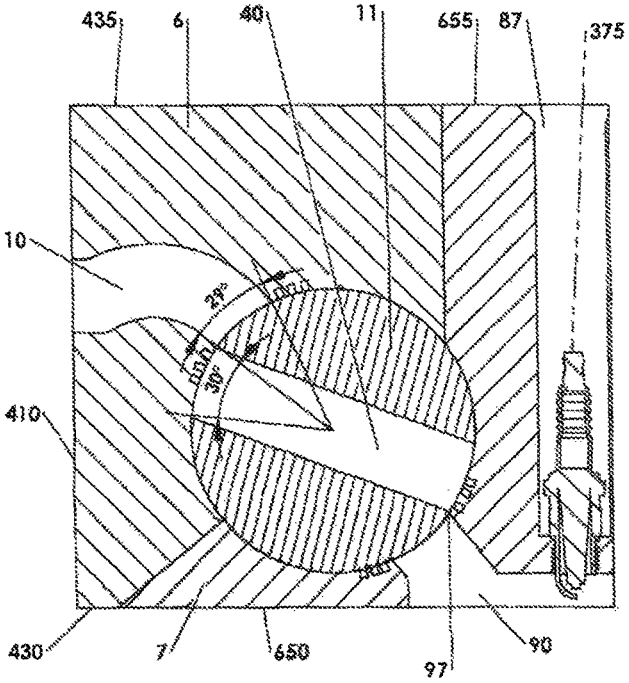

FIG. 119 depicts an embodiment of cylinder head assembly 5, in a cropped sectional view, illustrating the relationship between intake port 10, intake cam 11, center section 7 and spark plug 375 and to illustrate how duration is measured. Note: Duration is measured in degrees of crankshaft rotation. This view is a "bare part," (i.e., intake section 6, center section 7, intake cam 11, and spark plug 375 only). The intake cam 11 has rotated to open the intake valve 97. Cam duration is measured by the interaction of the intake cam 11 and the intake port 10. The intake cam 11 is measured in degrees of rotation when the primary intake aperture 40 is open (pass fluid) to the intake port 10. The intake port 10 is measured in degrees of rotation when the primary intake aperture 40 is open (pass fluid). In this illustration, the intake cam 11 rotates 30°. The intake port 10 is open for 29°. The cams in this device rotate are quarter-speed cams. (i.e. the cams rotate 90° when the crankshaft (not shown) rotates 360°.) To calculate the crankshaft duration of this device the following formula is used: ([intake cam 11 duration 30°+intake port 10 duration 29°]*360/90). The resulting crankshaft duration is 236° as calculated as follows: ([30°+29°]*4)=236°. Faces of intake section 6 and center section 7 are identified as follows: intake outside face 410, intake bottom face 430, intake top face 435, center bottom face 650, and center top face 655.

Figure 120:
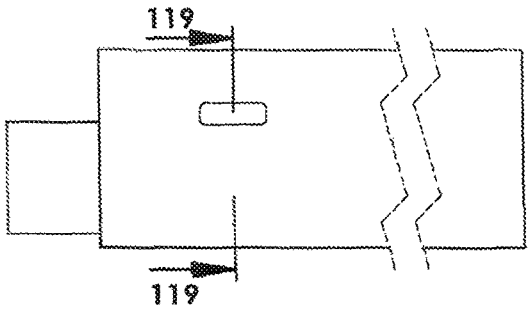

FIG. 120 provides a side view of cylinder head assembly 5. A cutting line for FIG. 121 is identified.

Figure 121:
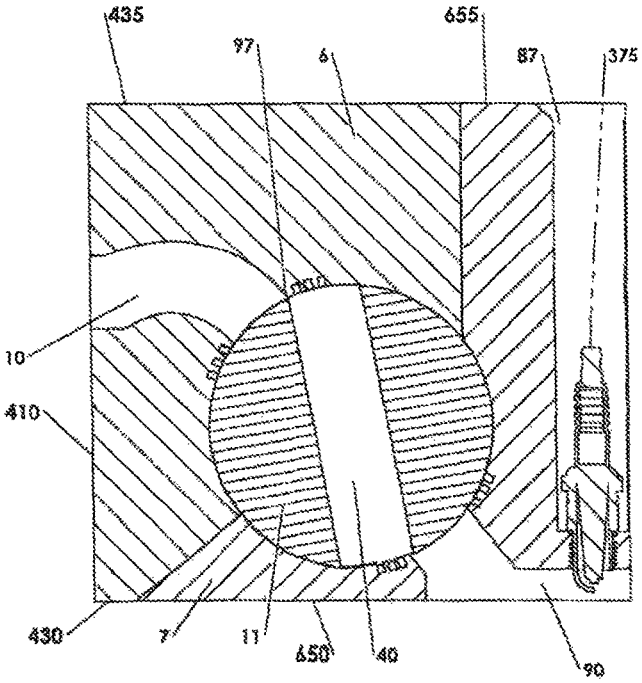

FIG. 121 depicts an embodiment of cylinder head assembly 5, in a cropped sectional view, illustrating the relationship between intake port 10, intake cam 11, center section 7 and spark plug 375 and to illustrate how duration is measured in degrees of crankshaft rotation. This view is bare part, i.e., intake section 6, center section 7, intake cam 11, and spark plug 375 only. The intake cam 11 rotated to close the intake valve 97. Measurement of duration has ceased. Faces of intake section 6 and center section 7 are identified as follows: intake outside face 410, intake bottom face 430, intake top face 435, center bottom face 650, and center top face 655.

Figure 122:
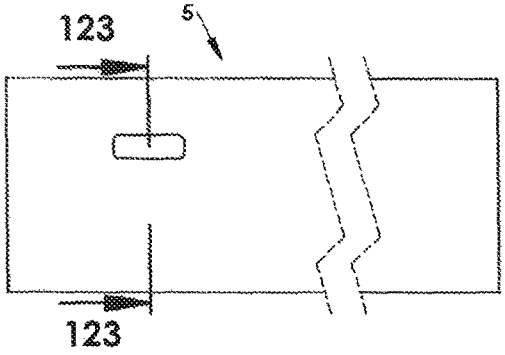

FIG. 122 provides a side view of cylinder head assembly 5. A cutting line for FIG. 123 is identified.

Figure 123:
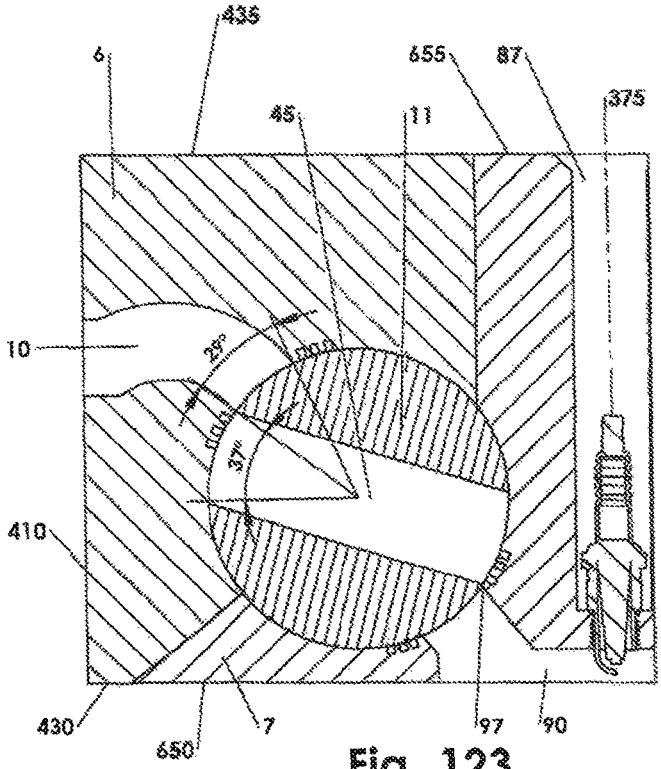

FIG. 123 depicts an embodiment of cylinder head assembly 5, in a cropped sectional view, illustrating the relationship between intake port 10, intake cam 11, center section 7 and spark plug 375 and to illustrate how duration is measured. Note: Duration is measured in degrees of crankshaft rotation. This view is bare part, i.e., intake section 6, center section 7, intake cam 11, and spark plug 375 only. The intake cam 11 has rotated to open the intake valve 97. The secondary intake aperture 45 in the intake cam 11 is active. Cam duration is measured by the interaction of the intake cam 11 and the intake port 10. The intake cam 11 is measured in degrees of rotation when the secondary intake aperture 45 is open (pass fluid) to the intake port 10. The intake port 10 is measured in degrees of rotation when the secondary intake aperture 45 is open (pass fluid). In this illustration, the intake cam 11 rotates 37°. The intake port 10 is open for 29°. The cams in this device rotate are quarter-speed cams, i.e. they rotate 90° when the crankshaft (not shown) rotates 360°. To calculate the duration of this device the following formula is used: ([intake cam 11 duration of 37°+intake port 10 duration of 29°]*360/90). The resulting duration is 264° as calculated as follows: ([37°+29°]*4)=264°. Faces of intake section 6 and center section 7 are identified as follows: intake outside face 410, intake bottom face 430, intake top face 435, center bottom face 650, and center top face 655.

Figure 124:
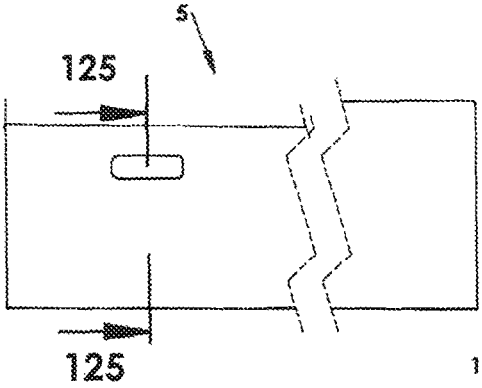

FIG. 124 provides a side view of cylinder head assembly 5. A cutting line for FIG. 125 is identified.

Figure 125:
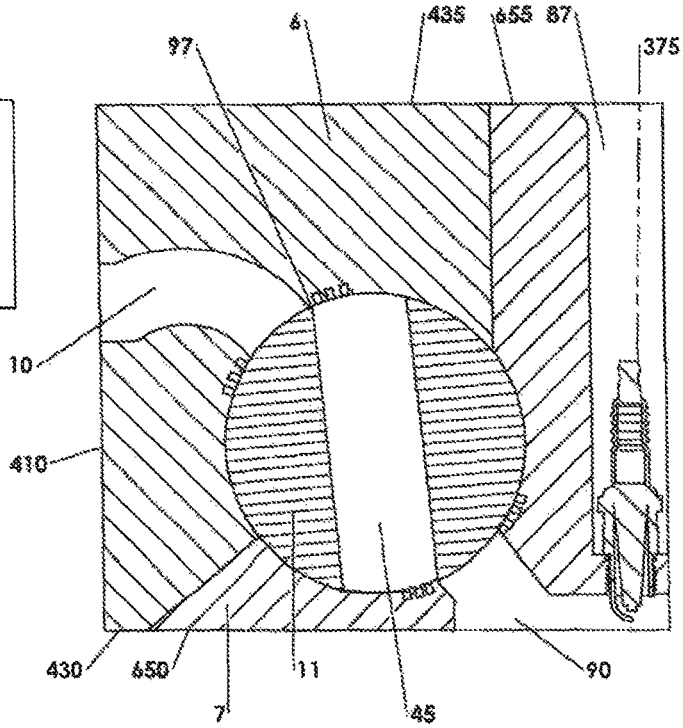

FIG. 125 depicts an embodiment of cylinder head assembly 5, in a cropped sectional view, illustrating the relationship between intake port 10, intake cam 11, center section 7 and spark plug 375 and to illustrate how duration is measured. Note: Duration is measured in degrees of crankshaft rotation. This view is a bare part, i.e., intake section 6, center section 7, intake cam 11, and spark plug 375 only. The intake cam 11 rotated to close the intake valve 97. Measurement of duration has ceased. Faces of intake section 6 and center section 7 are identified as follows: intake outside face 410, intake bottom face 430, intake top face 435, center bottom face 650, and center top face 655.

Figure 126:
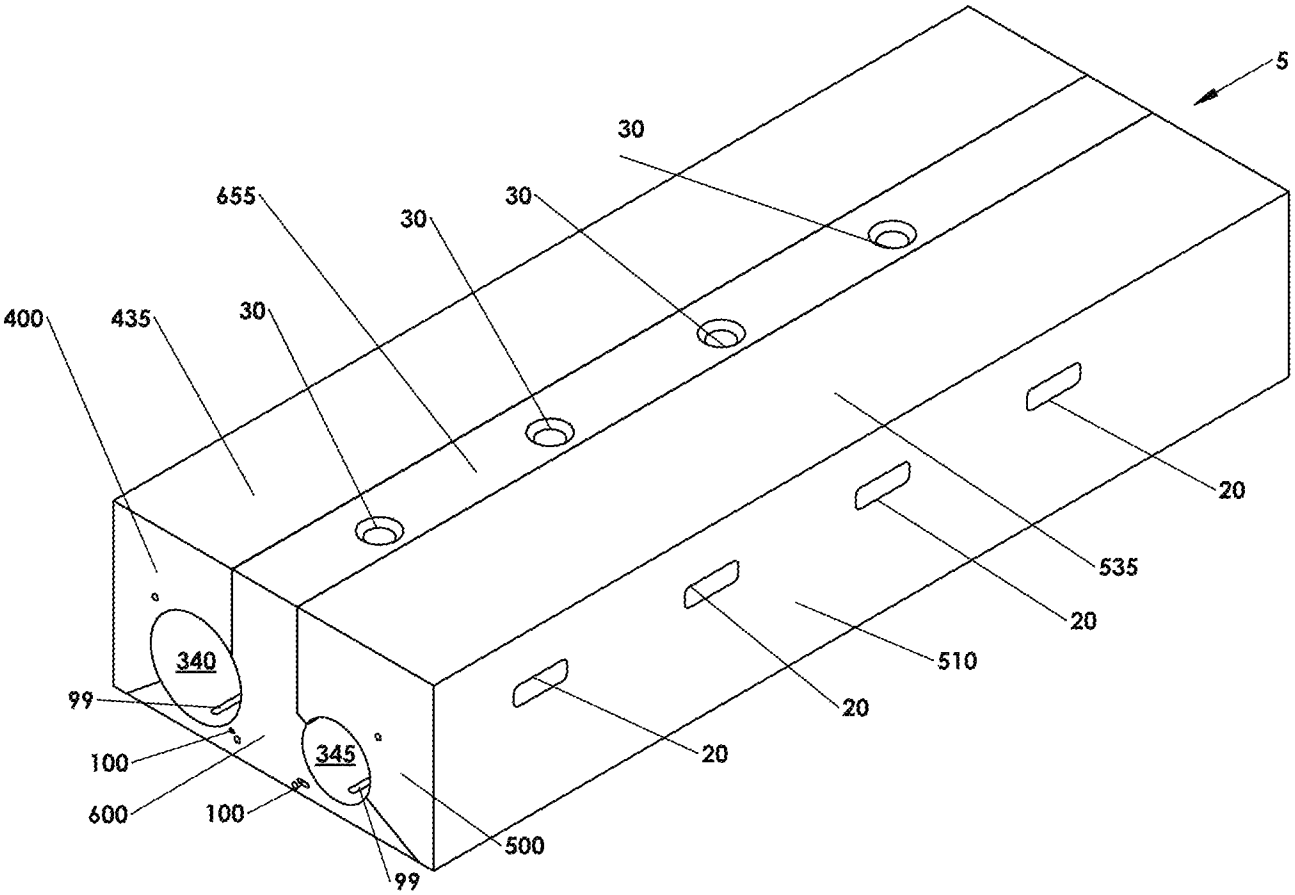

FIG. 126 depicts an embodiment of cylinder head assembly 5. This view is a bare part, i.e., intake section 6, center section 7, exhaust section 8 only. The relationship between the cylinder head assembly 5 and the intake camshaft sleeve 340 and exhaust camshaft sleeve 345 is depicted. Faces of intake section 6, center section 7, and exhaust section 8 are identified as follows: intake front face 400, intake top face 435, exhaust front face 500, exhaust outside face 510, exhaust top face 535, center front face 600, center top face 655.

Figure 127:
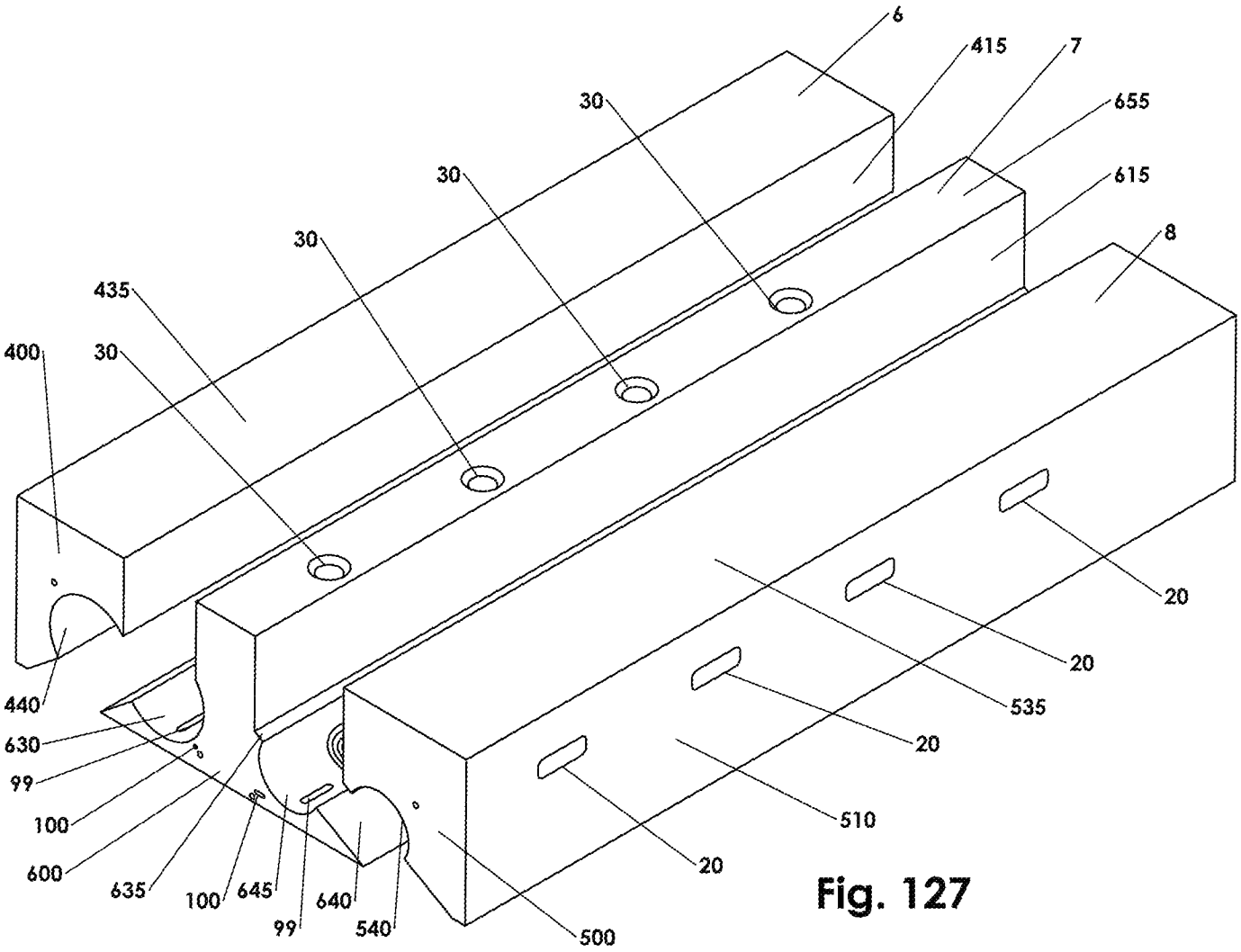

FIG. 127 depicts an exploded view of the cylinder head assembly 5. Features and faces of the intake section 6, center section 7, exhaust section 8 are depicted: exhaust port 20, spark plug access opening 30, lubricating oil return passageways 99, lubricating oil inlets 100, intake front face 400, intake back face 405, intake outside face 410, intake inside face 415, intake upper sealing face 420, intake lower sealing face 425, intake bottom face 430, intake top face 435, intake cam apse 440, exhaust front face 500, exhaust outside face 510, exhaust cam apse 540, center front face 600, center exhaust side face 615, center intake cam apse 630, center upper sealing face-exhaust 635, center lower sealing face-exhaust 640, center exhaust cam apse 645, center top face 655.

The rifled shaft housing 210 designed to fit either intake section 6 or the exhaust section 8 of the cylinder head assembly 5. When attached to intake section 6, one oil return/vent port 314 will hang vertically acting as an oil return passageway 99, the other port, pointing horizontally acting as a vent port to the fluid containment system 364. When attached to the exhaust section 8, one oil return/vent port 314 will hang vertically acting as an oil return passageway 99, the other port, pointing horizontally, and acting as a vent port in communication with the fluid containment system 364. The rifled shaft housings 210 installs with the two vent ports attach to the housing-to-housing vent tube 322 and function as part of the fluid containment system 364.

Passageways in the head 5 exist between at ports 10, 20. Passageways in the camshafts 11, 12 exist between apertures 40, 45, 60, 65. The apertures 40, 45, 60, 65 and ports 10, 20 combine to become valves 97, 98. An intake cam 11 and an exhaust cam 12 rotate in the same direction.

The manner of operation is different from other known camshaft(s)/head systems in present use. Namely, the valve camshafts 11, 12 not only rotate on their lengthwise axis, they also shift laterally, in unison, on their lengthwise axis to one of at least two operational positions (primary or secondary). In the primary position, apertures 40, 60 overlap ports 10, 20 permitting flow. In the secondary position, apertures 45, 65 overlap ports 10, 20 permitting flow. The apertures are the primary intake 40, secondary intake 45, primary exhaust 60, and secondary exhaust 65. The camshafts 11, 12 operate in the primary position at idle RPMs to 1500-2000 RPMs. Above this RPM range, the camshafts operate in the secondary position, i.e. aligning their secondary apertures 45, 65 with the ports 10, 20.

This device is designed to function with camshafts that rotate clockwise or counterclockwise. Sealing rings/springs 110, 115, 120, 125, 160, 165, 170, 175, are non-directional. Rotational direction does not dictate placement of sealing rings/springs 110, 115, 120, 125, 160, 165, 170, 175. Placement of oil-control devices/springs 105, 106, 155, 156, dictated by rotational direction. Regardless of rotation direction, clockwise or counterclockwise, aperture(s) 40, 45, 60, 65, must rotate past the oil-control devices/springs 105, 106, 155, 156, followed by sealing rings/springs 110, 115, 120, 125, 160, 165, 170, 175.

All depictions in this document utilize clockwise rotating camshafts. FIG. 42 depicts correct placement of oil-control devices/springs 105, 106 in intake side of the center section 7. This placement is applicable to the following: intake port 10 of intake section 6, exhaust port 20 of the center section 7, and exhaust port 20 of the exhaust section 8.

The precise timing and lateral movement of intake cam 11 and exhaust cam 12 is controlled by the engine's control system (not shown) to prevent damage to the engine.

The lateral positions of intake cam 11 and exhaust cam 12 is always either primary position or secondary position except during transition from one position to the other. The slave pins (3) 260 riding in the primary detent 300 or secondary detent 301 maintain lateral positioning of the camshafts. The articulated master pin 232 (a member of the sliding assembly 374) moves laterally to engage the master pin rifling 298. The master pin 232 is longer than the slave pin 260 and can only enter the master pin rifling 298 thereby controlling lateral movements. Double-acting solenoids contain two electromagnets (coils). This allows the solenoid armature 372 to shuttle back and forth depending upon which coil is activated. Lateral movements of intake cam 11 and exhaust cam 12 are initiated by a signal from the engine control system (not shown). The signal will activate the double-acting solenoid shell 238 to pull the sliding assembly 374. The master pin 232 engages the master-pin rifling 298 moving the rifled shaft 290 laterally which engages the slave-pins (3) 260 into slave-pin rifling (3) 296. The rotating camshafts 11, 12 moves laterally in the slave-pin rifling (3) 296 until the slave-pins 260 engage the primary detent 300 or secondary detent 301. Depending which coil is energized, the sliding assembly 374 can be pulled either direction.

There is an 8 mm border between an aperture and the oil control device. That could increase to 23 mm, but it would necessitate a redesign of both cams and all three parts of the cylinder head, rifled shaft, rifled shaft housing and the two telescoping members. Additionally, some of the oil return ports would need to be repositioned to accommodate the additional 15 mm.

Lubricating oil, under pressure, is supplied by an engine block (not shown) machined to match with lubricating oil inlets 100 in the cylinder head. The same engine block (not shown) will also contain passageways to match with oil return passageways 99. These passageways would channel the lubricating oil to the engine block oil pan (not shown). There the oil pump (not shown) picks up the oil and returns it to the lubricating oil inlets 100.

Electronic cam advance-retard device: this is an optional device designed to provide more torque or less torque. More torque is required, to get a vehicle moving from a start, when it is heavily laden or towing another vehicle or trailer. Less torque is needed on slippery surfaces such as: wet, snowy, icy, or any surface with limited traction. Lowering the torque reduces the possibility of wheel(s) losing traction.

What is claimed is:

1. A cylinder head assembly for an internal combustion engine comprising:

a. at least one intake camshaft and at least one exhaust camshaft wherein each said camshaft is cylindrical and has a center axis, a length, a width, a height, an outer surface, a proximal end adjacent to a rifled shaft actuator, and a distal end opposite said proximal end;

b. a cylinder head having at least one intake port and at least one exhaust port, wherein said cylinder head houses at least one combustion chamber intake port and at least one combustion chamber exhaust port, wherein said at least one combustion chamber intake port and said at least one combustion chamber exhaust port are in communication with a combustion chamber;

c. a cylindrical intake camshaft sleeve formed from the union of an cylinder head intake camshaft receiving apse and an aspiration head intake camshaft receiving apse, wherein said intake camshaft sleeve is in communication with said at least one cylinder head intake port and said at least one combustion chamber intake port and said cylindrical intake camshaft sleeve is configured to receive said intake camshaft;

d. a cylindrical exhaust camshaft sleeve formed from the union of an cylinder head exhaust camshaft receiving apse and an aspiration head intake camshaft receiving apse, wherein said exhaust camshaft sleeve is in communication with said at least one cylinder head exhaust port and said at least one combustion chamber exhaust port and said cylindrical exhaust camshaft sleeve is configured to receive said exhaust camshaft;

e. a plurality of intake camshaft aspiration ports extending through said at least one intake camshaft, wherein said intake camshaft aspiration ports are arranged linearly in sets of different sizes so as to create an intake channel to permit the flow of fuel and air to said at least one combustion chamber through said intake camshaft and said cylinder head during an intake stroke of said piston;

f. a plurality of exhaust camshaft aspiration ports extending through said at least one exhaust camshaft, wherein said exhaust camshaft aspiration ports are arranged linearly in sets of different sizes so as to create an exhaust channel to permit the flow of combustion byproducts from said at least one combustion chamber through said exhaust camshaft and said cylinder head during an exhaust stroke of said piston; and g. an intake rifled shaft actuator for said intake camshaft and an exhaust rifled shaft actuator for said exhaust camshaft, each said rifled shaft actuator having a rotating camshaft drive and a camshaft shifter, wherein said camshaft drive is in communication with said proximal end of a respective said camshaft and arranged to rotate said camshaft about said center axis when said camshaft drive is actuated and which moves said camshaft linearly through said camshaft sleeve when said camshaft shifter is actuated.

2. The cylinder head assembly of claim 1, wherein each said rifled shaft actuator possesses a rifled shaft in end-to-end communication with one respective said camshaft, said rifled shaft having master pin rifling and slave pin rifling which engage a master pin and a slave pin of said camshaft shifter when said master pin or said slave pin is actuated so as to cause said rifled shaft and one respective said camshaft to travel linearly along said center axis of one respective said camshaft during the time when said master pin engages said master pin rifling.

3. The cylinder head assembly of claim 2, wherein said rifled shaft possesses slave pin rifling which terminates at opposing ends of said rifled shaft at a first rifled shaft positioning detent and a second rifled shaft detent.

4. An oil control and compression ring assembly for a cylindrical camshaft sleeve comprising rings which seat within said camshaft sleeve around each said intake aspiration port, said intake combustion chamber port, said exhaust combustion chamber port, and said exhaust aspiration port, wherein each said ring is comprised of a plurality of ring segments having ring segment joints which maintain a seal during thermal expansion and cooling of said ring segments.

5. The oil control and compression ring assembly of claim 4, wherein said ring segment joints are selected from the group consisting of butt joints, angle joints, overlapped joints, convex step type joints, angle step type joints, and hook joints.

6. The oil control and compression ring assembly of claim 4, further possessing an oil control ring segment.

7. The oil control and compression ring assembly of claim 6, wherein each said ring is tensioned by a spring.

8. The oil control and compression ring assembly of claim 7, wherein said spring is selected from the group consisting of accordion springs, flat springs, and leaf springs.

9. The method of modifying the port size of an engine by linearly moving a camshaft housed within a ported camshaft sleeve along a camshaft center axis to align linearly arranged camshaft ports of differing of sizes with engine ports so as create at least one intake channel and at least one exhaust channel and to change a combustion chamber's volumetric throughput of gases when said camshaft moves to arrange ports of a different size with said engine ports.

10. The method of claim 9, wherein said camshaft rotates within said camshaft sleeve to open and close said engine ports.

11. The method of claim 10, wherein said camshaft rotation is controllably timed to open and close said engine ports to coincide with an appropriate engine cycle.

12. The method of claim 11, wherein said camshaft is positioned within said camshaft sleeve through the controlled engagement of a master pin and at least one slave pin within master pin rifling and slave pin rifling on a rifled shaft in communication with an end of said camshaft while said camshaft is rotating so as to move said camshaft linearly within said camshaft sleeve during the engagement of said pins with said rifling.

* * * * *